US005210370A

United States Patent [19]

Mraz et al.

[11] Patent Number: 5,210,370

[45] Date of Patent: May 11, 1993

[54] LIGHTWEIGHT WEAPON STABILIZING SYSTEM

[75] Inventors: William A. Mraz, Middlebury; Martin E. Buttolph, Newport; Michael J. Farney, Newport Center, all of Vt.

[73] Assignee: Royal Ordnance, London, England

[21] Appl. No.: 608,299

[22] Filed: Nov. 2, 1990

Related U.S. Application Data

[63] Continuation-in-part of Ser. No. 463,801, Jan. 11, 1990, abandoned, which is a continuation of Ser. No. 147,317, Jan. 22, 1988, abandoned.

[51] Int. Cl.[5] ..... F41A 23/30

[52] U.S. Cl. ..... 89/40.11; 89/40.09; 89/37.14; 89/37.13; 89/43.01

[58] Field of Search ..... 89/37.05, 37.13, 37.14, 89/37.21, 40.11, 40.02, 40.09, 37.07, 37.11, 38, 39, 40.16, 40.01, 42.01, 42.02, 43.01

[56] References Cited

U.S. PATENT DOCUMENTS

| | | | |
|---|---|---|---|
| 33,646 | 11/1861 | Henson | 89/37.01 |
| 378,333 | 2/1888 | Noble | 89/43.01 |
| 439,570 | 10/1890 | Anderson | 89/43.01 |
| 463,463 | 11/1891 | Spiller | 89/38 |
| 569,224 | 10/1896 | Morgan | 89/39 |
| 1,032,869 | 7/1912 | Völler | 89/42.03 |
| 1,340,415 | 5/1920 | Schneider | 89/40.11 |
| 3,114,291 | 12/1963 | Ashley | 89/42.01 |
| 4,485,722 | 12/1984 | Metz et al. | 89/43.01 |

FOREIGN PATENT DOCUMENTS

| | | | |
|---|---|---|---|
| 68166 | 1/1983 | European Pat. Off. . | |
| 75137 | 5/1894 | Fed. Rep. of Germany . | |
| 445552 | 6/1927 | Fed. Rep. of Germany . | |
| 685257 | 7/1930 | France . | |
| 833183 | 10/1938 | France . | |
| 918219 | 2/1947 | France . | |
| 8906778 | 7/1989 | PCT Int'l Appl. . | |
| 169746 | 6/1934 | Switzerland . | |
| 7443 | of 1888 | United Kingdom . | |
| 18084 | of 1893 | United Kingdom . | |
| 15307 | 6/1909 | United Kingdom | 89/37.01 |
| 494304 | 10/1938 | United Kingdom . | |

*Primary Examiner*—Stephen M. Johnson
*Attorney, Agent, or Firm*—Mason, Fenwick & Lawrence

[57] ABSTRACT

A gun system comprising a recoiling cannon assembly, a stationary carriage having a cradle, and a campath and cam follower mechanism for moveably mounting the cannon assembly on the cradle for travel along a two-stage curvilinear recoil path. The first stage has a linear portion shaped to maintain prefiring orientation, and a curved portion with a decreasing radius of curvature in the direction of travel (i.e., recoil) to accelerate the cannon assembly upwards. The second stage, which may be straight or have a curved configuration different from that of the first stage, causes the cannon assembly's upward motion to be decelerated in a controlled manner. A recoil buffer assembly has deceleration characteristics matched in a predetermined relationship to the configuration of the curvilinear path, so that the instantaneous stabilizing moment of the reaction to the upward force of the recoiling cannon assembly and the moment of the static weight of the gun system. The campath mechanism can be mounted on the cannon assembly or on the cradle, with the cam follower mechanism correspondingly mounted on the cradle or cannon mechanism respectively.

13 Claims, 19 Drawing Sheets

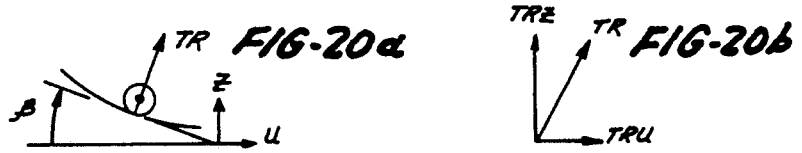
FIG-21
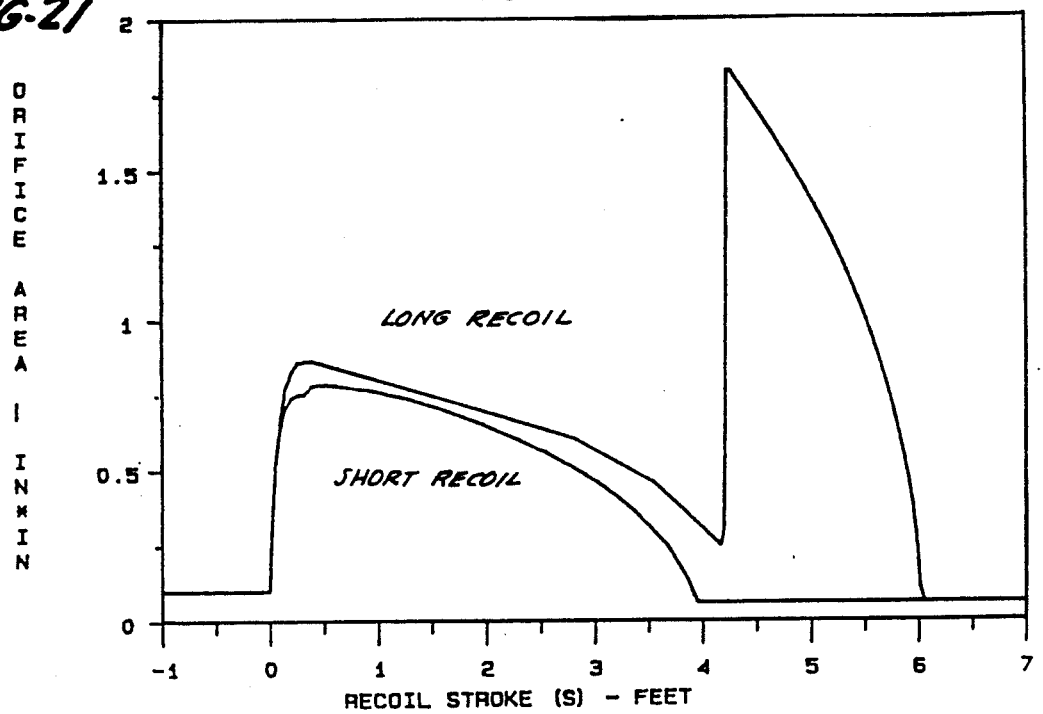
FIG-22
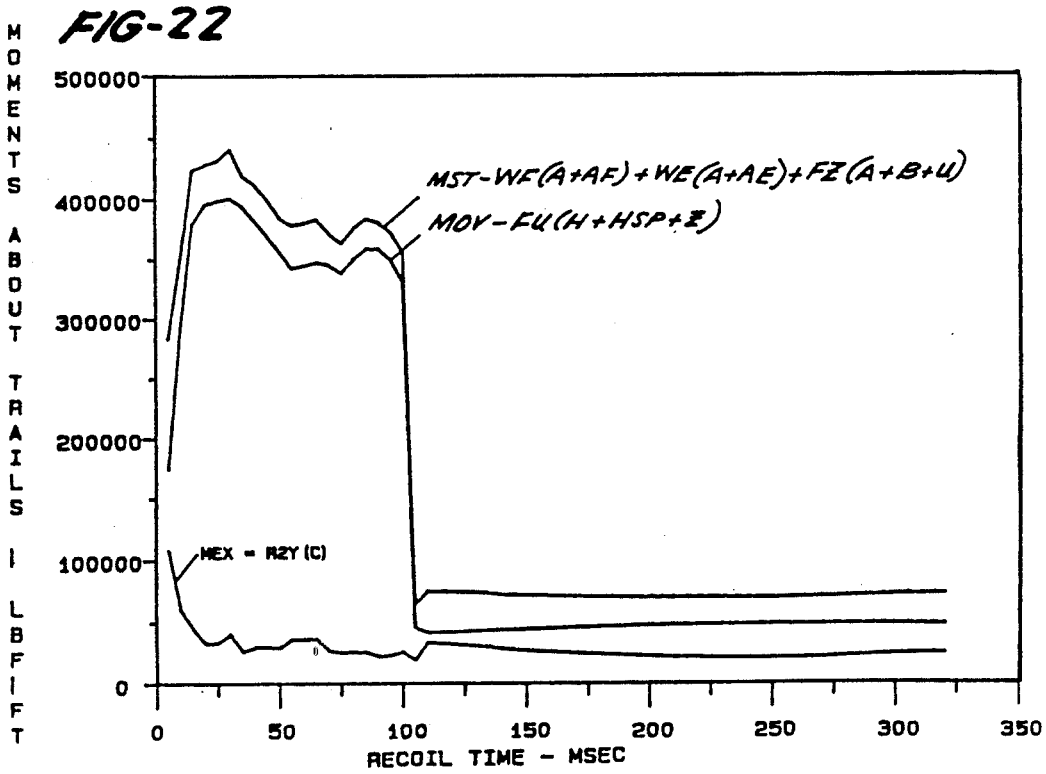

LIGHTWEIGHT WEAPON STABILIZING SYSTEM

BACKGROUND OF THE INVENTION

This application is a Continuation-In-Part of U.S. patent Ser. No. 463,801, filed Jan. 11, 1990, and now abandoned, which is a Continuation of U.S. patent Ser. No. 147,317, filed Jan. 22, 1988, and now abandoned.

The present invention is directed to the field of gun systems, and more specifically directed to a stabilizing system using curvilinear recoil energy management to improve weapon stability for gun systems, especially towed artillery.

Recoil systems currently in use for artillery, and particularly towed artillery, are strictly rectilinear. In other words, the axis of motion during recoil is coaxial with the tube axis. Retardation of the recoiling parts is provided by one or more hydropneumatic cylinders, in which a working fluid is forced through one or more orifices. In these currently used systems, the moment of retarding force tends to tip the gun over backwards. Opposing this is the moment of weapon weight about the trail ends. If the overturning moment exceeds the downward weight moment, the weapon will momentarily lift about its trail ends. This condition is termed "instability," and is undesirable because of (1) possible damage to the weapon and (2) gross weapon movement requiring resighting.

An alternative, non-rectilinear, recoil system is disclosed in U.S. Pat. No. 3,114,291 to Ashley. As shown in Ashley's FIG. 1, the system makes use of levers and guides. There are two guideways 8 and 23 and two levers 6 and 7. Levers 6 and 7 connect slide 9 and guideway 8 to barrel 5. Lever 7 extends to a second guideway 12, which can be curved, so that during recoil the barrel is forced to a rearward and upward position. The barrel is moved so that the recoil force is directed down, rather than only back. However, Ashley does not address the problem of controlled deceleration of upward velocity to maintain stability, so that the lightweight weapon stability problem remains unsolved.

German Patent No. 75137 to Ollivier describes a curved recoil path which causes increased pressure of adhesion between the gun and the ground, and states that the path may be either a circular arc or some other geometric curve, or even a path formed by curves and straight lines. Ollivier does not however teach a two-stage curvilinear path, with the first stage inducing a vertical acceleration component to the recoiling mass and a second stage for controlling vertical deceleration of the mass.

Significantly, neither Ashley or Ollivier teach how the characteristics of a recoil buffer system and the shape of the guideway o recoil path can be matched to optimize stability.

U.S. Pat. No. 439,570 to Anderson and U.S. Pat. No. 463,463 to Spiller disclose "disappearing" guns which, after being fired, rotate vertically so that they descend behind a wall. This motion is caused by recoil. Anderson and Spiller also do not solve the problem of lightweight weapon stability. Also, Anderson and Spiller disclose gun mountings which are suitable for use only with heavy ordnance.

In summary, no system exists which addresses the problem of deceleration of upward velocity and which uses recoil means to optimize stability in a manner applicable to lightweight towed weapons. It is the solution of these and other problems to which the present invention is directed.

SUMMARY OF THE INVENTION

Therefore, it is the primary object of this invention to provide a system for providing improved weapon stability for gun systems.

It is another object of this invention to provide a system for providing improved weapon stability for towed artillery.

It is still another object of this invention to provide a weapon stabilizing system for use with lightweight artillery.

It is still another object of this invention to provide a weapon stabilizing system which imposes a transient stabilizing moment during times of high destabilizing recoil loads.

It is yet another object of this invention to provide a weapon stabilizing system in which the transient stabilizing moment is tailored to overcome the destabilizing recoil loads to assure that the weapon never lifts off the ground.

It is yet another object of this invention to provide a weapon stabilizing system which does not rely solely on the static moment of weapon weight about the trail ends, so that a lighter structure can be employed without fear of instability.

The foregoing and other objects of the invention are achieved by provision of a gun system having a fixed carriage and a cradle for elevating the gun supported by the carriage and which remains relatively fixed during the firing cycle. A recoiling cannon assembly is moveably mounted in relation to the cradle so that the cannon assembly can travel on a defined recoil path. The gun system has recoil braking means for decelerating the cannon assembly and conventional recouperator means for returning the cannon assembly to its original prefiring orientation. The recoil path is a two-stage curvilinear path, the first stage having a curved configuration portion to produce an upward force and vertical acceleration component to the center of mass of the recoiling cannon assembly and the second stage having a configuration different from that of the first stage for causing controlled vertical deceleration of the cannon assembly during recoil. The recoil system generates a retarding force which predictably and controllably decelerates the cannon assembly, and is adapted such that the magnitude of the retarding force is matched in a predetermined relationship to the configuration of the two-stage curvilinear recoil path. In this way the instantaneous de-stabilizing moment of the recoil forces is overcome by the instantaneous stabilizing moment of the forces resulting from the reaction to the upward force of the recoiling cannon assembly in the curved configuration portion of the first stage of the curvilinear recoil path, and the moment of the static weight of the gun system.

It is therefore possible by dynamic analysis of the forces in operation during recoil to select or design suitable characteristics for the recoil system, and by appropriate design of the exact configuration of the two-stage curvilinear recoil path in relation to such characteristics, to maximize the stabilizing moment of the reaction to the upward force of the recoiling cannon assembly in relation to the destabilizing moment of the recoil system. In this way, the moment of the static weight of the gun system required to maintain stability is minimized. This allows the static weight of the gun system to be reduced while maintaining stability.

The first stage of the two-stage curvilinear recoil path preferably has a linear portion shaped to maintain the prefiring orientation of the cannon assembly at the beginning of recoil. The curved configuration portion of the first stage preferably has a portion of decreasing radius of curvature in the direction of recoil travel. The second stage of the two-stage curvilinear recoil path may be either linear or curved in either the same or the opposite direction as the first stage, or a combination of these, as necessary. If curved in the same direction as the first stage, the second stage will have a shallower curve than that of the first.

In one aspect of the invention, the mechanism for moveably mounting the cannon assembly in relation to the cradle comprises a campath mechanism and a cam follower mechanism associated with the campath mechanism, the campath mechanism having a first stage having a curved portion and a second stage, which is either curved or straight, or both. The campath mechanism can be fixedly mounted on the cannon assembly, with the cam follower mechanism fixedly mounted on the carriage portion, or the campath mechanism can be fixedly mounted on the carriage portion with the cam follower mechanism being fixedly mounted on the cannon assembly.

When used on a weapon such as a Light Towed Howitzer, the mounting mechanism causes the weapon to remain stable (that is, to remain in contact with the ground) at all times under all firing conditions. Application of the mounting mechanism to an otherwise standard weapon results in a weapon which weighs considerably less than current weapons of similar performance. In a specific application, this apparatus results in a weight reduction of more than 40% over the lightest 155 mm towed howitzer currently in service.

A better understanding of the disclosed embodiments of the invention will be achieved when the accompanying detailed description is considered in conjunction with the appended drawings, in which like reference numerals are used for the same parts illustrated in the different figures.

BRIEF DESCRIPTION OF THE DRAWINGS

FIGS. 20*a* and 20*b* are vector diagrams showing the forces acting on the cannon for the first embodiment of the stabilizing system of the invention; and FIG. 21 is a graph plotting orifice areas for long and short recoils for the first embodiment of the stabilizing system of the invention;

FIG. 22 is a graph plotting moments versus recoil time;

DESCRIPTION OF THE PREFERRED EMBODIMENTS

Figure 1:
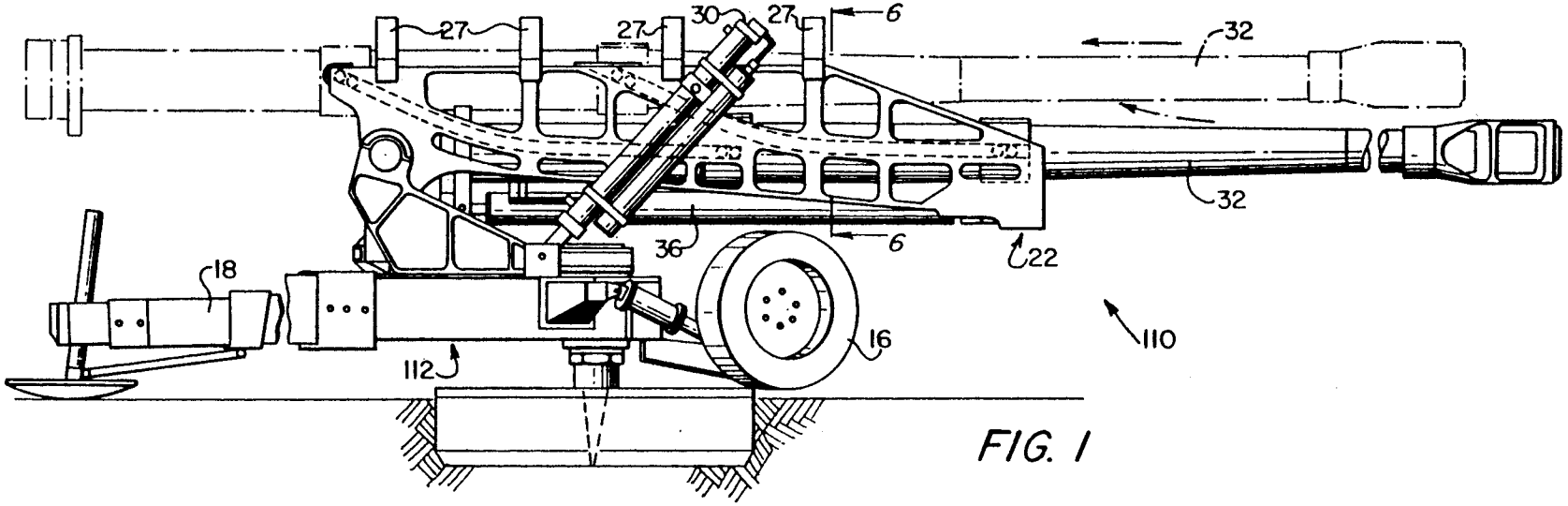
FIG. 1 is a right elevational view of a light weight towed Howitzer incorporating a first embodiment of the stabilizing system of the invention.
Figure 2:
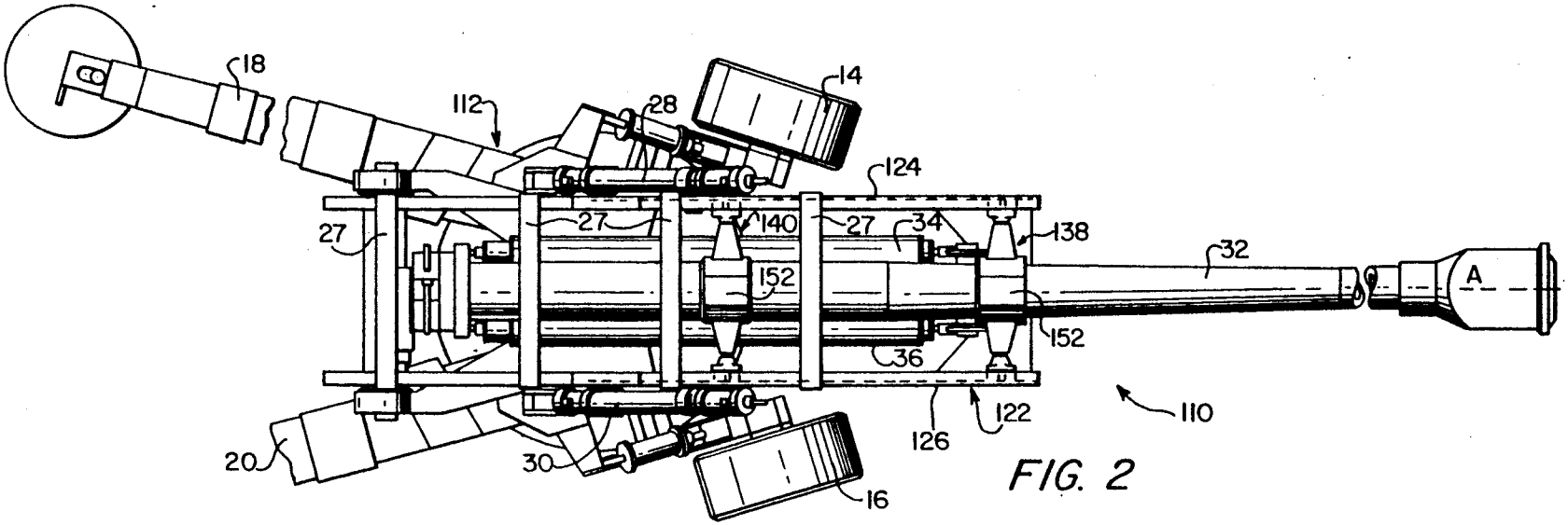
FIG. 2 is a partial, top plan view of FIG. 1.

In the present invention, curvilinear recoil is used to provide stability to a lightweight towed Howitzer or the like. As will be described in greater detail below, curvilinear recoil works as follows: the recoiling parts travel rearwardly and upwardly during recoil in curved tracks mounted to the recoil cradle assembly.

Weapon stability requires the balancing of the destabilizing (recoil) moment by an equal and opposite stabilizing moment. In conventional towed weapons, e.g. an M198 Howitzer which weighs 15,000 pounds, this stabilizing moment is derived from gravity acting upon the weapon's mass. In the lightweight towed Howitzer, the weapon weight is 9,000 pounds, just over one-half that of existing large caliber weapons; the available stabilizing moment therefore is substantially reduced compared with that of the conventional weapon.

Our invention involves generating an additional vertical force which produces a supplemental stabilizing moment, counteracting the destabilizing moment of the recoil force. This vertical force acts upon the recoiling parts, resulting in a recoil path which is both rearward and upward. From the shape of this path, we have termed it "curvilinear" in contrast to conventional straight-line or "rectilinear," recoil motion.

The application of a vertical upward force to the recoiling parts causes an equal and opposite downward reaction force on the non-recoiling parts in accordance with Newton's Third Law. This downward reaction supplements the gravitational force, and acts as a stabilizing moment about the trail ends, permitting recoil loads to be higher without an unstable condition resulting. The vertical force on the recoiling parts results in an upward velocity, and this velocity must be returned to zero by the end of the recoil stroke. This results in a two stage recoil cycle, which is described with respect to a lightweight towed 155 millimeter Howitzer incorporating a first embodiment of the invention.

Referring now to FIGS. 1–7, there is shown a conventional lightweight towed 155 millimeter Howitzer 110 modified to incorporate a first embodiment of the stabilizing system of the invention. Howitzer 110 comprises a conventional stationary carriage mechanism 112 comprising an upper carriage 112*a* and a lower carriage 112*b* and ground contact 112*c* supported by conventional running gear 14 and conventional trails and trail end ground contacts 18. A cradle assembly 122 having left and right sides 124 and 126 held together at the top by cross members 27 and modified according to the invention as will be described in greater detail hereinafter is pivotally mounted on upper carriage 112*a*. Cradle assembly 122 is rotated up or down by conventional elevation and traverse means, shown here as left and right pistons 28 and 30.

As shown in FIG. 1, a cannon assembly 32 having a longitudinal tube axis A is mounted in cradle assembly 122 for reciprocating movement between a first, forward and downward position (solid lines) and a second, rearward and upward position (dashed lines). Most of the recoil energy is absorbed and the cannon is returned to battery by a conventional recoil recuperator mechanism assembly, such as left and right recoil/recuperator cylinders 34 and 36 pivotally mounted between cradle assembly 122 and cannon assembly 32.

Cannon assembly 32, cradle assembly 122, and recoil mechanism assembly 34, 36 define the elevating mass of Howitzer 110. Cannon assembly 32, cradle assembly 122, recoil mechanism assembly 34, 36, and upper carriage 112*a* define the traversing mass of Howitzer 110. Cannon assembly 32 and recoil mechanism assembly 34, 36 define the recoiling mass of Howitzer 110.

The mounting mechanism for cannon assembly 32 includes a forward yoke 138 positioned forward of the tube center of mass and a rearward yoke 140 positioned rearward of the tube center of mass. Yokes 138 and 140 comprise cylindrical central collars 142 and 144, respectively, for supporting and housing cannon assembly 32 and forward left and right ears 146*a* and 146*b* and rearward left and right ears 148*a* and 148*b*, respectively, in the form of tapered structures extending from either side of central collars 142 and 144. Each collar includes a torque key 150 to prevent spinning between the yoke and the cannon tube, and a doubler 152 enveloping torque key 150. Forward left and right twin roller sets 154*a* and 154*b* are mounted on forward left and right ears 146*a* and 146*b* and rearward left and right twin roller sets 156*a* and 156*b* are mounted on rearward left and right ears 148*a* and 148*b*, respectively, via stub axles 162. Left twin rollers 154*a* and 156*a* preferably are flat, i.e., have rectangular longitudinal cross-sections, while right twin rollers 154*b* and 156*b* are trapezoidal, i.e., have trapezoidal longitudinal cross-sections.

Figures 3, 4, 5:
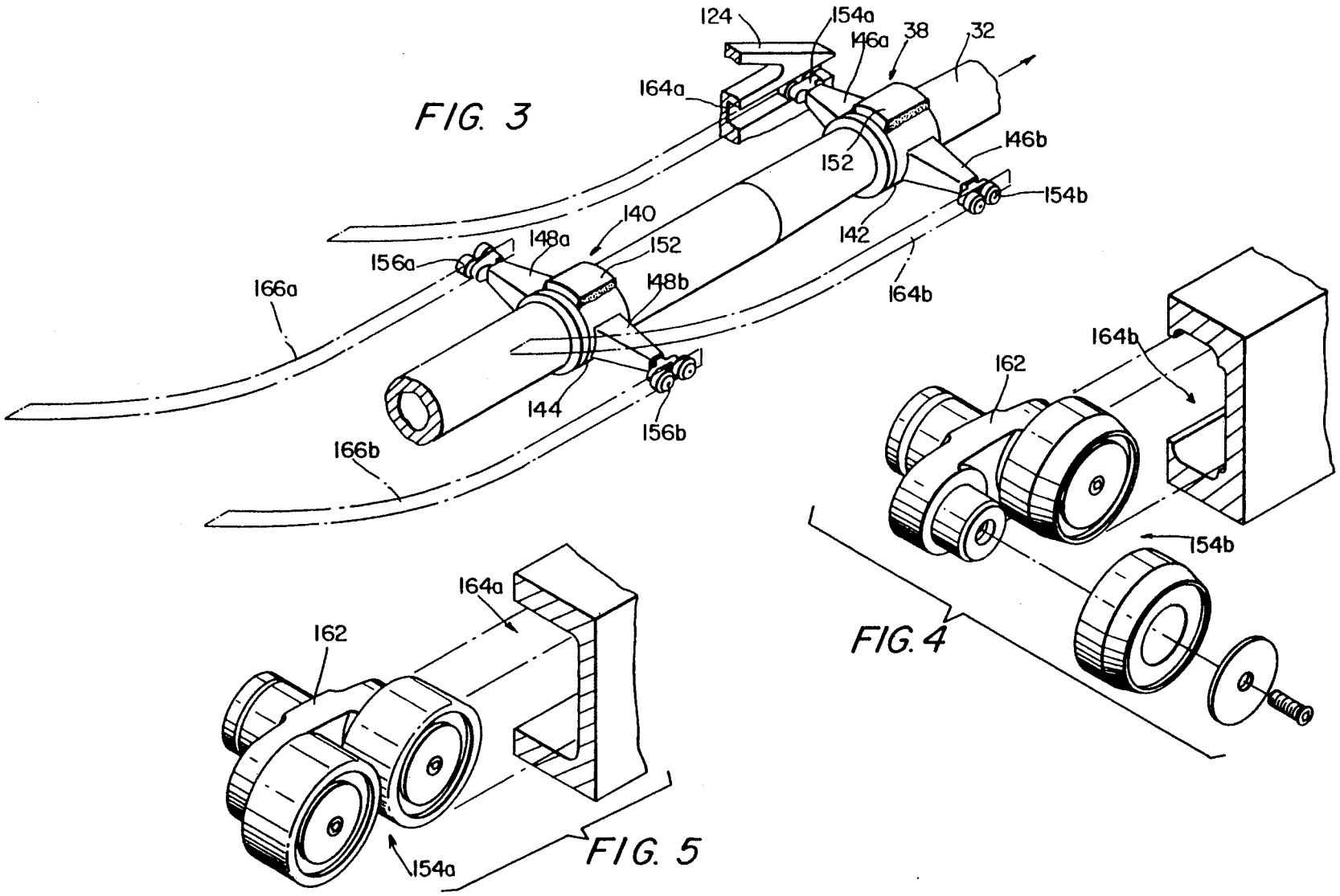
FIG. 3 is a partial perspective view of the mounting mechanism of the cannon shown in FIG. 1.
FIG. 4 is an exploded perspective view of a right side roller set and campath of the mounting mechanism shown in FIG. 3.
FIG. 5 is a perspective view of a left side roller set and campath of the mounting mechanism shown in FIG. 3.
Figure 6:
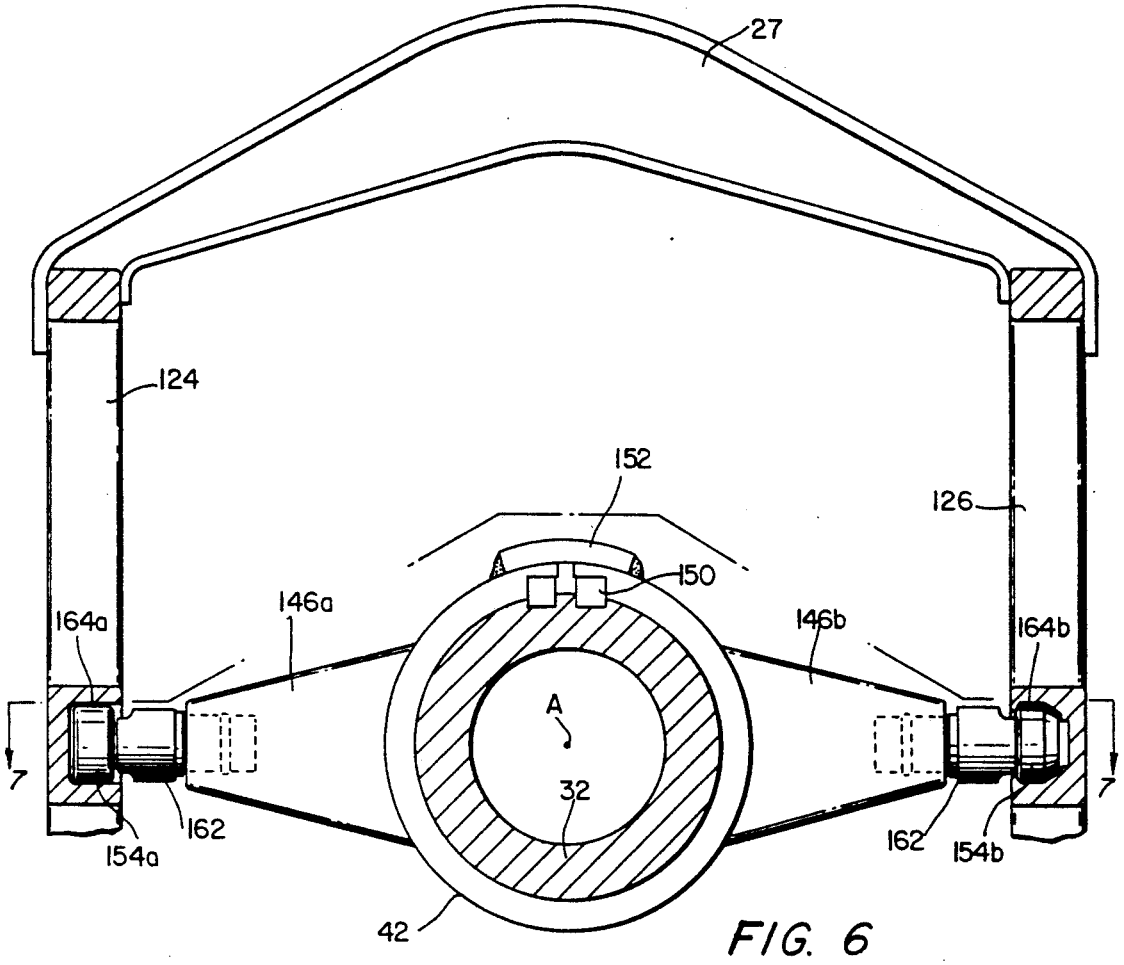
FIG. 6 is a cross-sectional view of the stabilizing system, taken along line 6—6 of FIG. 1.
Figure 7:
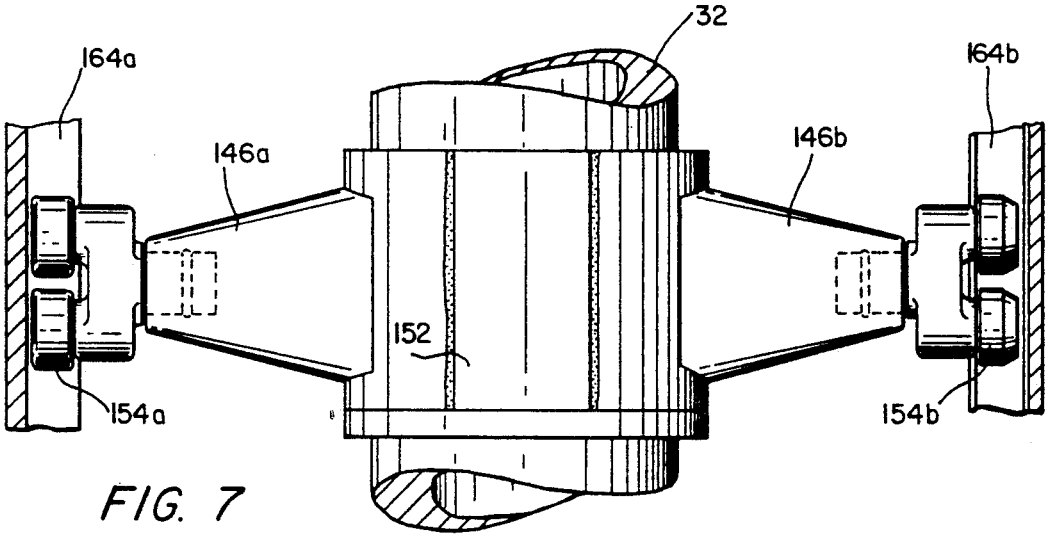
FIG. 7 is a top plan view of FIG. 6.

The left and right sides 124 and 126 of cradle assembly 122 are provided with forward left and right parallel campaths 164*a* and 164*b*, respectively, for movably engaging forward left and right roller sets 154*a* and 154*b*, and rearward left and right parallel campaths 166*a* and 166*b*, respectively, for movably engaging rearward roller sets 156*a* and 156*b*, respectively. Forward and rearward left campaths 164*a* and 166*a* have rectangular cross-sections, while forward and rearward right campaths 166*a* and 166*b* have cross-sections which are rectangular with a necked in portion at the outer face to better accommodate lateral thrust loads. The precise location of yokes 138 and 140 and their appended roller sets 154*a* and 154*b* and 156*a* and 156*b* is determined by convenience with respect to the overall weapon design. The locations will affect the division of force between the forward and rearward roller sets. As shown in FIGS. 1 and 3, campaths 164*a*, 164*b*, 166*a*, and 166*b* have identical configurations, consisting of a first, curved stage and a second, straight stage.

Most of the energy of the recoiling parts in a tube-axial direction, i.e. along tube axis A, is absorbed during the first stage of the recoil cycle. During this period, weapon stability is ensured by accelerating the recoiling parts (i.e., cannon assembly 32 and its mounting mechanism) in a direction normal to the tube axis A. The normal force is generated by the action of roller sets 154*a* and 154*b* and 156*a* and 156*b* attached to the recoiling parts on curved campaths 164*a* and 164*b* and 166*a* and 166*b*, Which are part of non-recoiling cradle assembly 122.

Figure 13:
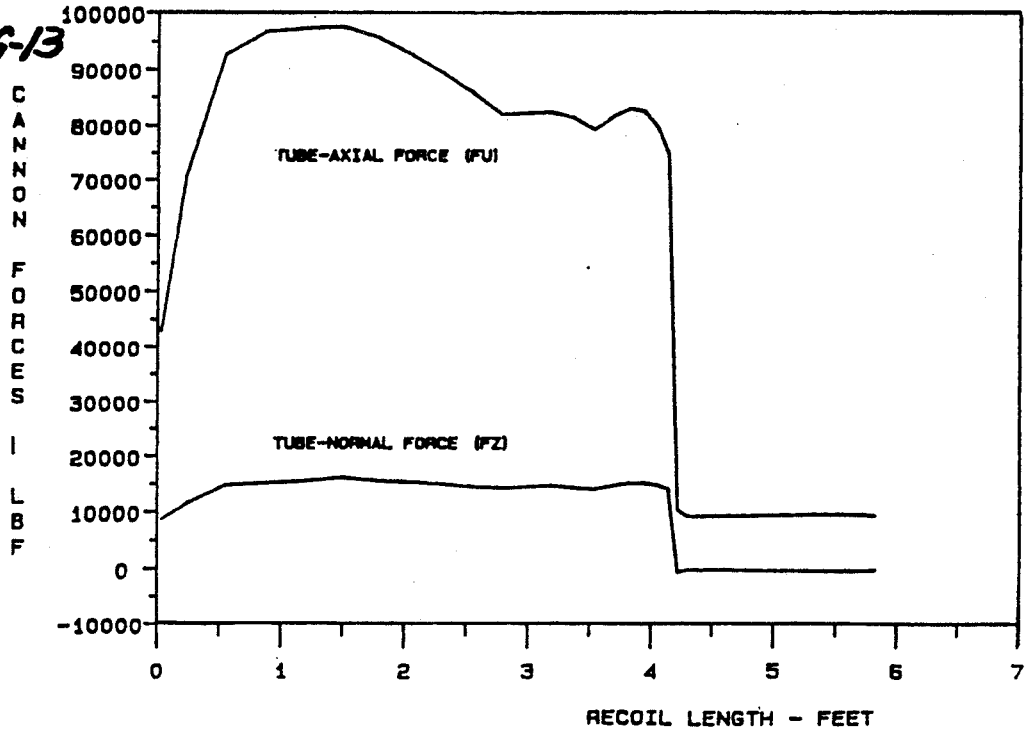
FIG. 13 is a graph plotting cannon reaction forces versus recoil length for the first embodiment of the stabilizing system of the invention.

The hydropneumatic recoil system (i.e. recoil cylinders 34 and 36) brakes the recoiling parts along tube axis A. When the recoil velocity has been reduced to an appropriate level by the recoil system, the recoiling parts will have both a small axial and small normal velocity. At this time (stage II), the high initial recoil force is reduced, and simultaneously the tube-normal force is removed by straightening campaths 164*a*, 164*b*, 166*a*, and 166*b*. Gravitational forces, plus a small component from recoil/recuperator cylinders 34 and 36, and a possible small contribution from the campaths 164*a*, 164*b*, 166*a*, and 166*b*, slow the recoiling parts to rest in a tube-normal direction by the end of the recoil stroke, as shown in FIG. 13.

Figure 12:
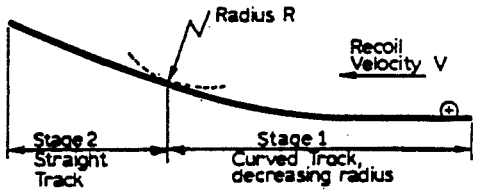
FIG. 12 is a graph plotting the path of the center of mass of the recoiling parts for the first embodiment of the stabilizing system of the invention.

More specifically, as FIG. 12 shows, the interaction of the cam followers (i.e. roller sets 154*a*, 154*b*, 156*a*, and 156*b*) and curved campaths (164*a*, 164*b*, 166*a*, and 166*b*, respectively) causes the center of mass of recoiling parts to follow a like curved path. A centrifugal force is generated whose magnitude is $$F = \frac{M \cdot V_{inst}^2}{R_{inst}}$$

and whose direction is along the local radius vector. $V_{inst}$ is the instantaneous velocity of the center of mass of the recoiling parts. $R_{inst}$ is the corresponding radius of curvature of the campath at the point of contact between roller sets 154*a*, 154*b*, 156*a*, and 156*b* and campaths 164*a*, 164*b*, 166*a*, and 166*b*, respectively.

When fired, the specific combination of projectile and propelling charge will produce a predictable firing recoil impulse, determinable by testing of the specific combination of projectile and propelling charge or through tables. This in turn will cause the recoiling parts of the gun to move rearwardly at a predetermined velocity, likewise determinable by testing or from tables The recoil system causes this velocity to be diminished in a controlled manner by applying a retardation force, determined by choice of the orifice size through which the recoil working fluid is forced. Again, the retardation force is determinable either by testing of the cylinder or through tables. In this manner, the force applied by the recoil system is known and predictable at any point in the recoil stroke. Additionally, the remaining velocity of the recoiling part is also known an predictable. The overturning moment is thus known and predictable at all points in the recoil stroke.

The difference between the overturning and the stabilizing moment gives the minimum additional stabilizing moment required to maintain the gun in contact with the ground. This additional moment (plus any additional safety factor) is provided by the centrifugal force generated by the cam followers/campath interaction. Since the required instantaneous centrifugal force, together with the mass of the recoiling parts and their instantaneous velocity is now known, the corresponding value for radius of curvature can be predetermined. That is, $$R_{inst} = \frac{M \cdot V_{inst}^2}{F}$$

In this manner, the "y" (tube normal) coordinates of each of campaths 164*a*, 164*b*, 166*a*, and 166*b* can be determined for all corresponding values of "x" (tube-axial) coordinates.

At all points in the recoil stroke, the recoiling parts will have a velocity component in both the "y" direction (normal to tube axis A) and in the "x" direction (along tube axis A). Both of these velocities must be reduced to zero by the end of the recoil stroke. At some point in the recoil stroke, the centrifugal force is reduced to 0 by making the radius of curvature infinite (i.e., each of campaths 164*a*, 164*b*, 166*a*, and 166*b* becomes a straight line). Accordingly, the recoiling parts now cease their upward acceleration. The recoil system continues to apply a gentle retardation force, eventually bringing the recoiling parts to rest in both the "x" and "y" axes.

The final retardation force causes a small destabilizing moment, but its magnitude is such that it can be overcome by the stabilizing moment of the static weight of the complete weapon. In effect, the curvilinear recoil motion gives Howitzer 110 an apparent weight greater than the static weight of the weapon during the period of high recoil forces. The curvilinear campath is designed to assure that the stabilizing moment of the apparent weight of the gun is sufficient to overcome the overturning moment of the recoil retardation forces, maintaining ground contact. During the latter part of recoil travel, when the curvilinear recoil force has been discontinued, the apparent weight of Howitzer 110 is diminished but ground contact is still maintained.

A second, equally viable stability solution exists if, as shown in FIGS. 8–11, the positions of the campaths and the cam followers are reversed. Thus, referring now to FIGS. 8–11, there is shown a lightweight towed 155 millimeter Howitzer 210 incorporating a second embodiment of the stabilizing system of the invention. Howitzer 210 also comprises a carriage assembly 212, wheels 14 and 16, and trails 18 and 20. A cradle assembly 222 having left and right sides 224 and 226 and modified according to the second embodiment of the invention as will be described in greater detail hereinafter is pivotally mounted on carriage assembly 212. Cradle assembly 222 is pivoted up and down by left and right pistons 28 and 30.

Figure 8:
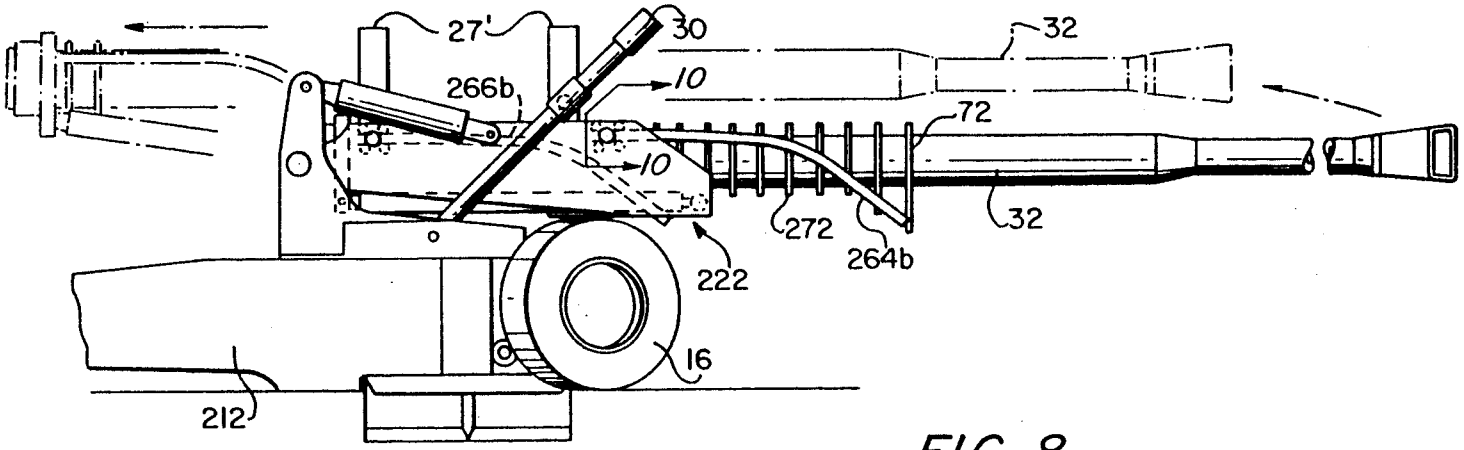
FIG. 8 is a partial, right elevational view of a light weight towed Howitzer incorporating a second embodiment of the stabilizing system of the invention.
Figure 9:
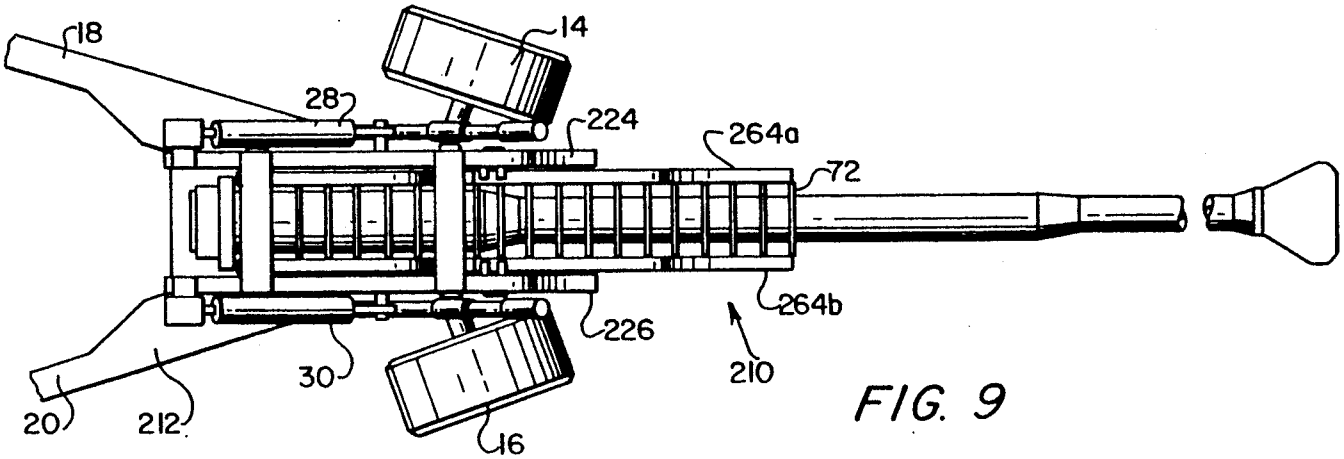
FIG. 9 is a top plan view of FIG. 8.
Figure 10:
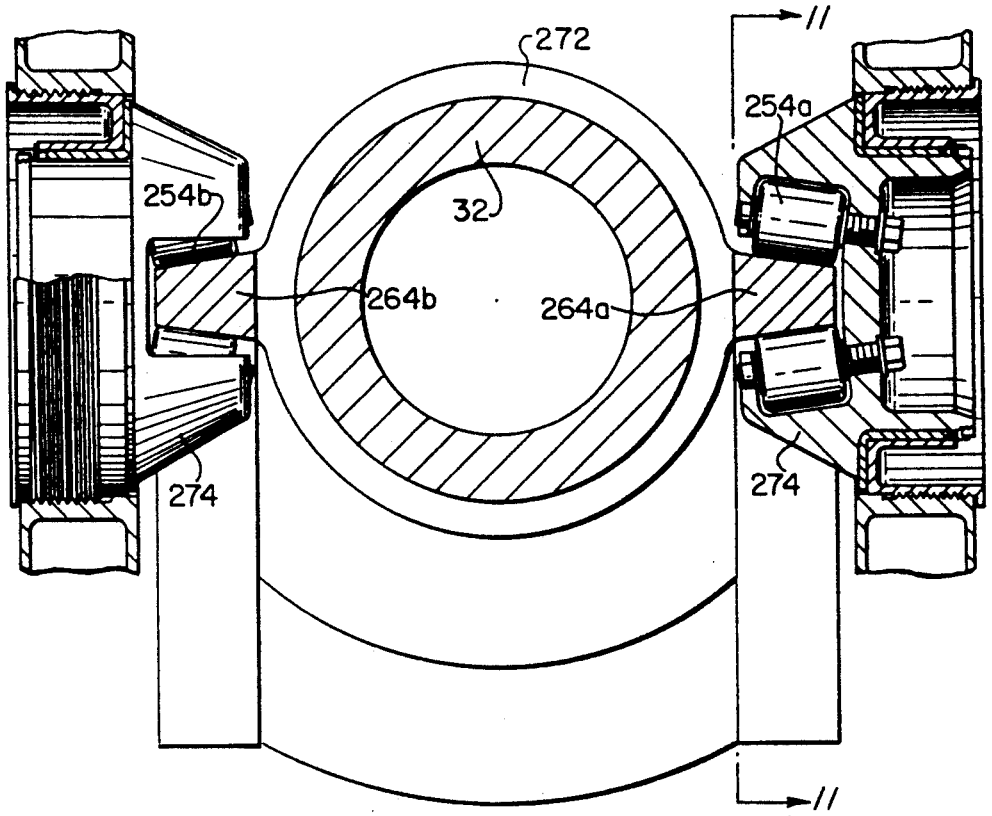
FIG. 10 is a cross-sectional view of the stabilizing system shown in FIG. 8, taken along line 10—10 of FIG. 8.
Figure 11:
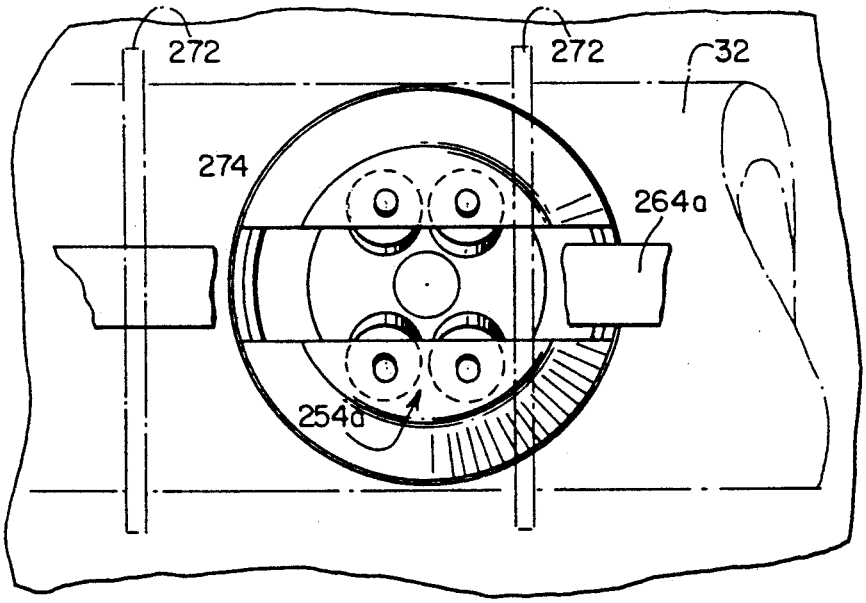
FIG. 11 is a cross-sectional view of the mounting mechanism of the cannon, taken along line 11—11 of FIG. 10.

As shown in FIG. 8, cannon assembly 32 is mounted in cradle assembly 222 for reciprocating movement between a first, forward and downward position (solid lines) and a second, rearward and upward position (dashed lines). The mounting mechanism for cannon assembly 32 according to the second embodiment of the invention is the reverse of mounting mechanism for cannon assembly 32 according the first embodiment of the invention, in that the campaths are positioned on cannon assembly 32, while the cam followers are positioned on cradle assembly 222. Specifically, the mounting mechanism for cannon assembly 32 comprises forward left and right campaths 264*a* and 264*b* and rearward left and right campaths 266a and 266b, welded or bolted or otherwise attached to track support collars 272 mounted on cannon assembly 32. Left and right sides 224 and 226 of cradle assembly 222 are provided with forward left and right roller sets 254a and 254b of twin rollers and rearward left and right twin roller sets 256a and 256b, respectively for movable engagement with forward left and right campaths 264a and 264b and rearward left and right campaths 266a and 266b, respectively. Each of roller sets 254a, 254b, 256a, and 256b, consists of four rollers, an upper twin roller set and a lower twin roller set, housed in a circular housing 74. Placement of the roller sets in a circular housing is important in that the housing provides the walking beam structure and strength required to make the roller (follower) system work. Circular housings 274 allow the rollers to stay perpendicular to the resultant tangent of the twin rollers to the campath, as the campath curves and angles upward or downward.

Choice of the design of either the first embodiment or the second embodiment of the invention does not affect the function of the stabilizing system, and is dictated by overall weapon design. In a further alternate design, the campath of either the first or the second embodiment can be curved in the opposite direction during the second stage of recoil; that is, towards tube axis A to achieve a greater retardation in the "y" axis (the tube-normal direction). Use of this alternate construction is limited by the requirement to keep ground contact during the second stage of recoil travel.

In a still further alternate design, the campath of either the first or the second embodiment can be curved in the same direction during the second stage of recoil. In this case the curve of the second stage is shallower than that of the first stage.

Figure 14A:
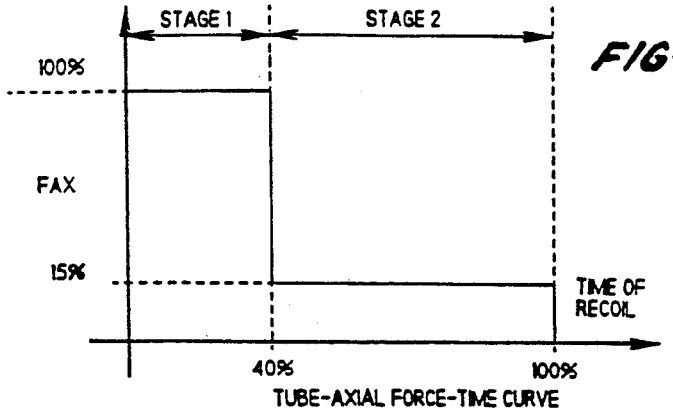
FIGS. 14*a* and 14*b* are graphs plotting axial and normal force, respectively, versus time for the first embodiment of the stabilizing system of the invention.
Figure 14B:
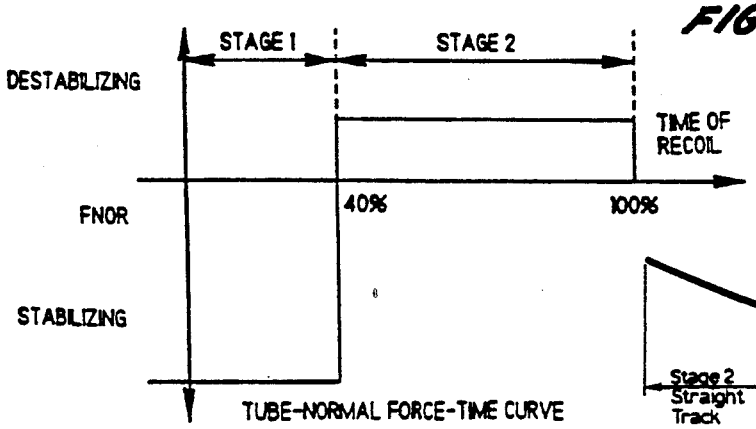
Figure 15A:
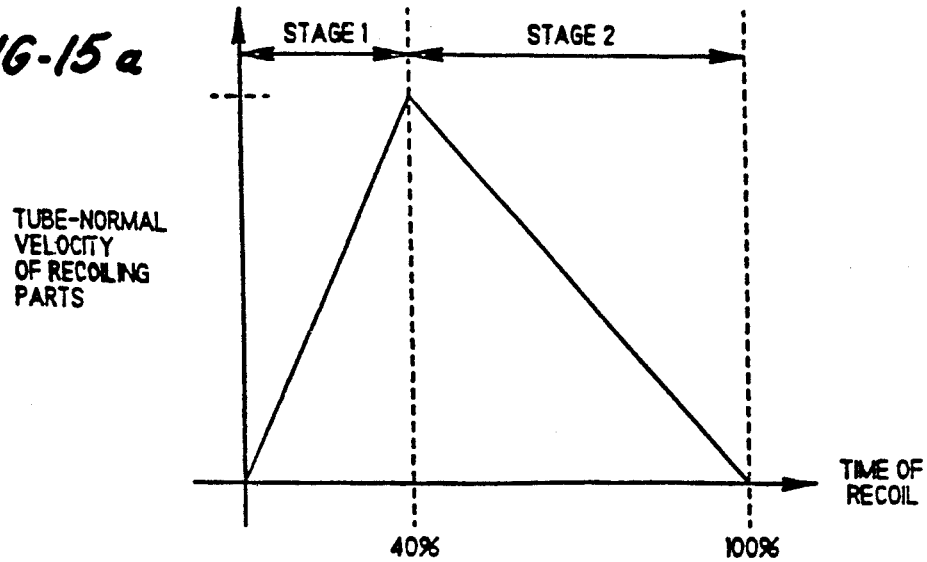
FIGS. 15*a* and 15*b* are graphs plotting the tube-axial and tube-normal recoil velocities, respectively, versus time for the first embodiment of the stabilizing system of the invention.
Figure 15B:
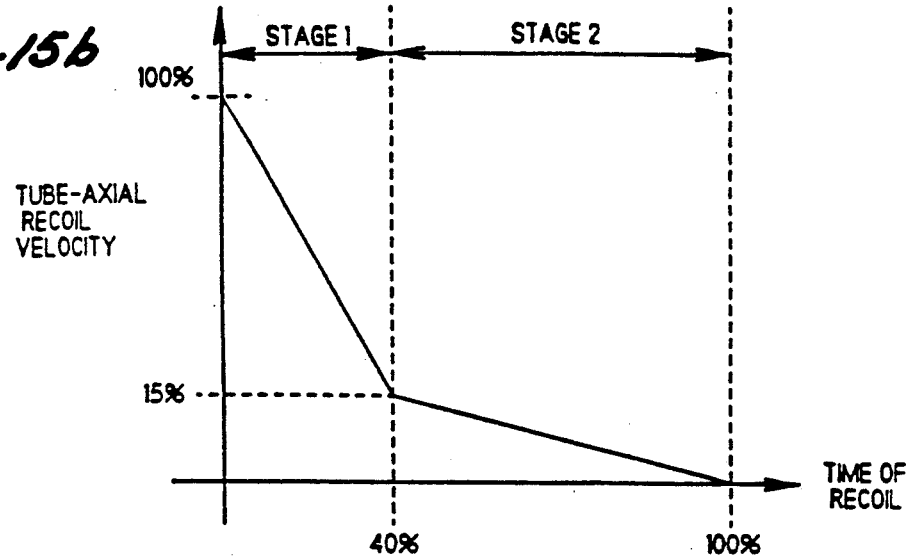
Figure 15C:
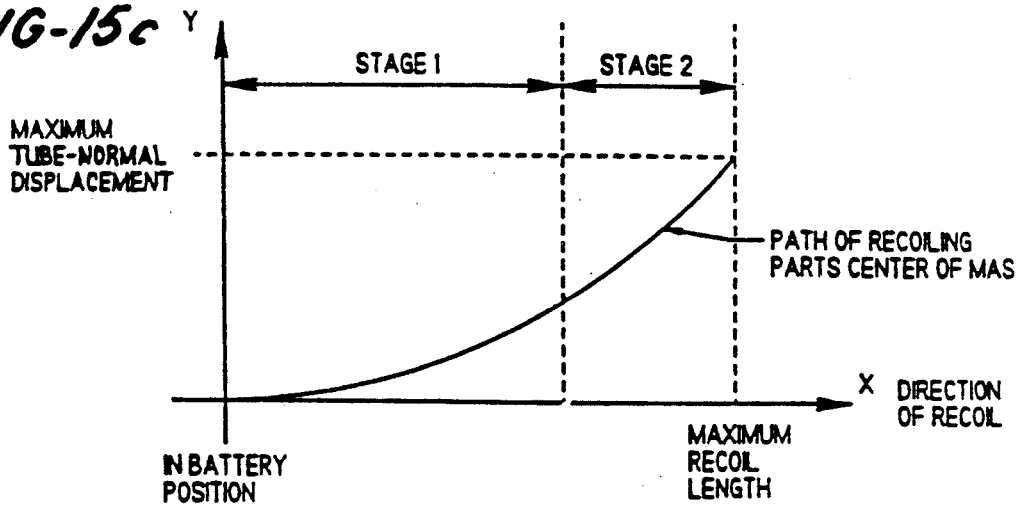
FIG. 15*c* is a graph plotting maximum tube-normal displacement versus maximum tube-axial displacement for the first embodiment of the stabilizing system of the invention.

Stylized tube-axial and tube-normal force-time curves for the first embodiment of the stabilizing system of the invention are shown in FIGS. 14a and 14b. Superimposing these two force-time curves gives a net force vector and a resultant acceleration. Integration leads to a velocity-time history, resolvable into vertical and horizontal components. Further integration produces the horizontal and vertical displacement of the recoiling parts' center of mass. In stylized form, velocity-time is shown in FIGS. 15a and 15b and displacements shown in FIG. 15c. In the configuration of the invention represented by FIGS. 15a and 15b, stage I accounts for 60% of the recoil distance and 40% of the recoil time, while stage II accounts for 40% of the recoil distance and 60% of the recoil time.

The preceding description of our curvilinear system and the following dynamic (stability) analysis directly support the campath location on the cradle assembly as described with respect to the first embodiment shown in FIGS. 1–7, and the stability achieved thereby.

The preceding discussion on stability and the recoil system as well as the development of the governing equations and the dynamic analysis are all based on modeling the gun system as two planar rigid bodies: one recoiling and the other fixed. The recoiling body (mass) will hereafter be referred to as the "cannon." The fixed (non-recoiling) body will hereafter be referred to as the "carriage." Actually, the carriage is made up of two masses or weights, one that elevates (WE) and one that remains fixed (WF). This is to allow for the movement of the carriage center of gravity associated with elevating and depressing the gun.

Figure 16:
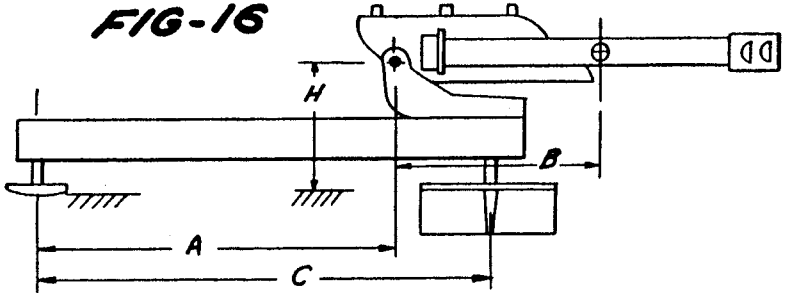
FIG. 16 is a diagrammatic representation of the general gun configuration for the first embodiment of the stabilizing system of the invention.

The general gun configuration is shown diagrammatically in FIG. 16. There are two coordinate systems associated with the cannon model. The first is a ground fixed coordinate system (X-Y) centered at the end of the trail at ground level. The second is a coordinate system (U-Z) which rotates with the gun tube as the cannon elevates and which is centered at the in-battery location of the recoiling mass. This reference frame does not recoil with the cannon. The recoil displacement of the cannon (center of gravity) is measured from the U-Z coordinate system and the horizontal and vertical displacements are U and Z, respectively. The coordinate directions U and Z and the displacements U and Z should not be confused. Similarly the position (X,Y) of the cannon center of gravity can be found relative to the X-Y coordinate system.

Figure 17:
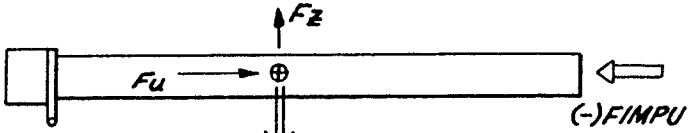
FIG. 17 is a diagrammatic representation of the forces acting on the cannon assembly for the first embodiment of the stabilizing system of the invention.
Figure 18:
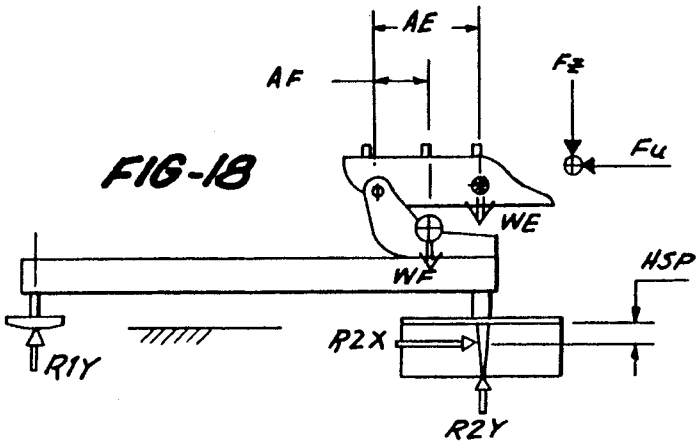
FIG. 18 is a diagrammatic representation of the forces acting on the carriage and cradle assembly for the first embodiment of the stabilizing system of the invention.

The two rigid bodies are shown separately in FIGS. 17 and 18 to facilitate the illustration of the forces that act between these two bodies and to make clear their equal and opposite effect. The cannon experiences forces from the carriage, parallel to the tube primarily from the recoil mechanism, and normal to the tube from cradle support points. In the case shown in FIGS. 1–7, the support is provided by rollers 154a and 154b and 156a and 156b constrained in campaths 164a and 164b and 166a and 166b, respectively, both fore and aft. The force from the recoil mechanism is referred to here as the "rod pull" and is the sum of both the recoil (cylinder) force and the recuperator force. To simplify the analysis and discussion, all the forces between the carriage and the cannon are lumped into two force components $F_u$ parallel to the tube and $F_z$ normal to the tube. $F_u$ and $F_z$ are reaction forces that support the cannon. $F_x$ and $F_y$ are equivalent to $F_u$ and $F_z$ yet based on the ground fixed X-Y coordinate system.

At zero quadrant elevation $F_x=F_u$ and $F_y=F_z$.

$$F_x=+F_u(\cos\phi)-F_z(\sin\phi)$$

$$F_y=+F_u(\cos\phi)+F_u(\sin\phi)$$

$\phi$=Quadrant Elevation

The criterion for stability can be derived from a consideration of FIG. 18. Stability is the condition when the carriage does not rotate about the trail ends. This condition is satisfied if the vertical reaction on the firing platform (R2Y) remains positive. R2Y will remain positive and the gun stable if the stabilizing moment $M_{st}$ remains larger than the overturning moment $M_{ov}$. At zero quadrant elevation, the overturning moment is the horizontal force $F_x$ times its moment arm:

$$M_{ov}=F_u(h+z+hsp) \quad (1)$$

The stabilizing moment is the vertical force $F_z$ and the fixed weights WF and WE times their respective moment arms:

$$M_{st}=F_z(A+B+U)+WF(A+AF)+WE(A+AE) \quad (2)$$

For stability $$M_{st}>M_{ov} \quad (3)$$

The degree of stability can be found by defining the excess stability moment $M_{ex}$ as $$M_{ex}=M_{st}-M_{ov} \quad (4)$$

also $$R2Y = M_{ex}/C \quad (5)$$

The larger $M_{ex}$ and R2Y are, the more stable the gun system is.

For a conventional recoil system, $F_u$ would be equal to the rod pull (RP), and the force $F_z$ would support the portion (WRZ) of the recoiling weight WR that was acting normal to the tube and cradle assembly. At zero quadrant elevation, $F_z$ would be equal to the entire recoiling weight, i.e., $F_z = WRZ = WR$.

Because the sum of WF, WE and WR is limited to 9000 pounds, the stabilizing moment is greatly reduced.

$$M_{st} = F_z(A+B+U) + WF(A+AF) + WE(A+AE)$$

(For a conventional gun) $F_z = WR$ $$M_{st} = WR(A+B+U) + WF(A+AF) + WE(A+AE)$$

Curvilinear recoil increases the stabilizing moment by increasing $F_z$. With curvilinear recoil $F_z$ does not simply support the weight of the cannon but acts also to accelerate the cannon upward (normal to the tube) when greater stability is needed. Accelerating the tube upward (Z direction) increases $F_z$ by the inertial force associated with this acceleration:

$$F_z = M(A_z) + WRZ \quad (6)$$

The application of this increased $F_z$ and resulting acceleration of the cannon in the z-direction gives the cannon a displacement (z) and velocity ($V_z$) in the z-direction. At some point in the latter part of the stroke, this velocity ($V_z$) must be returned to zero. To accomplish this, $F_z$ must be reduced sufficiently to switch the sign of $A_z$, in effect to pull down on the cannon. If $F_z$ is reduced in the latter portion of the recoil stroke as required, then the overturning moment must also be reduced to prevent instability during this portion of the recoil. This gives rise t two distinct stages during curvilinear recoil: stage one defined as the portion of recoil when the tube normal acceleration $A_z$ is positive ("upward"), and characterized by a large tube axial force $F_u$ (rod pull large) and a commensurate tube normal force $F_z$ for stability; and stage two, defined as the portion of recoil when the tube normal acceleration $A_z$ is negative ("downward"), characterized by a reduced or even negative tube normal force $F_z$ and a necessarily greatly reduced tube axial force $F_u$ (rod pull small).

In the transition from stage one to stage two, the recoil force is greatly reduced so that during stage two, the rod pull is primarily provided by the recuperator force.

The dynamic analysis models the gun system as two planar rigid bodies; one recoiling, the other fixed. Both rigid bodies are initially at rest; at time equals zero, the time varying forces from firing impulse is applied. This accelerates the cannon in the negative U-direction while it is being acted upon by retarding forces from the recoil mechanism as modeled. Any of several firing impulse functions can be applied to the gun including (but not limited to) M203 PIMP, M203 nominal, and M119, all matched to the cannon tube with 0.7 index muzzle brake and M483 projectile. The recoil force acts to prevent the cannon from attaining free recoil velocity and continues to act to return the recoiling mass to rest.

The cannon is constrained in the cradle assembly to follow a pre-defined curvilinear campath. The path is curved upward, which forces the cannon to be displaced and accelerated normally to the tube center-line as it recoils axially. This acceleration "generates" the force that contributes the stability during stage one recoil.

The magnitudes of $F_u$ and $F_z$ at all time steps are found by solving the differential equations of motion set forth below for the recoiling mass. Once the dynamic forces are found, the firing loads on all major components are statically determined at each time step using the known system geometry.

Figure 19A:
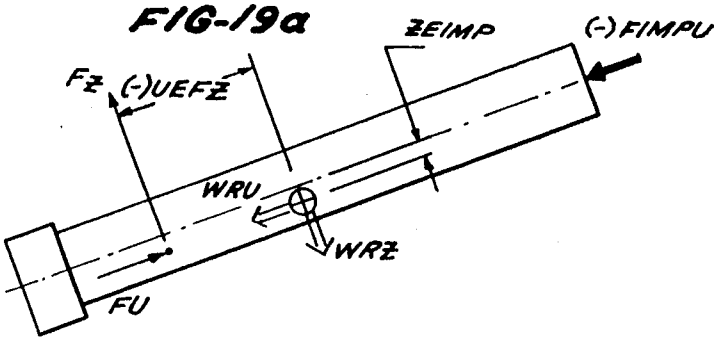
FIGS. 19*a*–19*c* are free body diagrams of the cannon showing the forces acting on the cannon for the first embodiment of the stabilizing system of the invention.

FIG. 19*a* is the free body diagram of the cannon (recoiling mass). From this diagram comes the two differential equations that describe the motion of the gun system. The carriage is assumed stationary, a condition satisfied if the vertical firing platform reaction R2Y remains positive. Summing forces in the u direction yields the first differential equation.

Tube axial:

$$EF(u) = M(A_u) = F_u - (-)FIMPU - WRU$$
$$M(A_u) = F_u + FIMPU - WRU$$

$$A_u = (F_u + FIMPU - WRU)/M \quad (7)$$

Summing forces in the z direction yields the second differential equation

Tube normal: $EF(z) = M(A_z) = F_z - WRZ$ $$A_z = (F_z - WRZ)/M \quad (8)$$

As shown in FIG. 19*a* the center of gravity may be displaced from the center line of the tube. The firing impulse force (FIMPU) introduces a moment which is balanced by moving the point of application of the reaction forces $F_u$ and $F_z$ axially, providing a countering moment.

Sum of the moments about the center of gravity yields $$EMOM = 0 = (-)\ FIMPU(ZEIMP) - F_z(-UEFZ)$$

$$UEFZ = FIMPU(ZEIMP)/F_z$$

When the firing force has gone to zero, the "eccentricity" UEFZ will be zero and the reaction forces $F_u$ and $F_z$ will act through the center of gravity.

$F_u$ and $F_z$ are the reactions on the cannon from the carriage of the gun; specifically, these forces are supplied by the cradle assembly. The cradle assembly applies these forces by two means, the recoil mechanism and the cam tracks. The recoil mechanism pulls on the cannon via the breech band (see FIGS. 19*b* and 1(*c*), and has two components that are related by the geometry of the recoil mechanism. Although as shown in FIG. 3 there are two pairs of tracks, a front pair and a rear pair, a single equivalent track force (TR) will be used (a single force on a rigid body can be replaced by two different forces located at any two locations, here the fore and aft roller contact points).

The point of action of the track force (TR) is not fixed; rather it moves such that the sum of the moments about the center of gravity remains equal to zero. This ensures that the cannon translates only.

Figure 19B:
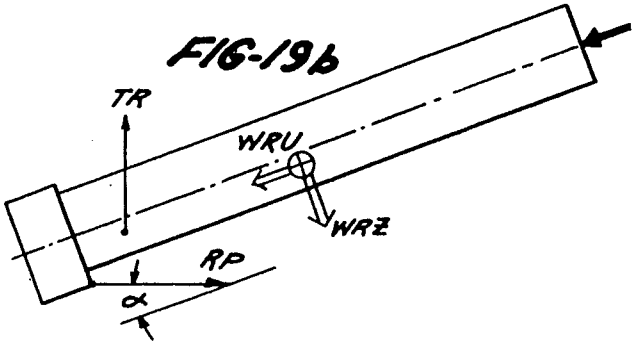
Figure 19C:
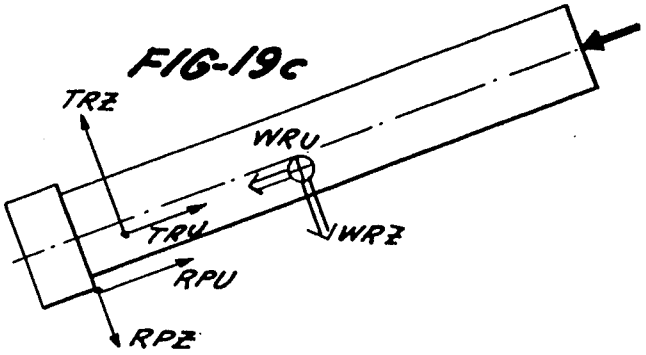

FIGS. 19*a*, 19*b*, and 19*c* are all equivalent. So, $$F_u = TRU + RPU \quad (9)$$

and $$F_z = TRZ - RPZ \quad (10)$$

The total recoil force (RP) is found from the mathematical recoil model and components are found from using the recoil mechanism inclination angle $\alpha$.

$$RP = (c)\ (VS\ VS)/(A_o A_o) = (Recup.\ Force),$$

where C is a constant that includes effective piston area, orifice discharge coefficient, and oil density.

$$RPU = RP \cos \alpha$$

$$RPZ = RP \sin \alpha$$

The track force TR is not known, but the relationship between the components can be determined. The track force results from constraining the cannon to follow a predetermined path. The path can be represented by a function of u, pf(u), such that:

$$Z = pf(u) \text{ or } Z = pf$$

$$\text{The track slope} = dz/du = \frac{d(pf)}{du} = pf'$$

The track angle ($\beta$) is defined as positive CW so:

$$\tan \beta = -\text{slope} = -dz/du = -pf'$$

Referring to FIGS. 20(*a*) and 20(*b*):

$$\tan \beta = TRU/TRZ = -pf'$$

$$TRU = -(TRZ)pf' \quad (11)$$

Two differential equations were developed, Equations (7) and (8). The constraint of the recoil track couples these two equations, resulting in the first equation (7) being the only independent equation. The displacement Z is strictly a function of U (i.e. Z=pf) so the following relationship can be developed:

$$Z = pf \quad (12)$$
$$dz/du = pf'$$

$$\frac{dz}{dt} = \frac{dz}{du} \cdot \frac{du}{dt} = pf' \cdot VU$$

$$V_z = pf' \cdot VU \quad (13)$$

and $$\frac{d^2z}{dt^2} = \frac{d}{dt}\ \frac{dz}{dt} = \frac{d}{dt}\ \frac{dz}{du} \cdot \frac{du}{dt} = \frac{du}{dt} \cdot \frac{d}{dt}\ \frac{dz}{du} + \frac{dz}{du} \cdot \frac{d}{dt}\ \frac{du}{dt}$$

$$\frac{d^2z}{dt^2} = \frac{du}{dt} \cdot \frac{du}{dt} \cdot \frac{d}{du}\ \frac{dz}{du} + \frac{dz}{du} \cdot \frac{d^2u}{dt^2}$$

$$\frac{d^2z}{dt^2} = \frac{du^2}{dt} \cdot \frac{d^2z}{du^2} + \frac{dz}{du} \cdot \frac{d^2u}{dt^2}$$

$$A_z = pf'' \cdot B(V_u)^2 + pf' \cdot (A_u) \quad (14)$$

$$A_z = pf'' \cdot B(V_u)^2 + pf' \cdot (A_u) \quad (14)$$

Now defined are positioned, velocity, and acceleration in the z-direction, all as functions of position, velocity, and acceleration int he u-direction.

$$A_u = (F_u + FIMPU - WRU)/M \quad (7)$$

$$A_z = (F_z - WRZ)/M \quad (8)$$

$$F_u TRU + RPU \quad (9)$$

$$F_z TRZ - RPZ \quad (10)$$

$$TRU = -(TRZ)\ pf'$$

From Equations (9)
and (11) $F_u = -TRZ(pf') + RPU$

From Equation (10) $TRZ = F_z + RPZ$
Combine $Fu = -pf'(F_z + RPZ) + RPU$
From Equation (8) $F_z = MA_z + WRZ$
Combine $F_u = -pf'(MA_z + WRZ + RPZ) + RPU$ From Equation (14) $A_z = pf' \cdot A_u + pf'' \cdot V_u^2$ $$F_u = -pf'(M[Pf' A_u pf'' V_u^2] + WRZ + RPZ) + RPU$$

Add Equation (7) for $A_u$ $$F_u = -pf'(M[pf'(F_u + FIMPU - WRU)/M + pf'' V_u^2] + WRZ + RPZ) + RPU$$

Solve for $F_u$:

$$F_u = \frac{-pf'\ (M\ pf''\ V_u \cdot V_u + pf'\ (FIMPU - WRU) + WRZ + RPZ) + RPU}{(1 + pf' \cdot pf')} \quad (15)$$

Also from Equation (8) $F_z = M \cdot A_z + WRZ$
Combining with Equation (14)

$$F_z = Mpf' A_u + Mpf'' V_u \cdot V_u + WRZ$$

Combining with Equation (7)

$$F_z = pf'(F_u + FIMPU - WRU) + Mpf'' V_u \cdot V_u + WRZ \quad (16)$$

The track campath used for the dynamic analysis was matched to the current configuration and recoil mechanism model to ensure weapon stability at zero quadrant elevation. In the present example, a positive ground force on the firing platform was specified to decay from 2000 to a minimum of 1000 lbf. An additional factor of safety for stability was included by designing the campath in the present example for the M203 PIMP charge. This results in even greater stability when a nominal M203 is fired. The path description consists of pairs of points U and Z (Table 1). One can see that the point pairs do not extend the full length of recoil. The path beyond the data is defined as a straight line tangent to the last portion of the track, and as such does not need to be explicitly tabulated.

BEST AVAILABLE COPY

TABLE 1

| U | Z | $\bar{\beta}$ |
|---|---|---|
| 1.0 | 0.0 | |
| 0.0 | 0.0 | |
| -1.3943[illegible]5E-02 | 1.3027527E-05 | 0.1064200 |
| -3.3500475E-02 | 5.6624060E-05 | 0.1409592 |
| -6.3604531E-02 | 1.3510455E-04 | 0.1563128 |
| -0.1042069 | 2.5162366E-04 | 0.1717640 |
| -0.1540052 | 4.1052324E-04 | 0.1937705 |
| -0.2104911 | 6.1716477E-04 | 0.2249140 |
| -0.2717772 | 8.7735784E-04 | 0.2614119 |
| -0.3362349 | 1.1975085E-03 | 0.3000340 |
| -0.4028695 | 1.5043266E-03 | 0.3572629 |
| -0.4700303 | 2.0439695E-03 | 0.4173050 |
| -0.5391440 | 2.5009406E-03 | 0.4845003 |
| -0.6071967 | 3.1974320E-03 | 0.5538052 |
| -0.6750160 | 3.8050406E-03 | 0.6251525 |
| -0.7425436 | 4.6751157E-03 | 0.6992530 |
| -0.8097011 | 5.5995346E-03 | 0.7756743 |
| -0.8764620 | 6.4800075E-03 | 0.8539873 |
| -0.9428217 | 7.5242161E-03 | 0.9342305 |
| -1.008725 | 8.6467713E-03 | 1.017808 |
| -1.074094 | 9.8571833E-03 | 1.104130 |
| -1.138307 | 1.1155967E-02 | 1.192294 |
| -1.203163 | 1.2543593E-02 | 1.282417 |
| -1.266051 | 1.4020517E-02 | 1.374535 |
| -1.330001 | 1.5587180E-02 | 1.468686 |
| -1.392581 | 1.7244002E-02 | 1.564907 |
| -1.454550 | 1.8991329E-02 | 1.665446 |
| -1.515803 | 2.0829225E-02 | 1.768319 |
| -1.576554 | 2.2757646E-02 | 1.873283 |
| -1.636573 | 2.4776516E-02 | 1.980368 |
| -1.695942 | 2.6885740E-02 | 2.089606 |
| -1.754664 | 2.9085198E-02 | 2.201026 |
| -1.812731 | 3.1374734E-02 | 2.315465 |
| -1.870110 | 3.3754066E-02 | 2.434139 |
| -1.926781 | 3.6222722E-02 | 2.555043 |
| -1.982749 | 3.8780171E-02 | 2.678199 |
| -2.038010 | 4.1425050E-02 | 2.803630 |
| -2.092594 | 4.4159204E-02 | 2.931360 |
| -2.146402 | 4.6979610E-02 | 3.061410 |
| -2.199606 | 4.9886454E-02 | 3.193803 |
| -2.252212 | 5.2879095E-02 | 3.328559 |
| -2.304066 | 5.5956870E-02 | 3.465699 |
| -2.355253 | 5.9119098E-02 | 3.605246 |
| -2.405778 | 6.2365074E-02 | 3.747216 |
| -2.455648 | 6.5694079E-02 | 3.891629 |
| -2.504867 | 6.9105372E-02 | 4.038505 |
| -2.553442 | 7.2598197E-02 | 4.187860 |
| -2.601373 | 7.6171771E-02 | 4.339711 |
| -2.648682 | 7.9825304E-02 | 4.494075 |
| -2.695359 | 8.3557993E-02 | 4.650960 |
| -2.741403 | 8.7368988E-02 | 4.812841 |
| -2.786800 | 9.1257334E-02 | 4.978995 |
| -2.831550 | 9.5221981E-02 | 5.147902 |
| -2.875655 | 9.9262640E-02 | 5.322362 |
| -2.919115 | 0.1033798 | 5.502657 |
| -2.961929 | 0.1075741 | 5.689036 |
| -3.004096 | 0.1118458 | 5.881670 |
| -3.045615 | 0.1161953 | 6.080730 |
| -3.086488 | 0.1206231 | 6.286392 |
| -3.126714 | 0.1251293 | 6.498843 |
| -3.166293 | 0.1297142 | 6.718233 |
| -3.205220 | 0.1343779 | 6.944769 |
| -3.243510 | 0.1391206 | 7.178625 |
| -3.281166 | 0.1439423 | 7.419980 |
| -3.318173 | 0.1488429 | 7.669021 |
| -3.354541 | 0.1538224 | 7.925926 |
| -3.390272 | 0.1588807 | 8.190881 |
| -3.425370 | 0.1640174 | 8.464065 |
| -3.459837 | 0.1692324 | 8.745662 |
| -3.493676 | 0.1745252 | 9.035846 |
| -3.526892 | 0.1798956 | 9.334798 |
| -3.559488 | 0.1853429 | 9.643009 |
| -3.591464 | 0.1908675 | 9.965417 |
| -3.622815 | 0.1964707 | 10.30440 |
| -3.653537 | 0.2021539 | 10.66101 |
| -3.683624 | 0.2079185 | 11.03582 |
| -3.713072 | 0.2137657 | 11.42976 |
| -3.741877 | 0.2196966 | 11.84371 |
| -3.770037 | 0.2257122 | 12.27855 |
| -3.797549 | 0.2318135 | 12.73519 |
| -3.824410 | 0.2380012 | 13.21455 |
| -3.850620 | 0.2442758 | 13.71754 |
| -3.876178 | 0.2506378 | 14.24510 |
| -3.901085 | 0.2570876 | 14.79814 |
| -3.925340 | 0.2636252 | 15.37757 |
| -3.948947 | 0.2702507 | 15.98427 |
| -3.971907 | 0.2769639 | 16.61910 |
| -3.994224 | 0.2837644 | 17.28289 |
| -4.015902 | 0.2906516 | 17.97638 |
| -4.036945 | 0.2976250 | 18.70029 |
| -4.057360 | 0.3046835 | 19.45525 |
| -4.077151 | 0.3118262 | 20.24179 |
| -4.096127 | 0.3190518 | 21.06035 |
| -4.114895 | 0.3263590 | 21.91125 |
| -4.132064 | 0.3337463 | 22.79468 |
| -4.150242 | 0.3412120 | 23.71479 |
| -4.167034 | 0.3487554 | 24.66697 |
| -4.183279 | 0.3563679 | 25.52153 |
| -4.199083 | 0.3640265 | 26.12380 |

The driving function for the dynamic analysis is the force applied to the cannon by the firing of the projectile. This time dependent force is calculated from the tables of total impulse supplied to the recoiling mass versus time. the force is calculated by:

*FIMPU=(change in IMPULSE)/(change in TIME)*

The effects of different charges on the curvilinear system are determined by using a different firing impulse table as input. The tables are produced from internal ballistics calculations and include the gas action on a muzzle brake with a momentum index of 0.7. Three different tables were used:

*Table* 2: *M*203 *PIMP—M*483 *projectile*

*Table* 3: *M*203 *nominal—M*483 *projectile*

*Table* 4: *M*119 *nominal—M*483 *projectile*

TABLE 2

| | |
|---|---|
| _DUAL:CPE12.PCR.PFJIMPM203PIMP.DAT;1 | |
| 20 | |
| .0000 | 000. |
| .0023 | −502. |
| .0031 | −1073. |
| .0040 | −2051. |
| .0047 | −3016. |
| .0054 | −4075. |
| .0060 | −4994. |
| .0067 | −6025. |
| .0075 | −7096. |
| .0085 | −8076. |
| .0100 | −9035. |
| .0123 | −9913. |
| .0133 | −10006. |
| .0163 | −10211. |
| .0203 | −10406. |
| .0271 | −10602. |
| .0337 | −10704. |
| .0514 | −10806. |
| .1711 | −10843. |
| 10.00 | −10843. |
| M203 SHOT IMPULSE DATA | |
| (PIMP) M483 0.7 M.B. | |

TABLE 3

| | |
|---|---|
| _DUAL:CPE12.PCR.PFJIMPM203.DAT;1 | |
| 14 | |
| .0000 | 000. |
| .0030 | −763. |
| .0042 | −1797. |
| .0048 | −2473. |
| .0069 | −5079. |
| .0090 | −7291. |
| .0108 | −8550. |
| .0129 | −9434. |
| .0150 | −9677. |
| .0195 | −9955. |
| .0315 | −10286. |
| .0665 | −10443. |
| .1365 | −10455. |
| 10.00 | −10455. |
| M203 SHOT IMPULSE DATA | |
| (NOMINAL) M483 0.7 M.B. | |

TABLE 4

| | |
|---|---|
| _DUAL:CPE12.PCR.PFJIMPM119.DAT;1 | |
| 16 | |
| .0000 | 000. |
| .0040 | −949. |
| .0050 | −1601. |
| .0060 | −2396. |
| .0070 | −3261. |
| .0080 | −4123. |
| .0100 | −5675. |
| .0120 | −6709. |
| .0140 | −7361. |
| .0155 | −7712. |
| .0203 | −7952. |
| .0253 | −8104. |
| .0453 | −8322. |
| .0803 | −8373. |
| .2803 | −8379. |
| 10.00 | −8379. |
| M119 SHOT IMPULSE DATA | |
| (NOMINAL) M483 0.7 M.B. | |

The recoil force is provided by a recoil cylinder model where the recoil force (F-recoil) is given by:

$$F\text{-}recoil = C\,(V_S \cdot V_S)/(A_O \cdot A_O)$$

The transition between stage one recoil and stage two is accompanied by a rapid drop in F-recoil. This is accomplished by rapidly enlarging the orifice areas. The enlarging of the orifice areas is modeled as a smooth, albeit rapid, transition rather than as an abrupt change. This should more closely represent the response of a real system. This more protracted transition provides for a more forgiving match between the recoil mechanism and the campath profile. Additionally, the recoil force is not removed entirely during stage two but rather is designed to a nominal value of 1000 lbf. This has several advantages over letting the recuperator alone control stage two: (1) the orifice areas are now defined in stage two rather than being infinity; (2) the active recoil cylinder can now be used to fine tune the stage two recoil; and (3) a velocity dependent retarding force is now present in stage two to help dissipate the energy from an overpressure.

Two orifice profiles are developed for the recoil model; one for long recoil, and one for short recoil. These orifice areas are plotted in FIG. 21 and tabulated in Tables 5 and 6. These orifice areas are equivalent areas, and do not correspond directly to the orifice areas for the actual recoil cylinder.

TABLE 5

| | | | |
|---|---|---|---|
| _DUA1:LPE12.PCR.PFJX1_ORD.DAT;1 | | | |
| 43 | | | |
| −1.0 | 0.1000000 | | |
| 0.0 | 0.1000000 | | |
| 1.0980606E-02 | 0.2136773 | −1.0980375E-02 | 7.615981 |
| 2.9442310E-02 | 0.3697216 | −2.9442154E-02 | 7.634443 |
| 5.8368206E-02 | 0.5307279 | −5.8368392E-02 | 7.663369 |
| 9.7794533E-02 | 0.6714978 | −9.7794317E-02 | 7.702795 |
| 0.1463418 | 0.7719964 | −0.1463419 | 7.751342 |
| 0.2016678 | 0.8272313 | −0.2016679 | 7.806668 |
| 0.2618084 | 0.8600011 | −0.2618082 | 7.866809 |
| 0.3251381 | 0.8641519 | −0.3251382 | 7.930139 |
| 0.3906655 | 0.8674879 | −0.3906651 | 7.995666 |
| 2.811534 | 0.6066884 | −2.811117 | 10.41653 |
| 3.551729 | 0.4550896 | −3.550291 | 11.15673 |
| 4.144249 | 0.2584715 | −4.139843 | 11.74925 |
| 4.162491 | 0.2494449 | −4.157892 | 11.76749 |
| 4.18 | 0.260 | | |
| 4.20 | 0.310 | | |
| 4.21 | 0.500 | | |
| 4.23 | 1.500 | | |
| 4.24 | 1.800 | | |

TABLE 5-continued

| | | | |
|---|---|---|---|
| 4.245087 | 1.838936 | | |
| 4.260842 | 1.830884 | | |
| 4.276539 | 1.822829 | −4.270426 | 11.88154 |
| 4.445129 | 1.734067 | −4.436337 | 12.05013 |
| 4.620374 | 1.636875 | −4.608381 | 12.22537 |
| 4.772849 | 1.547431 | −4.757758 | 12.37785 |
| 4.930054 | 1.449455 | −4.911491 | 12.53505 |
| 5.065610 | 1.359271 | −5.043849 | 12.67061 |
| 5.203977 | 1.259954 | −5.178774 | 12.80898 |
| 5.332038 | 1.157433 | −5.303502 | 12.93704 |
| 5.440137 | 1.063096 | −5.408682 | 13.04514 |
| 5.539235 | 0.9684290 | −5.505030 | 13.14424 |
| 5.629237 | 0.8734521 | −5.592476 | 13.23424 |
| 5.710056 | 0.7781891 | −5.670962 | 13.31506 |
| 5.781618 | 0.6826680 | −5.740430 | 13.38662 |
| 5.843856 | 0.5869220 | −5.800835 | 13.44886 |
| 5.896716 | 0.4909886 | −5.852135 | 13.50172 |
| 5.940156 | 0.3949136 | −5.894298 | 13.54516 |
| 5.974138 | 0.2987556 | −5.927299 | 13.57914 |
| 5.998644 | 0.2026038 | −5.951124 | 13.60364 |
| 6.013669 | 0.1066578 | −5.965774 | 13.61867 |
| 6.05 | 0.060 | | |
| 7.05 | 0.060 | | |
| $\bar{S}$ | $\overline{A_o}$ | $\bar{U}$ | $\bar{\alpha}$ |

TABLE 6

| | | | |
|---|---|---|---|
| _DUAL:CPE12.PCR.PFJX1SR_ORD.DAT;1 | | | |
| 29 | | | |
| −1.0 | 0.1000000 | | |
| 0.0 | 0.1000000 | | |
| 1.1038303E-02 | 0.2141681 | −1.1038204E-02 | 7.616039 |
| 2.9524803E-02 | 0.3651744 | −2.9524621E-02 | 7.634525 |
| 5.8463097E-02 | 0.5136756 | −5.8463290E-02 | 7.663464 |
| 9.7870827E-02 | 0.6343604 | −9.7870767E-02 | 7.702871 |
| 0.1463437 | 0.7107175 | −0.1463436 | 7.751344 |
| 0.2015076 | 0.7425037 | −0.2015076 | 7.806508 |
| 0.2613635 | 0.7537519 | −0.2613631 | 7.866364 |
| 0.3242474 | 0.7553425 | −0.3242471 | 7.929248 |
| 0.3891602 | 0.7807769 | −0.3891598 | 7.994161 |
| 0.4553499 | 0.7885355 | −0.4553490 | 8.060350 |
| 0.5216808 | 0.7871751 | −0.5216795 | 8.126681 |
| 0.9126625 | 0.7689710 | −0.9126559 | 8.517663 |
| 1.286214 | 0.7367233 | −1.286190 | 8.891214 |
| 1.638360 | 0.6977797 | −1.638298 | 9.243361 |
| 1.966563 | 0.6532170 | −1.966431 | 9.571564 |
| 2.269381 | 0.6065208 | −2.269134 | 9.874381 |
| 2.547086 | 0.5591587 | −2.546663 | 10.15209 |
| 2.799577 | 0.5086938 | −2.798896 | 10.40458 |
| 3.026139 | 0.4566602 | −3.025103 | 10.63114 |
| 3.226931 | 0.4036990 | −3.225414 | 10.83193 |
| 3.402062 | 0.3496875 | −3.399911 | 11.00706 |
| 3.551527 | 0.2944165 | −3.548557 | 11.15653 |
| 3.675147 | 0.2374927 | −3.671132 | 11.28015 |
| 3.772432 | 0.1780574 | −3.767100 | 11.37743 |
| 3.850954 | 0.1018210 | −3.843654 | 11.45595 |
| 3.90 | 0.060 | | |
| 7.00 | 0.060 | | |
| $\bar{S}$ | $\overline{A_o}$ | $\bar{U}$ | $\bar{\alpha}$ |

The total recoil mechanism force RP includes a linear spring representation of the recuperator function. So, $$RP = F\text{-}recoil + FRCP + DFRCP(S),$$

where S is the magnitude of extension of the recoil mechanism in feet.

The exact gun configuration and all remaining data are contained in the input data file shown in Table 7, and tabulated in Table 8.

TABLE 7

```
_DUAL:CPE12.PCR.PP.RPRTJX1CL1N.DAT;1
3240.  1430.  4330.  2000.  16.08  8.00  19.33  3.833  −1.43  4.00  .001  5  1
0.854  6.813  0.854  8.792  700.  0.2  0.0  1000.
0.0  0.0  2.646  −1.688  6000.  500.  1
2.0  0.8333  2.25  −0.250  0.0  0.0  0.0  0.0  0.0
2.417  −1.625  4.833  1.017  4.0  4.0
***** MAY 14, 1986 CONFIGURATION WITH SPADE REACTION OFFSET.
WF   WE   WR   —   A   B   C   H   AF   AE   TIME PRINT   —
                                            STEP FREQ.
RO1   RD1   RO2   RD2   —   —   —   STAGE_2_F-RECOIL
ETR1   ETR1   DTR1   DTR2   FRCP   DFRCP   —
T1   T2   T3   HSP   AEY   FX_2   A3   BY   HTB
T4   T5   T6   T7   —   —
***** VARIABLE NAMES ARE LISTED AS THEIR VALUES APPEAR IN THE DATA FILE.
```

TABLE 8

LWTH SYSTEM DIMENSIONS

DATE OF DISTRIBUTION
OF THIS INFORMATION - May 20, 1986
DATE OF ASSOCIATED
COMPUTER RUNS - May 17,18, 1986

| | lbf | |
|---|---|---|
| WR | 4330.0 | |
| WF | 3240.0 | |
| WE | 1430.0 | |
| FRCP | 6000.0 | |
| DFRCP | 500.0 | (lbf/foot) |
| | Inches | |
| A | 193.0 | |
| B | 96.0 | |
| BY | 0.0 | |
| C | 232.0 | |
| H | 46.0 | |
| HTB | 0.0 | |
| HSP | 3.0 | |
| A3 | 0.0 | |
| AF | −17.2 | |
| AE | 48.0 | |
| AEY | 0.0 | |
| RO1 | 10.25 | |
| RD1 | 81.75 | |
| RO2 | 10.25 | |
| RD2 | 105.5 | |
| ETR1 | 0.0 | |
| DTR1 | 31.75 | |
| ETR2 | 0.0 | |
| DTR2 | −20.25 | |
| T1 | 24.0 | |
| T2 | 10.0 | |
| T3 | 29.0 | |
| T4 | 27.0 | |
| T5 | −19.5 | |
| T6 | 58.0 | |
| T7 | 12.2 | |

Figure 23:
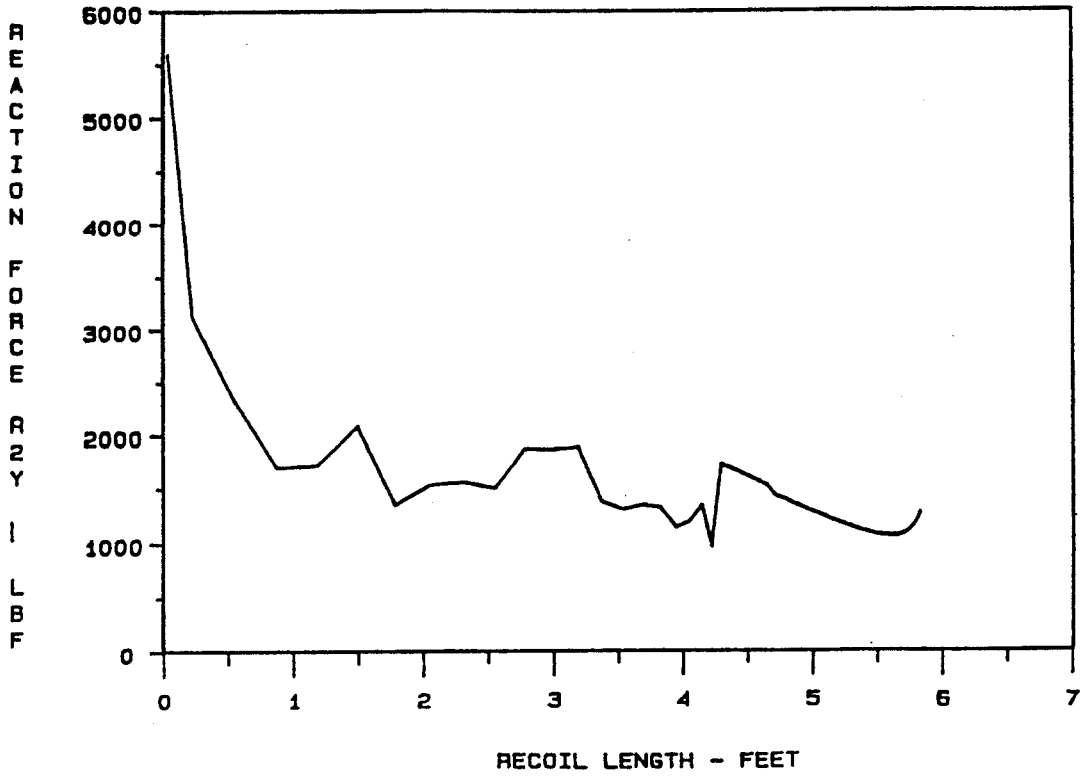
FIG. 23 is a graph plotting vertical reaction on the firing platform versus recoil length.
Figure 24:
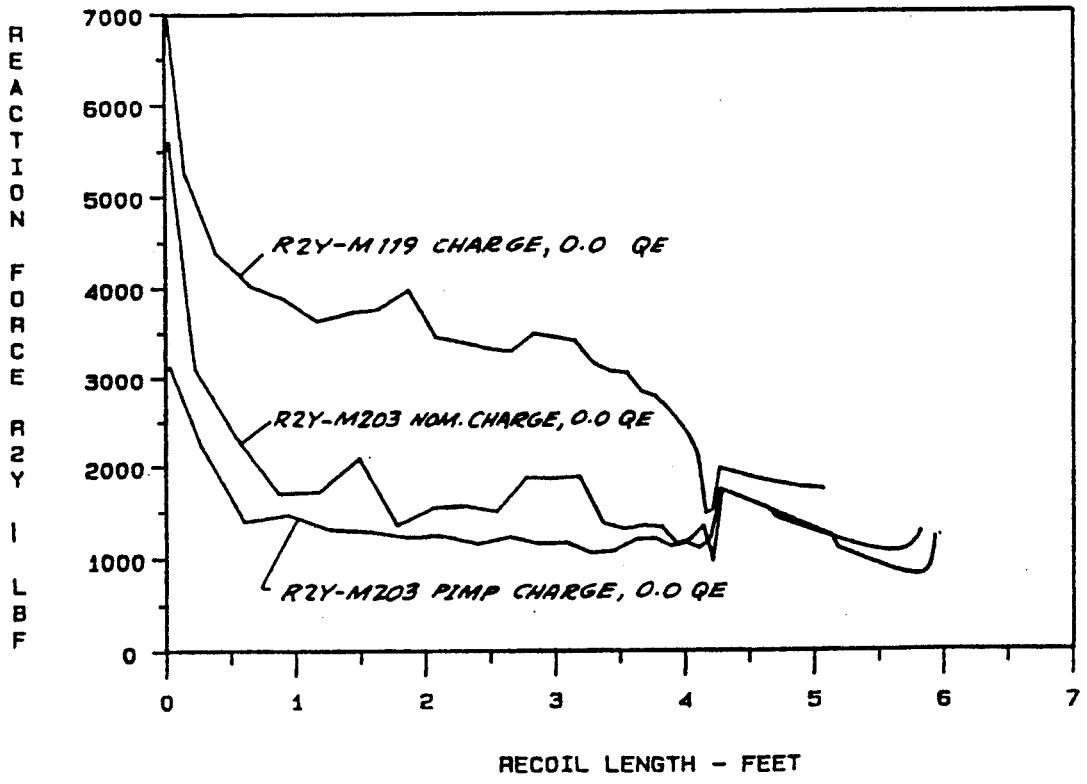
FIG. 24 is a graph showing the effect of charge on stability (i.e. vertical ground force)
Figure 25:
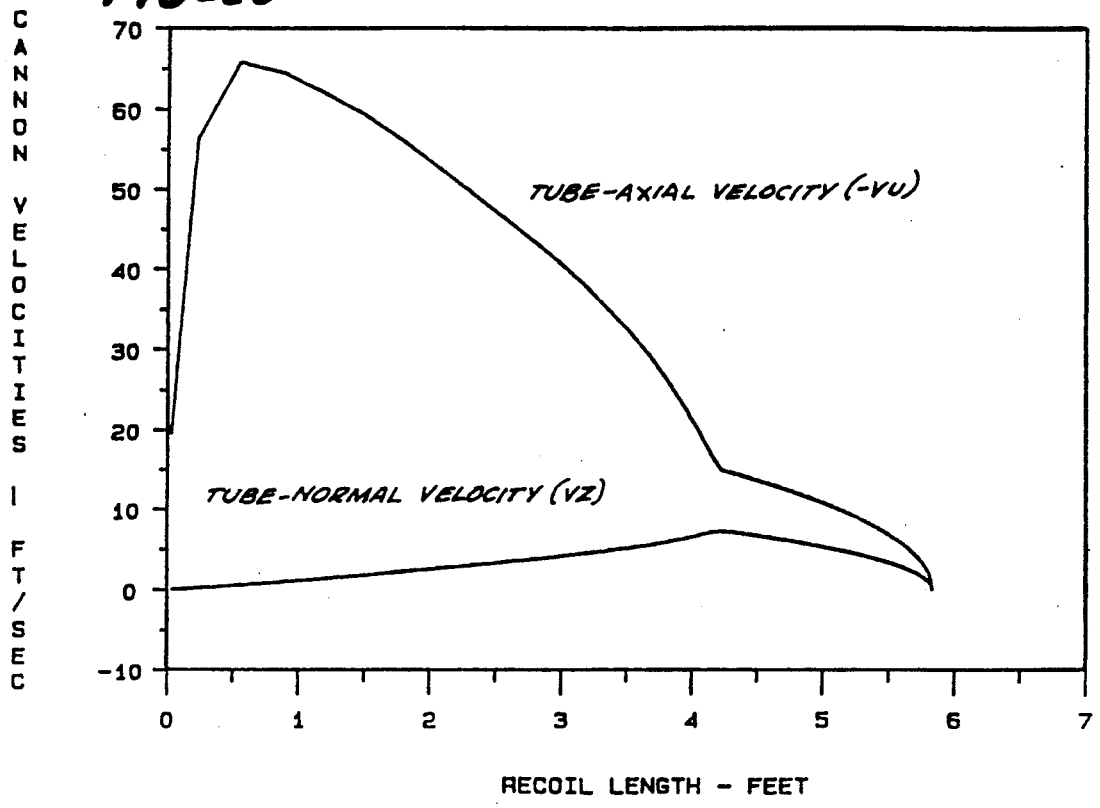
FIG. 25 is a graph plotting cannon velocities versus recoil length.
Figure 26:
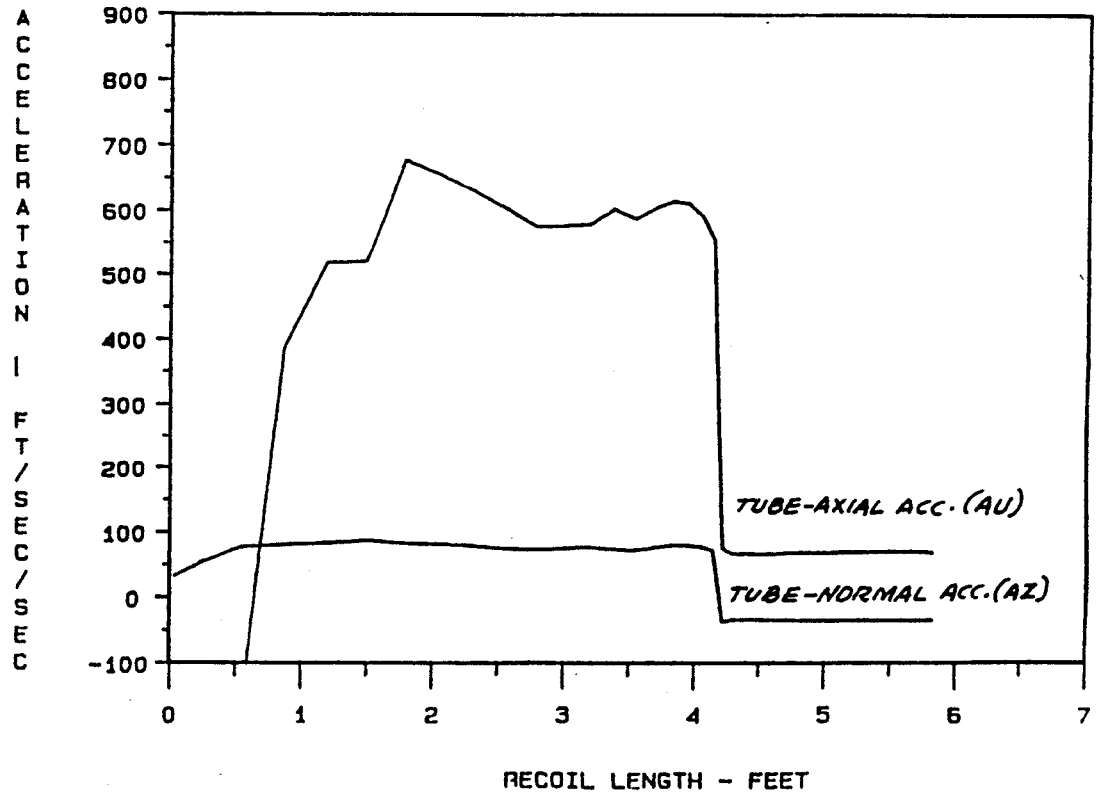
FIG. 26 is a graph plotting cannon accelerations versus recoil length.
Figure 27:
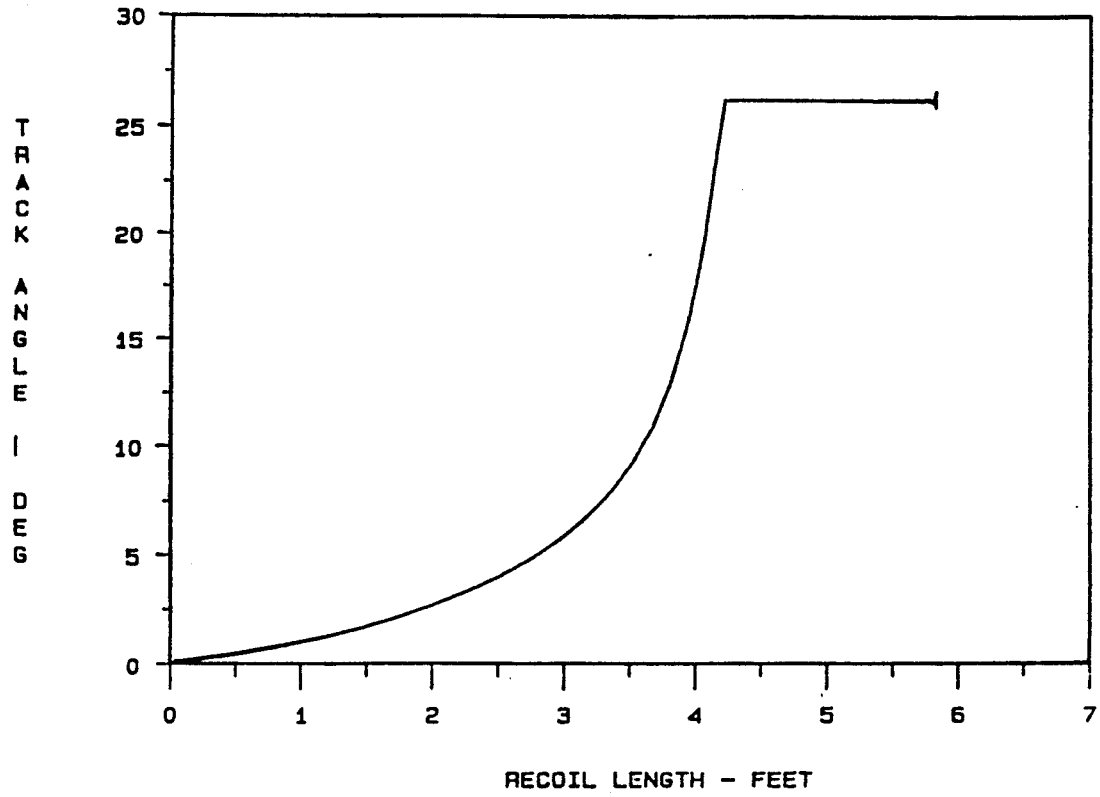
FIG. 27 is a graph plotting track angle versus recoil length.
Figure 28:
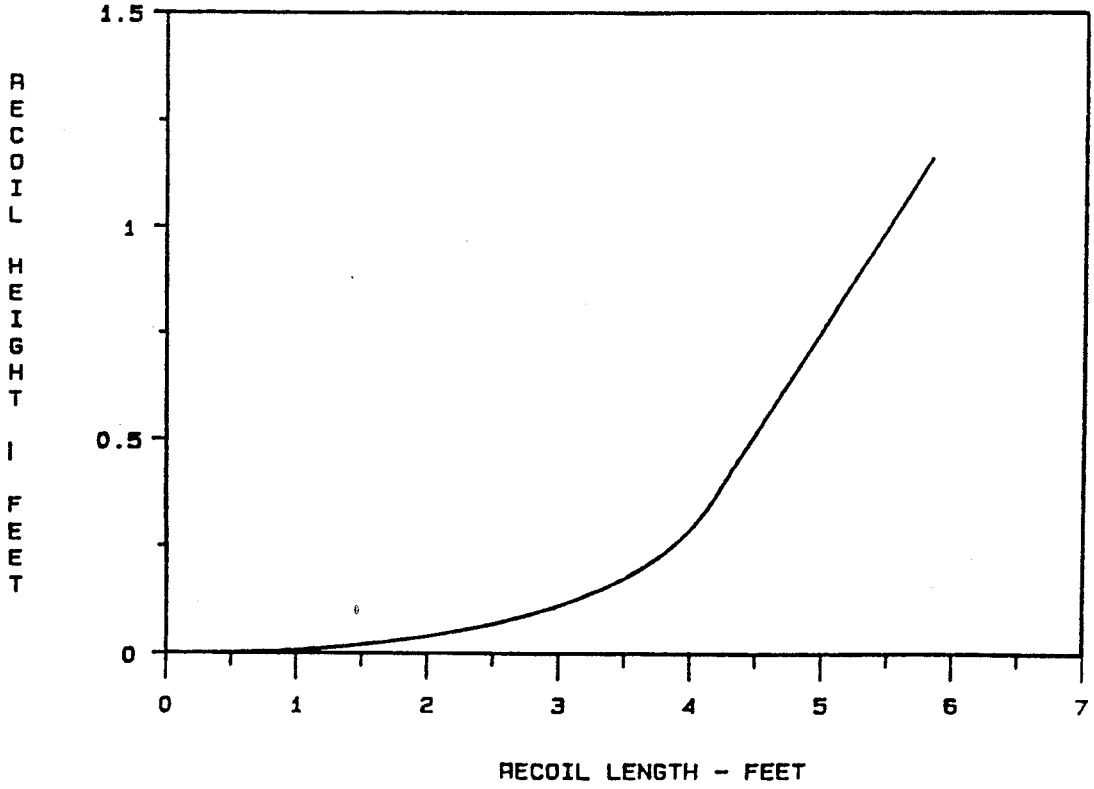
FIG. 28 is a graph plotting recoil height versus recoil length.

The primary objective of the preceding dynamic analysis was to demonstrate the stability of the gun system using curvilinear recoil. Stability is ensured if the stabilizing moment about the trail ends $M_{st}$ is greater than the overturning moment $M_{ov}$. $M_{ex} = M_{st} - M_{ov}$. If $M_{st}$ is greater than $M_{ov}$ then $M_{ex}$ is positive and the forward vertical ground reaction (R2Y) will remain positive and the gun will not "hop." For the condition of zero quadrant elevation and the M203 (nominal)

charge, FIG. 22 illustrates that $M_{st}$ is greater than $M_{ov}$ and FIG. 23 illustrates that R2Y remains positive. The gun system was designed to be stable, even with a M203 PIMP charge. FIG. 24 shows that indeed, the gun is stable with the PIMP charge. FIG. 24 also shows that the gun system gets progressively more stable as the charge is reduced, the M119 charge being the most stable of the three shown.

For each dynamic analysis run, there are provided up to four files or tables of output with suffixes ".CP1," ".CP2," ".CP3," and ".CP4.". Each run has a file name associated with it, beginning first with the prefix "X1" which identifies all files used by, and generated for, this analysis. The remainder of the file name identifies the charge and the quadrant elevation of the gun in degrees. All plots are generated from the tables provided, and the file name of the source is printed in the right-most portion of the title.

Additional data is plotted in FIGS. 13 and 25–28 for the case of the M203 (nominal charge) and a quadrant elevation equal to zero, because this is the worst condition at which the gun must remain stable.

Table 9 describes all of the headings for Tables 10–16. All forces are in lbf. and forces printed out are the sum for both sides of the gun. All forces and dimensions are drawn on diagrams in the direction that was assumed positive for the dynamic analysis and resulting computer print-outs except where noted by a "(−)" which means that the direction shown is negative.

TABLE 9

Displacements, Velocities and Accelerations

| NAME | DESCRIPTION | UNITS |
|---|---|---|
| U | recoil displacement of cannon parallel to cradle (and tube) | ft |
| Z | recoil displacement of cannon perpendicular to cradle (and tube) | ft |
| VU | recoil velocity of cannon parallel to cradle (and tube) | ft/s |
| VZ | recoil velocity of cannon perpendicular to cradle (and tube) | ft/s |
| AU | recoil acceleration of cannon parallel to cradle (and tube) | ft/s/s |
| AZ | recoil acceleration of cannon perpendicular to cradle (and tube) | ft/s/s |
| WR | Weight of recoiling mass | centered at |
| WF | Weight of non-recoiling non-elevating mass | centered at |
| WE | Weight of non-recoiling elevating mass | centered at |

| NAME | DESCRIPTION | COMPONENT DIRECTION |
|---|---|---|
| RRU | Rod pull force | U |
| RPZ | Rod pull force | Z |
| TRU1 | Breech end track force | U |
| TRZ1 | Breech end track force | Z |
| TRU2 | Muzzle end track force | U |
| TRZ2 | Muzzle end track force | Z |
| F14_U | Trunnion force on cradle | U |
| F14_Z | Trunnion force on cradle | Z |
| F13_U | Elevating/equilibrator mech force | U |
| F13_Z | Elevating/equilibrator mech force | Z |
| F12_X | Trunnion force on upper carriage | X |
| F12_Y | Trunnion force on upper carriage | Y |
| F11_X | Elevator/equilibrator force on upper carriage | X |
| F11_Y | Elevator/equilibrator force on upper carriage | Y |
| F9_Y | Support force on upper carriage from lower carriage | Y |
| F3_Y | Recoil pad support force on upper carriage | Y |
| *F2_X | Lower pintle shear force from spade assembly | X |

TABLE 9-continued

Displacements, Velocities and Accelerations

| NAME | DESCRIPTION | COMPONENT DIRECTION |
|---|---|---|
| F2_Y | Pintle column load from spade assembly | Y |
| F1_X | Upper pintle shear force from spade assembly | X |
| F10_Y = −F9_Y | Force on trail/lower carriage from upper carriage | Y |
| F8_Y = −F3_Y | Force on recoil pads from upper carriage | Y |
| F7_Y | Force from spade assembly | Y |
| M2 | Moment (force couple(s)) from spade assembly | lbf-ft |
| F-FLOAT_Y (= R2Y) | Vertical ground force on float (vertical reaction number 2) | Y |
| R2X | Horizontal ground force on spade/float (horizontal reaction number 2) | X |
| R1Y | Vertical ground forces on trial end (vertical reaction number 1) | Y |
| FTRACK | Total (Net) track force | |
| RP | Total rodpull (recoil + recup.) | |

*The presence of this second pintle shear (F2_X) force makes the upper carriage statically indeterminate. So (F2_X) must be chosen prior to running the computer solution. The value for (F2_X) is dependent upon the design of the pintle-spade assembly interface and upon the deflections of all associated parts.

In addition to the plotted results are tables containing all the data for a variety of quadrant elevations and charges. The tabulated results include:

| | | |
|---|---|---|
| Table 10.1 | X1M203QE00.CP1 | long recoil/M203 |
| Table 10.2 | X1M203QE00.CP2 | long recoil/M203 |
| Table 10.3 | X1M203QE00.CP3 | long recoil/M203 |
| Table 10.4 | X1M203QE00.CP4 | long recoil/M203 |
| Table 11.1 | X1SRQE45.CP1 | short recoil/M203 |
| Table 11.2 | X1SRQE45.CP2 | short recoil/M203 |
| Table 11.3 | X1SRQE45.CP3 | short recoil/M203 |
| Table 11.4 | X1SRQE45.CP4 | short recoil/M203 |
| Table 12.1 | X1SRQE70.CP1 | short recoil/M203 |
| Table 12.2 | X1SRQE70.CP2 | short recoil/M203 |
| Table 12.3 | X1SRQE70.CP3 | short recoil/M203 |
| Table 12.4 | X1SRQE70.CP4 | short recoil/M203 |
| Table 13 | X1M203QE05.CP1 | long recoil/M203 |
| Table 14 | X1M203QE20.CP1 | long recoil/M203 |
| Table 15 | X1PIMPQE00.CP1 | long recoil/PIMP |
| Table 16 | X1M119QE00.CP1 | long recoil/M119 |

BEST AVAILABLE COPY

_DUA1:LPE12.PCR.PP.RE._ _1M203QE00.CP1;1

ORCOEF = 14.40 Q.E. = 0.00 (DEGREES)

| TIME | RP | FTRACK | F-FLOAT_Y | U | Z | VU | VZ | AU | AZ | |
|---|---|---|---|---|---|---|---|---|---|---|
| 0.000 | 0. | 4330. | 9335. | 0.000 | 0.000 | 0.00 | 0.00 | 0.00 | 0.00 | 0. |
| 0.005 | 42736. | 8587. | 5592. | -0.032 | 0.000 | -19.44 | 0.05 | -7829.01 | 31.63 | 0. |
| 0.010 | 70652. | 11431. | 3100. | -0.232 | 0.001 | -56.47 | 0.23 | -4671.30 | 52.71 | 0. |
| 0.015 | 92648. | 14013. | 2328. | -0.548 | 0.003 | -65.87 | 0.57 | -170.42 | 77.66 | 0. |
| 0.020 | 96579. | 15270. | 1703. | -0.874 | 0.006 | -64.51 | 0.96 | 307.27 | 80.72 | 0. |
| 0.025 | 97058. | 15690. | 1720. | -1.190 | 0.012 | -61.93 | 1.37 | 518.74 | 83.37 | 0. |
| 0.030 | 97169. | 16363. | 2070. | -1.494 | 0.020 | -59.33 | 1.79 | 520.66 | 87.75 | 0. |
| 0.035 | 95061. | 15715. | 1342. | -1.783 | 0.030 | -56.15 | 2.21 | 677.53 | 82.22 | 0. |
| 0.040 | 91826. | 15652. | 1533. | -2.055 | 0.042 | -52.82 | 2.62 | 654.66 | 80.99 | 0. |
| 0.045 | 88312. | 15360. | 1530. | -2.311 | 0.056 | -49.61 | 3.02 | 629.72 | 78.00 | 0. |
| 0.050 | 84575. | 15001. | 1516. | -2.551 | 0.072 | -46.53 | 3.40 | 603.14 | 74.50 | 0. |
| 0.055 | 80672. | 14979. | 1919. | -2.777 | 0.090 | -43.58 | 3.77 | 575.59 | 73.49 | 0. |
| 0.060 | 80631. | 15342. | 1855. | -2.987 | 0.110 | -40.71 | 4.14 | 577.23 | 75.00 | 0. |
| 0.065 | 80583. | 15921. | 1986. | -3.184 | 0.132 | -37.81 | 4.52 | 579.36 | 77.97 | 0. |
| 0.070 | 79205. | 15521. | 1371. | -3.365 | 0.155 | -34.82 | 4.90 | 603.18 | 73.69 | 0. |
| 0.075 | 76722. | 15402. | 1297. | -3.532 | 0.181 | -31.84 | 5.26 | 587.31 | 71.48 | 0. |
| 0.080 | 78470. | 16458. | 1345. | -3.684 | 0.208 | -28.87 | 5.63 | 605.04 | 77.11 | 0. |
| 0.085 | 79147. | 17303. | 1316. | -3.820 | 0.237 | -25.81 | 6.03 | 615.86 | 80.82 | 0. |
| 0.090 | 77645. | 17667. | 1217. | -3.942 | 0.268 | -22.74 | 6.43 | 611.17 | 80.73 | 0. |
| 0.095 | 73804. | 17643. | 1197. | -4.048 | 0.301 | -19.73 | 6.83 | 589.77 | 77.52 | 0. |
| 0.100 | 67804. | 17600. | 1559. | -4.139 | 0.336 | -16.86 | 7.20 | 553.63 | 73.66 | 0. |
| 0.105 | 10363. | -315. | 959. | -4.218 | 0.373 | -14.94 | 7.35 | 74.65 | -36.70 | 0. |
| 0.110 | 9053. | 249. | 1723. | -4.292 | 0.409 | -14.61 | 7.18 | 66.77 | -32.82 | 0. |
| 0.115 | 9085. | 260. | 1681. | -4.364 | 0.445 | -14.27 | 7.02 | 67.02 | -32.95 | 0. |
| 0.120 | 9114. | 270. | 1641. | -4.434 | 0.480 | -13.94 | 6.85 | 67.27 | -33.07 | 0. |
| 0.125 | 9143. | 279. | 1601. | -4.503 | 0.513 | -13.60 | 6.69 | 67.51 | -33.19 | 0. |
| 0.130 | 9171. | 289. | 1563. | -4.570 | 0.546 | -13.26 | 6.52 | 67.74 | -33.30 | 0. |
| 0.135 | 9197. | 299. | 1526. | -4.636 | 0.579 | -12.92 | 6.35 | 67.96 | -33.41 | 0. |
| 0.140 | 9222. | 232. | 1431. | -4.699 | 0.610 | -12.58 | 6.18 | 69.19 | -34.01 | 0. |
| 0.145 | 9245. | 242. | 1398. | -4.762 | 0.641 | -12.23 | 6.01 | 69.39 | -34.11 | 0. |
| 0.150 | 9268. | 251. | 1365. | -4.822 | 0.670 | -11.89 | 5.84 | 69.58 | -34.20 | 0. |
| 0.155 | 9288. | 261. | 1335. | -4.880 | 0.699 | -11.54 | 5.67 | 69.75 | -34.29 | 0. |
| 0.160 | 9307. | 270. | 1306. | -4.937 | 0.727 | -11.19 | 5.50 | 69.92 | -34.37 | 0. |
| 0.165 | 9326. | 279. | 1278. | -4.992 | 0.754 | -10.84 | 5.33 | 70.08 | -34.45 | 0. |
| 0.170 | 9341. | 289. | 1252. | -5.046 | 0.780 | -10.49 | 5.16 | 70.22 | -34.52 | 0. |
| 0.175 | 9357. | 298. | 1227. | -5.097 | 0.805 | -10.14 | 4.98 | 70.36 | -34.59 | 0. |
| 0.180 | 9370. | 307. | 1204. | -5.147 | 0.830 | -9.78 | 4.81 | 70.47 | -34.64 | 0. |
| 0.185 | 9382. | 316. | 1182. | -5.195 | 0.854 | -9.43 | 4.64 | 70.59 | -34.70 | 0. |
| 0.190 | 9394. | 325. | 1161. | -5.241 | 0.876 | -9.08 | 4.46 | 70.70 | -34.75 | 0. |
| 0.195 | 9402. | 335. | 1143. | -5.286 | 0.898 | -8.72 | 4.29 | 70.78 | -34.79 | 0. |
| 0.200 | 9410. | 344. | 1125. | -5.328 | 0.919 | -8.37 | 4.11 | 70.86 | -34.84 | 0. |
| 0.205 | 9415. | 353. | 1109. | -5.369 | 0.939 | -8.02 | 3.94 | 70.93 | -34.87 | 0. |
| 0.210 | 9418. | 364. | 1097. | -5.409 | 0.959 | -7.66 | 3.77 | 70.96 | -34.88 | 0. |
| 0.215 | 9419. | 373. | 1084. | -5.446 | 0.977 | -7.31 | 3.59 | 71.01 | -34.91 | 0. |
| 0.220 | 9417. | 384. | 1075. | -5.482 | 0.995 | -6.95 | 3.42 | 71.02 | -34.91 | 0. |
| 0.225 | 9413. | 395. | 1068. | -5.516 | 1.011 | -6.60 | 3.24 | 71.01 | -34.91 | 0. |
| 0.230 | 9406. | 405. | 1061. | -5.548 | 1.027 | -6.24 | 3.07 | 71.01 | -34.91 | 0. |
| 0.235 | 9395. | 418. | 1060. | -5.578 | 1.042 | -5.89 | 2.89 | 70.96 | -34.88 | 0. |
| 0.240 | 9383. | 431. | 1059. | -5.607 | 1.056 | -5.53 | 2.72 | 70.90 | -34.85 | 0. |
| 0.245 | 9367. | 444. | 1061. | -5.633 | 1.069 | -5.18 | 2.54 | 70.82 | -34.81 | 0. |
| 0.250 | 9346. | 458. | 1066. | -5.658 | 1.081 | -4.82 | 2.37 | 70.71 | -34.76 | 0. |
| 0.255 | 9323. | 473. | 1074. | -5.682 | 1.093 | -4.47 | 2.20 | 70.58 | -34.70 | 0. |
| 0.260 | 9297. | 487. | 1083. | -5.703 | 1.103 | -4.12 | 2.02 | 70.44 | -34.63 | 0. |
| 0.265 | 9266. | 504. | 1097. | -5.723 | 1.113 | -3.77 | 1.85 | 70.25 | -34.54 | 0. |
| 0.270 | 9232. | 521. | 1112. | -5.741 | 1.122 | -3.41 | 1.68 | 70.06 | -34.44 | 0. |
| 0.275 | 9197. | 538. | 1129. | -5.757 | 1.130 | -3.07 | 1.51 | 69.85 | -34.34 | 0. |
| 0.280 | 9158. | 556. | 1149. | -5.771 | 1.137 | -2.72 | 1.34 | 69.62 | -34.22 | 0. |
| 0.285 | 9118. | 574. | 1169. | -5.784 | 1.143 | -2.37 | 1.16 | 69.39 | -34.11 | 0. |
| 0.290 | 9078. | 591. | 1191. | -5.795 | 1.149 | -2.02 | 0.99 | 69.14 | -33.99 | 0. |
| 0.295 | 9041. | 608. | 1212. | -5.804 | 1.153 | -1.68 | 0.82 | 68.91 | -33.87 | 0. |
| 0.300 | 9006. | 622. | 1230. | -5.812 | 1.157 | -1.33 | 0.66 | 68.70 | -33.77 | 0. |
| 0.305 | 8977. | 634. | 1247. | -5.818 | 1.160 | -0.99 | 0.49 | 68.52 | -33.68 | 0. |
| 0.310 | 8955. | 643. | 1259. | -5.822 | 1.162 | -0.65 | 0.32 | 68.39 | -33.62 | 0. |
| 0.315 | 8942. | 648. | 1267. | -5.824 | 1.163 | -0.31 | 0.15 | 68.31 | -33.58 | 0. |
| 0.320 | 8938. | 650. | 1269. | -5.825 | 1.163 | 0.04 | -0.02 | 68.28 | -33.56 | 0. |

TABLE 10.1

BEST AVAILABLE COPY

_DUA1:[PEI2.PCR.PF.RPRTJX1M20JQE00.CP2;1

ORCOEF = 14.40 Q.E. = 0.00 (DEGREES)

| TIME | U | Z | RPU | RPZ | TRU1 | TRZ1 | TRU2 | TRZ2 | FU | FZ |
|---|---|---|---|---|---|---|---|---|---|---|
| 0.000 | 0.000 | 0.000 | 0. | 0. | 0. | 1606. | 0. | 2644. | 0. | 4330. |
| 0.005 | -0.032 | 0.000 | 42736. | 0. | 31. | 11766. | -8. | -3179. | 42758. | 8587. |
| 0.010 | -0.232 | 0.001 | 70652. | 6. | 76. | 18384. | -29. | -6953. | 70699. | 11425. |
| 0.015 | -0.548 | 0.003 | 92648. | 30. | 207. | 24073. | -80. | -9260. | 92775. | 14703. |
| 0.020 | -0.874 | 0.006 | 96579. | 74. | 373. | 25093. | -146. | -9824. | 96806. | 15195. |
| 0.025 | -1.190 | 0.012 | 97057. | 135. | 562. | 25447. | -215. | -9761. | 97404. | 15551. |
| 0.030 | -1.494 | 0.020 | 97169. | 215. | 781. | 25055. | -287. | -9500. | 97663. | 16140. |
| 0.035 | -1.783 | 0.030 | 95060. | 306. | 998. | 25327. | -379. | -9625. | 95679. | 15397. |
| 0.040 | -2.055 | 0.042 | 91825. | 402. | 1232. | 24014. | -456. | -9181. | 92601. | 15231. |
| 0.045 | -2.311 | 0.056 | 88310. | 502. | 1471. | 24162. | -538. | -8830. | 89244. | 14829. |
| 0.050 | -2.551 | 0.072 | 84573. | 603. | 1714. | 23440. | -620. | -8479. | 85667. | 14350. |
| 0.055 | -2.777 | 0.090 | 80668. | 702. | 1972. | 22812. | -682. | -7888. | 81959. | 14221. |
| 0.060 | -2.987 | 0.110 | 80627. | 838. | 2353. | 23150. | -802. | -7886. | 82178. | 14425. |
| 0.065 | -3.184 | 0.132 | 80577. | 984. | 2819. | 23582. | -929. | -7773. | 82467. | 14825. |
| 0.070 | -3.365 | 0.155 | 79197. | 1121. | 3284. | 23354. | -1123. | -7985. | 81358. | 14248. |
| 0.075 | -3.532 | 0.181 | 76712. | 1245. | 3798. | 22991. | -1288. | -7795. | 79223. | 13951. |
| 0.080 | -3.684 | 0.208 | 78457. | 1445. | 4686. | 24023. | -1535. | -7069. | 81608. | 14708. |
| 0.085 | -3.820 | 0.237 | 79130. | 1642. | 5775. | 24736. | -1841. | -7886. | 83064. | 15208. |
| 0.090 | -3.942 | 0.268 | 77624. | 1803. | 7002. | 24751. | -2193. | -7751. | 82433. | 15197. |
| 0.095 | -4.048 | 0.301 | 73779. | 1908. | 8320. | 24031. | -2548. | -7359. | 79552. | 14764. |
| 0.100 | -4.139 | 0.336 | 67777. | 1942. | 9700. | 22712. | -2787. | -6526. | 74689. | 14244. |
| 0.105 | -4.218 | 0.373 | 10358. | 327. | 1202. | 2445. | -1341. | -2727. | 10219. | -609. |
| 0.110 | -4.292 | 0.409 | 9048. | 311. | 1160. | 2360. | -1050. | -2136. | 9158. | -88. |
| 0.115 | -4.364 | 0.445 | 9078. | 338. | 1185. | 2410. | -1070. | -2177. | 9193. | -105. |
| 0.120 | -4.434 | 0.480 | 9107. | 363. | 1209. | 2459. | -1090. | -2217. | 9226. | -121. |
| 0.125 | -4.503 | 0.513 | 9135. | 387. | 1232. | 2507. | -1109. | -2256. | 9258. | -137. |
| 0.130 | -4.570 | 0.546 | 9162. | 411. | 1255. | 2553. | -1128. | -2294. | 9289. | -152. |
| 0.135 | -4.636 | 0.579 | 9187. | 434. | 1277. | 2597. | -1145. | -2329. | 9319. | -166. |
| 0.140 | -4.699 | 0.610 | 9211. | 457. | 1285. | 2614. | -1183. | -2406. | 9313. | -248. |
| 0.145 | -4.762 | 0.641 | 9233. | 478. | 1305. | 2656. | -1199. | -2438. | 9339. | -261. |
| 0.150 | -4.822 | 0.670 | 9254. | 499. | 1325. | 2696. | -1214. | -2471. | 9365. | -274. |
| 0.155 | -4.880 | 0.699 | 9274. | 519. | 1344. | 2735. | -1229. | -2501. | 9389. | -285. |
| 0.160 | -4.937 | 0.727 | 9292. | 538. | 1363. | 2772. | -1243. | -2530. | 9411. | -296. |
| 0.165 | -4.992 | 0.754 | 9309. | 557. | 1380. | 2808. | -1257. | -2557. | 9432. | -307. |
| 0.170 | -5.046 | 0.780 | 9323. | 575. | 1397. | 2842. | -1270. | -2583. | 9451. | -316. |
| 0.175 | -5.097 | 0.805 | 9338. | 592. | 1413. | 2875. | -1282. | -2608. | 9470. | -325. |
| 0.180 | -5.147 | 0.830 | 9350. | 609. | 1429. | 2906. | -1293. | -2631. | 9486. | -333. |
| 0.185 | -5.195 | 0.854 | 9361. | 624. | 1443. | 2936. | -1304. | -2653. | 9501. | -341. |
| 0.190 | -5.241 | 0.876 | 9372. | 639. | 1458. | 2965. | -1314. | -2674. | 9515. | -348. |
| 0.195 | -5.286 | 0.898 | 9380. | 654. | 1471. | 2993. | -1323. | -2692. | 9527. | -353. |
| 0.200 | -5.328 | 0.919 | 9386. | 667. | 1484. | 3018. | -1332. | -2710. | 9538. | -359. |
| 0.205 | -5.369 | 0.939 | 9391. | 680. | 1496. | 3043. | -1340. | -2726. | 9547. | -363. |
| 0.210 | -5.409 | 0.959 | 9392. | 692. | 1507. | 3066. | -1346. | -2739. | 9553. | -365. |
| 0.215 | -5.446 | 0.977 | 9393. | 703. | 1517. | 3087. | -1353. | -2752. | 9558. | -368. |
| 0.220 | -5.482 | 0.995 | 9390. | 714. | 1527. | 3106. | -1358. | -2762. | 9559. | -369. |
| 0.225 | -5.516 | 1.011 | 9385. | 723. | 1536. | 3124. | -1362. | -2770. | 9559. | -369. |
| 0.230 | -5.548 | 1.027 | 9378. | 732. | 1544. | 3141. | -1365. | -2777. | 9557. | -368. |
| 0.235 | -5.578 | 1.042 | 9366. | 740. | 1551. | 3155. | -1367. | -2780. | 9551. | -365. |
| 0.240 | -5.607 | 1.056 | 9353. | 748. | 1558. | 3169. | -1368. | -2782. | 9543. | -361. |
| 0.245 | -5.633 | 1.069 | 9336. | 754. | 1563. | 3180. | -1368. | -2782. | 9532. | -356. |
| 0.250 | -5.658 | 1.081 | 9315. | 759. | 1568. | 3189. | -1366. | -2778. | 9517. | -348. |
| 0.255 | -5.682 | 1.093 | 9292. | 764. | 1572. | 3197. | -1363. | -2773. | 9500. | -340. |
| 0.260 | -5.703 | 1.103 | 9265. | 768. | 1575. | 3203. | -1360. | -2766. | 9480. | -331. |
| 0.265 | -5.723 | 1.113 | 9234. | 771. | 1577. | 3208. | -1354. | -2755. | 9456. | -318. |
| 0.270 | -5.741 | 1.122 | 9199. | 773. | 1578. | 3211. | -1348. | -2743. | 9429. | -305. |
| 0.275 | -5.757 | 1.130 | 9164. | 775. | 1579. | 3212. | -1342. | -2729. | 9401. | -292. |
| 0.280 | -5.771 | 1.137 | 9125. | 776. | 1579. | 3212. | -1333. | -2713. | 9371. | -276. |
| 0.285 | -5.784 | 1.143 | 9085. | 776. | 1578. | 3210. | -1325. | -2695. | 9338. | -261. |
| 0.290 | -5.795 | 1.149 | 9045. | 775. | 1577. | 3208. | -1316. | -2677. | 9306. | -245. |
| 0.295 | -5.804 | 1.153 | 9008. | 775. | 1575. | 3205. | -1307. | -2660. | 9276. | -229. |
| 0.300 | -5.812 | 1.157 | 8973. | 774. | 1574. | 3202. | -1300. | -2644. | 9247. | -216. |
| 0.305 | -5.818 | 1.160 | 8944. | 773. | 1572. | 3199. | -1293. | -2630. | 9224. | -204. |
| 0.310 | -5.822 | 1.162 | 8922. | 772. | 1571. | 3196. | -1288. | -2619. | 9205. | -195. |
| 0.315 | -5.824 | 1.163 | 8908. | 771. | 1570. | 3194. | -1284. | -2613. | 9194. | -190. |
| 0.320 | -5.825 | 1.163 | 8904. | 771. | 1570. | 3194. | -1283. | -2611. | 9191. | -188. |

TABLE 10.2

_DUA1:[PE12.PCR.PP.RPRTJX1M203QE00.CPJ;1

FORCES ON CRADLE AND TRAIL/LOWER CARRTAGE **********
ORCOEF = 14.40 Q.E. = 0.00 (DEGREES)

| TIME | F14_U | F14_Z | F13_U | F13_Z | F7_Y | R2_X | R2_Y | R1_Y | M2 |
|---|---|---|---|---|---|---|---|---|---|
| 0.000 | -9456. | -4501. | 9456. | 10341. | 4607. | 0. | 9335. | -335. | 0. |
| 0.005 | 25300. | -8970. | 17370. | 18995. | 21023. | 42758. | 5592. | 7665. | 96206. |
| 0.010 | 40576. | 11330. | 22123. | 24193. | 31913. | 70699. | 3100. | 12994. | 159073. |
| 0.015 | 65603. | -13414. | 27093. | 29627. | 41107. | 92775. | 2328. | 17125. | 208745. |
| 0.020 | 70243. | -12422. | 26563. | 29048. | 43020. | 96806. | 1703. | 18163. | 217814. |
| 0.025 | 71532. | -11311. | 25072. | 28292. | 43720. | 97404. | 1720. | 18501. | 219158. |
| 0.030 | 72179. | 10298. | 25484. | 27868. | 44410. | 97663. | 2070. | 18741. | 219743. |
| 0.035 | 72506. | -8426. | 23093. | 25253. | 43759. | 95679. | 1342. | 18725. | 215278. |
| 0.040 | 70963. | -7001. | 21638. | 23662. | 42941. | 92601. | 1533. | 18368. | 208353. |
| 0.045 | 69317. | -5532. | 19927. | 21791. | 41900. | 89244. | 1530. | 17969. | 200798. |
| 0.050 | 67451. | -4131. | 18215. | 19919. | 40724. | 85667. | 1516. | 17512. | 192750. |
| 0.055 | 64950. | -2949. | 17009. | 18600. | 39639. | 81959. | 1919. | 16972. | 184407. |
| 0.060 | 66017. | -1818. | 16162. | 17673. | 40123. | 82178. | 1855. | 17240. | 184902. |
| 0.065 | 66743. | -721. | 15523. | 16975. | 40735. | 82467. | 1986. | 17509. | 185550. |
| 0.070 | 67507. | 531. | 13851. | 15147. | 40331. | 81358. | 1371. | 17547. | 183056. |
| 0.075 | 66632. | 1613. | 12591. | 13769. | 39683. | 79223. | 1297. | 17324. | 178251. |
| 0.080 | 69369. | 2755. | 12239. | 13384. | 41253. | 81608. | 1345. | 18033. | 183618. |
| 0.085 | 71446. | 3932. | 11619. | 12706. | 42355. | 83064. | 1316. | 18562. | 186095. |
| 0.090 | 71824. | 5025. | 10609. | 11602. | 42405. | 82433. | 1217. | 18649. | 185474. |
| 0.095 | 70150. | 5921. | 9394. | 10273. | 41368. | 79552. | 1197. | 18236. | 178902. |
| 0.100 | 66353. | 6557. | 8337. | 9116. | 39515. | 74689. | 1559. | 17355. | 168051. |
| 0.105 | 10312. | 923. | -93. | -102. | 6845. | 10219. | 959. | 3101. | 22992. |
| 0.110 | 8773. | 921. | 305. | 421. | 6695. | 9150. | 1723. | 2859. | 20605. |
| 0.115 | 8900. | 1005. | 293. | 320. | 6719. | 9193. | 1681. | 2884. | 20684. |
| 0.120 | 9023. | 1088. | 203. | 221. | 6743. | 9226. | 1641. | 2909. | 20758. |
| 0.125 | 9144. | 1168. | 114. | 125. | 6766. | 9258. | 1601. | 2932. | 20831. |
| 0.130 | 9260. | 1247. | 28. | 31. | 6787. | 9289. | 1563. | 2955. | 20900. |
| 0.135 | 9373. | 1323. | -54. | -60. | 6854. | 9319. | 1526. | 2977. | 20967. |
| 0.140 | 9496. | 1382. | -103. | -200. | 6924. | 9313. | 1431. | 2991. | 20955. |
| 0.145 | 9599. | 1453. | -260. | -284. | 7006. | 9339. | 1398. | 3011. | 21014. |
| 0.150 | 9699. | 1522. | -334. | -365. | 7086. | 9365. | 1365. | 3031. | 21072. |
| 0.155 | 9794. | 1588. | -406. | -444. | 7163. | 9389. | 1335. | 3050. | 21124. |
| 0.160 | 9886. | 1653. | -475. | -520. | 7238. | 9411. | 1306. | 3068. | 21175. |
| 0.165 | 9974. | 1716. | -542. | -593. | 7310. | 9432. | 1278. | 3085. | 21222. |
| 0.170 | 10057. | 1777. | -606. | -663. | 7378. | 9451. | 1252. | 3102. | 21264. |
| 0.175 | 10138. | 1835. | -668. | -731. | 7445. | 9470. | 1227. | 3118. | 21307. |
| 0.180 | 10213. | 1892. | -727. | -795. | 7509. | 9486. | 1204. | 3133. | 21343. |
| 0.185 | 10284. | 1946. | -784. | -857. | 7570. | 9501. | 1182. | 3147. | 21376. |
| 0.190 | 10354. | 1999. | -838. | -917. | 7629. | 9515. | 1161. | 3161. | 21410. |
| 0.195 | 10417. | 2050. | -889. | -973. | 7684. | 9527. | 1143. | 3174. | 21436. |
| 0.200 | 10477. | 2098. | -939. | -1026. | 7737. | 9538. | 1125. | 3186. | 21460. |
| 0.205 | 10531. | 2144. | -985. | -1077. | 7787. | 9547. | 1109. | 3198. | 21480. |
| 0.210 | 10580. | 2188. | -1027. | -1123. | 7833. | 9553. | 1097. | 3208. | 21494. |
| 0.215 | 10626. | 2230. | -1068. | -1168. | 7877. | 9558. | 1084. | 3218. | 21505. |
| 0.220 | 10665. | 2269. | -1105. | -1209. | 7918. | 9559. | 1075. | 3226. | 21509. |
| 0.225 | 10699. | 2307. | -1139. | -1246. | 7955. | 9559. | 1068. | 3234. | 21508. |
| 0.230 | 10728. | 2342. | -1171. | -1281. | 7989. | 9557. | 1061. | 3240. | 21501. |
| 0.235 | 10749. | 2375. | -1198. | -1310. | 8020. | 9551. | 1060. | 3245. | 21489. |
| 0.240 | 10766. | 2406. | -1223. | -1338. | 8047. | 9543. | 1059. | 3250. | 21472. |
| 0.245 | 10777. | 2435. | -1245. | -1361. | 8072. | 9532. | 1061. | 3253. | 21447. |
| 0.250 | 10779. | 2462. | -1262. | -1380. | 8091. | 9517. | 1066. | 3255. | 21413. |
| 0.255 | 10777. | 2486. | -1277. | -1396. | 8109. | 9500. | 1074. | 3256. | 21375. |
| 0.260 | 10768. | 2508. | -1288. | -1409. | 8122. | 9480. | 1083. | 3256. | 21329. |
| 0.265 | 10752. | 2528. | -1296. | -1417. | 8132. | 9456. | 1097. | 3255. | 21276. |
| 0.270 | 10729. | 2546. | -1300. | -1422. | 8138. | 9429. | 1112. | 3252. | 21216. |
| 0.275 | 10703. | 2562. | -1302. | -1424. | 8141. | 9401. | 1129. | 3249. | 21153. |
| 0.280 | 10671. | 2575. | -1300. | -1422. | 8141. | 9371. | 1149. | 3245. | 21084. |
| 0.285 | 10635. | 2587. | -1296. | -1418. | 8139. | 9338. | 1169. | 3240. | 21011. |
| 0.290 | 10596. | 2596. | -1290. | -1411. | 8134. | 9306. | 1191. | 3234. | 20930. |
| 0.295 | 10559. | 2605. | -1284. | -1404. | 8129. | 9276. | 1212. | 3229. | 20879. |
| 0.300 | 10524. | 2610. | -1277. | -1396. | 8123. | 9247. | 1230. | 3224. | 20807. |
| 0.305 | 10494. | 2615. | -1270. | -1389. | 8117. | 9224. | 1247. | 3219. | 20753. |
| 0.310 | 10470. | 2618. | -1265. | -1383. | 8112. | 9205. | 1259. | 3216. | 20712. |
| 0.315 | 10456. | 2620. | -1261. | -1379. | 8109. | 9194. | 1267. | 3214. | 20687. |
| 0.320 | 10451. | 2620. | -1260. | -1378. | 8108. | 9191. | 1269. | 3213. | 20680. |

TABLE 10.3

BEST AVAILABLE COPY

_UUA1:CPE12.FCR  RPRTJX1M203QE00.CP4;1

FORCES ON UPPER CARRIAGE ********************************
ORCOEF = 14.40  Q.E. = 0.00 (DEGREES)  F2_X CHOSEN= 0.

| TIME | F12_X | F12_Y | F11_X | F11_Y | F9_Y | F1_X | F2_Y | F3_Y |
|---|---|---|---|---|---|---|---|---|
| 0.000 | 9456. | 4501. | -9456. | -10341. | 10341. | 0. | 4720. | -9309. |
| 0.005 | -25380. | 8978. | -17370. | -18995. | 18995. | 42750. | -15431. | 6452. |
| 0.010 | -40576. | 11330. | -22123. | -24193. | 24193. | 70699. | -28013. | 17475. |
| 0.015 | -65683. | 13414. | -27093. | -29627. | 29627. | 92775. | -38779. | 25365. |
| 0.020 | -70243. | 12422. | -26563. | -29048. | 29048. | 96806. | -41317. | 28895. |
| 0.025 | -71532. | 11311. | -25072. | -28292. | 28292. | 97404. | -42000. | 30609. |
| 0.030 | -72179. | 10298. | -25484. | -27868. | 27868. | 97663. | -42340. | 32042. |
| 0.035 | -72586. | 8426. | -23093. | -25253. | 25253. | 95679. | -42417. | 33991. |
| 0.040 | -70963. | 7001. | -21638. | -23662. | 23662. | 92601. | -41408. | 34407. |
| 0.045 | -69317. | 5532. | -19927. | -21791. | 21791. | 89244. | -40370. | 34838. |
| 0.050 | -67451. | 4131. | -18215. | -19919. | 19919. | 85667. | -39208. | 35077. |
| 0.055 | -64950. | 2949. | -17009. | -18600. | 18600. | 81959. | -37720. | 34771. |
| 0.060 | -66017. | 1818. | -16162. | -17673. | 17673. | 82178. | -38268. | 36450. |
| 0.065 | -66943. | 721. | -15523. | -16975. | 16975. | 82467. | -38749. | 38029. |
| 0.070 | -67507. | -531. | -13851. | -15147. | 15147. | 81358. | -38960. | 39491. |
| 0.075 | -66632. | -1613. | -12591. | -13769. | 13769. | 79223. | -38386. | 39999. |
| 0.080 | -69369. | -2755. | -12239. | -13384. | 13384. | 81608. | -39907. | 42662. |
| 0.085 | -71446. | -3932. | -11619. | -12706. | 12706. | 83064. | -41039. | 44971. |
| 0.090 | -71824. | -5025. | -10609. | -11602. | 11602. | 82433. | -41187. | 46212. |
| 0.095 | -70158. | -5921. | -9394. | -10273. | 10273. | 79552. | -40170. | 46092. |
| 0.100 | -66353. | -6557. | -8337. | -9116. | 9116. | 74689. | -37956. | 44514. |
| 0.105 | -10312. | -923. | 93. | 102. | 0. | 10219. | -5886. | 6706. |
| 0.110 | -8773. | -921. | -385. | -421. | 421. | 9158. | -4972. | 5093. |
| 0.115 | -8900. | -1005. | -293. | -320. | 320. | 9193. | -5038. | 6044. |
| 0.120 | -9023. | -1088. | -203. | -221. | 221. | 9226. | -5102. | 6190. |
| 0.125 | -9144. | -1168. | -114. | -125. | 125. | 9258. | -5165. | 6333. |
| 0.130 | -9260. | -1247. | -28. | -31. | 31. | 9289. | -5225. | 6471. |
| 0.135 | -9373. | -1323. | 54. | 60. | 0. | 9319. | -5327. | 6591. |
| 0.140 | -9496. | -1382. | 183. | 200. | 0. | 9313. | -5493. | 6675. |
| 0.145 | -9599. | -1453. | 260. | 284. | 0. | 9339. | -5608. | 6777. |
| 0.150 | -9699. | -1522. | 334. | 365. | 0. | 9365. | -5721. | 6877. |
| 0.155 | -9794. | -1588. | 406. | 444. | 0. | 9389. | -5828. | 6973. |
| 0.160 | -9886. | -1653. | 475. | 520. | 0. | 9411. | -5932. | 7065. |
| 0.165 | -9974. | -1716. | 542. | 593. | 0. | 9432. | -6031. | 7155. |
| 0.170 | -10057. | -1777. | 606. | 663. | 0. | 9451. | -6126. | 7240. |
| 0.175 | -10138. | -1835. | 668. | 731. | 0. | 9470. | -6218. | 7323. |
| 0.180 | -10213. | -1892. | 727. | 795. | 0. | 9486. | -6305. | 7402. |
| 0.185 | -10284. | -1946. | 784. | 857. | 0. | 9501. | -6388. | 7477. |
| 0.190 | -10354. | -1999. | 838. | 917. | 0. | 9515. | -6468. | 7550. |
| 0.195 | -10417. | -2050. | 889. | 973. | 0. | 9527. | -6541. | 7618. |
| 0.200 | -10477. | -2098. | 939. | 1026. | 0. | 9538. | -6612. | 7683. |
| 0.205 | -10531. | -2144. | 985. | 1077. | 0. | 9547. | -6677. | 7744. |
| 0.210 | -10580. | -2188. | 1027. | 1123. | 0. | 9553. | -6736. | 7801. |
| 0.215 | -10626. | -2230. | 1068. | 1168. | 0. | 9558. | -6793. | 7855. |
| 0.220 | -10665. | -2269. | 1105. | 1209. | 0. | 9559. | -6843. | 7904. |
| 0.225 | -10699. | -2307. | 1139. | 1246. | 0. | 9559. | -6888. | 7949. |
| 0.230 | -10728. | -2342. | 1171. | 1281. | 0. | 9557. | -6928. | 7989. |
| 0.235 | -10749. | -2375. | 1198. | 1310. | 0. | 9551. | -6960. | 8025. |
| 0.240 | -10766. | -2406. | 1223. | 1338. | 0. | 9543. | -6989. | 8057. |
| 0.245 | -10777. | -2435. | 1245. | 1361. | 0. | 9532. | -7011. | 8085. |
| 0.250 | -10779. | -2462. | 1262. | 1380. | 0. | 9517. | -7025. | 8107. |
| 0.255 | -10777. | -2486. | 1277. | 1396. | 0. | 9500. | -7035. | 8125. |
| 0.265 | -10752. | -2528. | 1296. | 1417. | 0. | 9456. | -7035. | 8146. |
| 0.270 | -10729. | -2546. | 1300. | 1422. | 0. | 9429. | -7025. | 8150. |
| 0.275 | -10703. | -2562. | 1302. | 1424. | 0. | 9401. | -7012. | 8150. |
| 0.280 | -10671. | -2575. | 1300. | 1422. | 0. | 9371. | -6993. | 8146. |
| 0.285 | -10635. | -2587. | 1296. | 1418. | 0. | 9338. | -6969. | 8138. |
| 0.290 | -10596. | -2596. | 1290. | 1411. | 0. | 9306. | -6943. | 8128. |
| 0.295 | -10559. | -2605. | 1284. | 1404. | 0. | 9276. | -6917. | 8118. |
| 0.300 | -10524. | -2610. | 1277. | 1396. | 0. | 9247. | -6892. | 8106. |
| 0.305 | -10494. | -2615. | 1270. | 1389. | 0. | 9224. | -6870. | 8096. |
| 0.310 | -10470. | -2618. | 1265. | 1383. | 0. | 9205. | -6853. | 8088. |
| 0.315 | -10456. | -2620. | 1261. | 1379. | 0. | 9194. | -6842. | 8082. |
| 0.320 | -10451. | -2620. | 1260. | 1378. | 0. | 9191. | -6839. | 8081. |

TABLE 10.4

_DUA1:LPE12.PCR.PP.RF[illegible]X1SRQE45.CP1;1

ORCOEF = 14.40 Q.E. = 45.00 (DEGREES)

| TIME | RP | FTRACK | F-FLOAT_Y | U | Z | VU | VZ | AU | AZ | |
|---|---|---|---|---|---|---|---|---|---|---|
| 0.000 | 3062. | 3062. | 8724. | 0.000 | 0.000 | 0.00 | 0.00 | 0.00 | 0.00 | 0. |
| 0.005 | 44063. | 7308. | 31602. | -0.032 | 0.000 | -19.54 | 0.05 | -7041.92 | 31.55 | 0. |
| 0.010 | 87934. | 10105. | 53965. | -0.232 | 0.001 | -56.40 | 0.23 | -4565.70 | 52.27 | 0. |
| 0.015 | 105563. | 13268. | 65080. | -0.547 | 0.003 | -65.27 | 0.56 | -97.32 | 75.57 | 0. |
| 0.020 | 104530. | 13596. | 64737. | -0.869 | 0.006 | -63.64 | 0.94 | 423.40 | 77.67 | 0. |
| 0.025 | 102663. | 13924. | 64003. | -1.181 | 0.012 | -60.92 | 1.33 | 537.32 | 79.63 | 0. |
| 0.030 | 102178. | 14470. | 64090. | -1.479 | 0.020 | -58.25 | 1.73 | 534.65 | 83.06 | 0. |
| 0.035 | 100779. | 13603. | 62236. | -1.762 | 0.029 | -55.00 | 2.13 | 696.58 | 75.89 | 0. |
| 0.040 | 99304. | 13367. | 61038. | -2.028 | 0.041 | -51.54 | 2.50 | 686.53 | 73.31 | 0. |
| 0.045 | 98165. | 12608. | 59435. | -2.278 | 0.054 | -48.13 | 2.86 | 678.78 | 66.75 | 0. |
| 0.050 | 97313. | 11698. | 57809. | -2.510 | 0.069 | -44.74 | 3.17 | 673.05 | 58.98 | 0. |
| 0.055 | 97201. | 10714. | 56435. | -2.725 | 0.086 | -41.38 | 3.44 | 672.66 | 50.57 | 0. |
| 0.060 | 97560. | 9942. | 55495. | -2.924 | 0.104 | -38.01 | 3.67 | 675.83 | 43.63 | 0. |
| 0.065 | 98288. | 9047. | 54590. | -3.105 | 0.123 | -34.63 | 3.87 | 681.58 | 35.68 | 0. |
| 0.070 | 98770. | 6941. | 52344. | -3.270 | 0.142 | -31.10 | 4.01 | 716.32 | 18.79 | 0. |
| 0.075 | 99371. | 4627. | 49947. | -3.416 | 0.163 | -27.51 | 4.06 | 719.19 | 0.37 | 0. |
| 0.080 | 100752. | 1543. | 47096. | -3.545 | 0.183 | -23.89 | 4.00 | 726.32 | -23.71 | 0. |
| 0.085 | 98736. | -1065. | 43345. | -3.655 | 0.202 | -20.29 | 3.83 | 707.95 | -43.71 | 0. |
| 0.090 | 103914. | -5717. | 40466. | -3.748 | 0.221 | -16.69 | 3.53 | 739.09 | -79.32 | 0. |
| 0.095 | 103908. | -10366. | 35478. | -3.822 | 0.237 | -12.99 | 3.04 | 730.27 | -113.77 | 0. |
| 0.100 | 101118. | -14393. | 30032. | -3.878 | 0.251 | -9.44 | 2.40 | 700.69 | -142.80 | 0. |
| 0.105 | 84250. | -14147. | 23339. | -3.917 | 0.261 | -6.18 | 1.68 | 574.27 | -138.38 | 0. |
| 0.110 | 57031. | -9483. | 17089. | -3.941 | 0.268 | -3.80 | 1.07 | 380.43 | -100.38 | 0. |
| 0.115 | 35237. | -4820. | 13079. | -3.956 | 0.272 | -2.31 | 0.67 | 227.72 | -63.31 | 0. |
| 0.120 | 21947. | -1714. | 10916. | -3.965 | 0.275 | -1.42 | 0.42 | 135.38 | -38.04 | 0. |
| 0.125 | 14649. | 67. | 9809. | -3.971 | 0.277 | -0.88 | 0.26 | 84.92 | -24.87 | 0. |
| 0.130 | 10778. | 1035. | 9248. | -3.974 | 0.278 | -0.53 | 0.16 | 58.24 | -17.30 | 0. |
| 0.135 | 8823. | 1531. | 8971. | -3.976 | 0.278 | -0.28 | 0.08 | 44.78 | -13.43 | 0. |
| 0.140 | 8040. | 1681. | 8811. | -3.977 | 0.279 | -0.07 | 0.02 | 40.57 | -12.22 | 0. |

TABLE 11.1

_DUA1:LPE12.PCR.PP.RFRTJX1SRQE45.CP2;1

ORCOEF = 14.40 Q.E. = 45.00 (DEGREES)

| TIME | U | Z | RPU | RPZ | TRU1 | TRZ1 | TRU2 | TRZ2 | FU | FZ |
|---|---|---|---|---|---|---|---|---|---|---|
| 0.000 | 0.000 | 0.000 | 3062. | 0. | 0. | 1796. | 0. | 1266. | 3062. | 3062. |
| 0.005 | -0.032 | 0.000 | 44063. | 0. | 30. | 11529. | -11. | -4221. | 44082. | 7308. |
| 0.010 | -0.232 | 0.001 | 87934. | 8. | 88. | 21275. | -46. | -11170. | 87976. | 10097. |
| 0.015 | -0.547 | 0.003 | 105563. | 34. | 224. | 26022. | -110. | -12755. | 105677. | 13233. |
| 0.020 | -0.869 | 0.006 | 104530. | 79. | 384. | 26016. | -183. | -12421. | 104731. | 13516. |
| 0.025 | -1.181 | 0.012 | 102663. | 141. | 565. | 25872. | -261. | -11952. | 102967. | 13780. |
| 0.030 | -1.479 | 0.020 | 102178. | 222. | 770. | 26115. | -347. | -11652. | 102609. | 14242. |
| 0.035 | -1.762 | 0.029 | 100779. | 316. | 992. | 25649. | -466. | -12056. | 101304. | 13277. |
| 0.040 | -2.028 | 0.041 | 99303. | 422. | 1236. | 25431. | -587. | -12080. | 99952. | 12929. |
| 0.045 | -2.278 | 0.054 | 98163. | 540. | 1489. | 25094. | -742. | -12508. | 98910. | 12046. |
| 0.050 | -2.510 | 0.069 | 97311. | 668. | 1755. | 24770. | -928. | -13101. | 98138. | 11001. |
| 0.055 | -2.725 | 0.086 | 97198. | 809. | 2045. | 24583. | -1157. | -13906. | 98086. | 9868. |
| 0.060 | -2.924 | 0.104 | 97555. | 962. | 2377. | 24589. | -1420. | -14693. | 98512. | 8934. |
| 0.065 | -3.105 | 0.123 | 98282. | 1126. | 2756. | 24638. | -1751. | -15647. | 99287. | 7865. |
| 0.070 | -3.270 | 0.142 | 98762. | 1294. | 3116. | 24175. | -2229. | -17291. | 99649. | 5590. |
| 0.075 | -3.416 | 0.163 | 99360. | 1466. | 3491. | 23666. | -2815. | -19089. | 100035. | 3112. |
| 0.080 | -3.545 | 0.183 | 100739. | 1652. | 3856. | 23040. | -3601. | -21518. | 100994. | -130. |
| 0.085 | -3.655 | 0.202 | 98720. | 1775. | 4117. | 21835. | -4315. | -22081. | 98522. | -2822. |
| 0.090 | -3.748 | 0.221 | 103895. | 2021. | 4536. | 21471. | -5717. | -27065. | 102713. | -7615. |
| 0.095 | -3.822 | 0.237 | 103885. | 2158. | 4662. | 19931. | -7024. | -30025. | 101525. | -12252. |
| 0.100 | -3.878 | 0.251 | 101094 | 2210. | 4571. | 17962. | -8121. | -31910. | 97544. | -16158. |
| 0.105 | -3.917 | 0.261 | 84220. | 1910. | 3870. | 14281. | -7570. | -27935. | 80528. | -15564. |
| 0.110 | -3.941 | 0.268 | 57016. | 1323. | 2758. | 9761. | -5336. | -18887. | 54430. | -10450. |
| 0.115 | -3.956 | 0.272 | 35237. | 830. | 1869. | 6443. | -3211. | -11072. | 33884. | -5459. |
| 0.120 | -3.965 | 0.275 | 21940. | 521. | 1328. | 4502. | -1812. | -6147. | 21456. | -2166. |
| 0.125 | -3.971 | 0.277 | 14645. | 350. | 1031. | 3461. | -1012. | -3397. | 14664. | -286. |
| 0.130 | -3.974 | 0.278 | 10775. | 258. | 874. | 2915. | -577. | -1924. | 11072. | 733. |
| 0.135 | -3.976 | 0.278 | 8821. | 212. | 795. | 2642. | -354. | -1176. | 9262. | 1254. |
| 0.140 | -3.977 | 0.279 | 8037. | 193. | 758. | 2515. | -273. | -905. | 8523. | 1417. |

TABLE 11.2

_DUA1:LPE12.FCR.FF 'JX1SRQE45.CPJ;1

BEST AVAILABLE COPY

FORCES ON CRADLE AND TRAIL/LOWER CARRIAGE **********
ORCOEF = 14.40 Q.E. = 45.00 (DEGREES)

| TIME | F14_U | F14_Z | F13_U | F13_Z | F7_Y | R2_X | R2_Y | R1_Y | M2 |
|---|---|---|---|---|---|---|---|---|---|
| 0.000 | -4406. | -3616. | 8479. | 7689. | 8444. | 0. | 8724. | 276. | 0. |
| 0.005 | 26595. | -8457. | 18499. | 16776. | 45659. | 26003. | 31602. | 9406. | 58508. |
| 0.010 | 64503. | -11096. | 24484. | 22204. | 84218. | 55068. | 53965. | 20053. | 123904. |
| 0.015 | 76268. | -13344. | 30420. | 27588. | 100946. | 65367. | 65080. | 23672. | 147076. |
| 0.020 | 76106. | -12350. | 29636. | 26877. | 100139. | 64498. | 64737. | 23546. | 145122. |
| 0.025 | 75228. | -11282. | 28750. | 26073. | 98625. | 63065. | 64003. | 23219. | 141895. |
| 0.030 | 75426. | -10316. | 28194. | 25569. | 98403. | 62485. | 64090. | 23206. | 140591. |
| 0.035 | 77393. | -8314. | 24923. | 22602. | 96522. | 62245. | 62236. | 23455. | 140051. |
| 0.040 | 78040. | -6048. | 22923. | 20789. | 94989. | 61534. | 61038. | 23451. | 138452. |
| 0.045 | 79838. | -5156. | 20083. | 18213. | 93416. | 61422. | 59435. | 23693. | 138199. |
| 0.050 | 82028. | -3514. | 17120. | 15526. | 91996. | 61615. | 57809. | 24034. | 138633. |
| 0.055 | 84936. | -1963. | 14160. | 12842. | 91151. | 62379. | 56435. | 24570. | 140353. |
| 0.060 | 87885. | -609. | 11638. | 10554. | 90836. | 63341. | 55495. | 25152. | 142517. |
| 0.065 | 91279. | 696. | 9019. | 8180. | 90753. | 64645. | 54590. | 25848. | 145452. |
| 0.070 | 95819. | 2211. | 4841. | 4391. | 89696. | 66509. | 52344. | 26742. | 149646. |
| 0.075 | 100441. | 3574. | 605. | 549. | 88581. | 68535. | 49947. | 27659. | 154204. |
| 0.080 | 106460. | 4922. | -4456. | -4041. | 92039. | 71505. | 47096. | 28896. | 160886. |
| 0.085 | 107899. | 5776. | -8366. | -7587. | 92426. | 71661. | 43345. | 28996. | 161237. |
| 0.090 | 118883. | 7144. | -15159. | -13747. | 100165. | 78013. | 40466. | 31449. | 175530. |
| 0.095 | 123702. | 7955. | -21167. | -19196. | 102775. | 80452. | 35478. | 32318. | 181017. |
| 0.100 | 124417. | 8307. | -25862. | -23454. | 102163. | 80400. | 30032. | 32187. | 180900. |
| 0.105 | 105468. | 7148. | -23929. | -21701. | 86445. | 67947. | 23339. | 27267. | 152881. |
| 0.110 | 71182. | 4830. | -15733. | -14269. | 59261. | 45882. | 17009. | 18606. | 103235. |
| 0.115 | 42994. | 2896. | -8098. | -7344. | 37157. | 27820. | 13079. | 11691. | 62596. |
| 0.120 | 25614. | 1700. | -3147. | -2854. | 23596. | 16703. | 10916. | 7394. | 37581. |
| 0.125 | 16021. | 1039. | -346. | -314. | 16130. | 10571. | 9809. | 5027. | 23786. |
| 0.130 | 10919. | 688. | 1165. | 1056. | 13333. | 7311. | 9248. | 3770. | 16450. |
| 0.135 | 8338. | 510. | 1935. | 1755. | 12101. | 5662. | 8971. | 3134. | 12740. |
| 0.140 | 7344. | 442. | 2189. | 1986. | 11573. | 5025. | 8811. | 2887. | 11306. |

TABLE 11.3

_DUA1:LPE12.FCR.FF.RPRTJX1SRQE45.CP4;1

FORCES ON UPPER CARRIAGE **********
ORCOEF = 14.40 Q.E. = 45.00 (DEGREES) F2_X CHOSEN= 0.

| TIME | F12_X | F12_Y | F11_X | F11_Y | F9_Y | F1_X | F2_Y | F3_Y |
|---|---|---|---|---|---|---|---|---|
| 0.000 | 558. | 5672. | -558. | -11432. | 11432. | 0. | 279. | -5951. |
| 0.005 | -24786. | -12825. | -1218. | -24943. | 24943. | 26003. | -14057. | 26882. |
| 0.010 | -53456. | -37764. | -1612. | -33014. | 33014. | 55068. | -30253. | 68017. |
| 0.015 | -63365. | -44494. | -2003. | -41018. | 41018. | 65367. | -35866. | 80360. |
| 0.020 | -62547. | -45083. | -1951. | -39960. | 39960. | 64498. | -35402. | 80484. |
| 0.025 | -61172. | -45216. | -1893. | -38766. | 38766. | 63065. | -34622. | 79830. |
| 0.030 | -60629. | -46040. | -1856. | -38016. | 38016. | 62485. | -34313. | 80353. |
| 0.035 | -60604. | -48046. | -1641. | -33605. | 33605. | 62245. | -34286. | 83132. |
| 0.040 | -60025. | -50340. | -1509. | -30909. | 30909. | 61534. | -33951. | 84291. |
| 0.045 | -60100. | -52808. | -1322. | -27080. | 27080. | 61422. | -33981. | 86789. |
| 0.050 | -60488. | -55518. | -1127. | -23085. | 23085. | 61615. | -34187. | 89705. |
| 0.055 | -61447. | -58672. | -932. | -19093. | 19093. | 62379. | -34716. | 93387. |
| 0.060 | -62575. | -61714. | -766. | -15693. | 15693. | 63341. | -35341. | 97055. |
| 0.065 | -64052. | -65037. | -594. | -12162. | 12162. | 64645. | -36163. | 101200. |
| 0.070 | -66191. | -69318. | -319. | -6528. | 6528. | 66509. | -37352. | 106670. |
| 0.075 | -68495. | -73550. | -40. | -816. | 816. | 68535. | -38634. | 112184. |
| 0.080 | -71798. | -78760. | 293. | 6008. | 0. | 71505. | -44944. | 117695. |
| 0.085 | -72212. | -80381. | 551. | 11280. | 0. | 71661. | -49081. | 118182. |
| 0.090 | -79011. | -89114. | 998. | 20440. | 0. | 78013. | -59699. | 128374. |
| 0.095 | -81846. | -93096. | 1394. | 28540. | 0. | 80452. | -67297. | 131853. |
| 0.100 | -82102. | -93850. | 1703. | 34872. | 0. | 80400. | -72131. | 131109. |
| 0.105 | -69522. | -79632. | 1575. | 32266. | 0. | 67947. | -63106. | 110472. |
| 0.110 | -46918. | -53749. | 1036. | 21215. | 0. | 45882. | -42173. | 74707. |
| 0.115 | -28353. | -32449. | 533. | 10920. | 0. | 27820. | -24078. | 45608. |
| 0.120 | -16910. | -19314. | 207. | 4244. | 0. | 16703. | -12680. | 27750. |
| 0.125 | -10594. | -12063. | 23. | 467. | 0. | 10571. | -6321. | 17918. |
| 0.130 | -7234. | -8207. | -77. | -1570. | 1570. | 7311. | -4085. | 12292. |
| 0.135 | -5535. | -6257. | -127. | -2609. | 2609. | 5662. | -3130. | 9386. |
| 0.140 | -4801. | -5506. | -144. | -2952. | 2952. | 5025. | -2762. | 8260. |

TABLE 11.4

BEST AVAILABLE COPY

_DUA1:UPE12.PCP " RPRTJX1SRQE70.CF1;1

ORCOEF = 14.40 Q.E. = 70.00 (DEGREES)

| TIME | RP | FTRACK | F-FLOAT_Y | U | Z | VU | VZ | AU | AZ | |
|---|---|---|---|---|---|---|---|---|---|---|
| 0.000 | 4069. | 1481. | 7961. | 0.000 | 0.000 | 0.00 | 0.00 | 0.00 | 0.00 | 0. |
| 0.005 | 44111. | 5735. | 40176. | -0.033 | 0.000 | -19.58 | 0.05 | -7849.08 | 31.53 | 0. |
| 0.010 | 88123. | 8545. | 73841. | -0.233 | 0.001 | -56.47 | 0.23 | -4571.82 | 52.42 | 0. |
| 0.015 | 105873. | 11730. | 89074. | -0.548 | 0.003 | -65.37 | 0.56 | -102.59 | 75.89 | 0. |
| 0.020 | 104929. | 12076. | 88499. | -0.871 | 0.006 | -63.76 | 0.94 | 418.71 | 78.12 | 0. |
| 0.025 | 103168. | 12416. | 87322. | -1.183 | 0.012 | -61.07 | 1.34 | 533.35 | 80.17 | 0. |
| 0.030 | 102798. | 12984. | 87308. | -1.481 | 0.020 | -58.41 | 1.74 | 531.45 | 83.75 | 0. |
| 0.035 | 101524. | 12149. | 85473. | -1.766 | 0.030 | -55.17 | 2.14 | 694.22 | 76.82 | 0. |
| 0.040 | 100180. | 11921. | 84104. | -2.033 | 0.041 | -51.73 | 2.52 | 685.05 | 74.28 | 0. |
| 0.045 | 99182. | 11173. | 82558. | -2.283 | 0.055 | -48.32 | 2.88 | 678.25 | 67.79 | 0. |
| 0.050 | 98450. | 10302. | 81109. | -2.516 | 0.070 | -44.94 | 3.20 | 673.30 | 60.29 | 0. |
| 0.055 | 98536. | 9277. | 80116. | -2.732 | 0.087 | -41.57 | 3.48 | 674.25 | 51.55 | 0. |
| 0.060 | 99126. | 8534. | 79710. | -2.932 | 0.105 | -38.19 | 3.72 | 679.01 | 44.79 | 0. |
| 0.065 | 100129. | 7617. | 79457. | -3.114 | 0.124 | -34.78 | 3.92 | 686.65 | 36.65 | 0. |
| 0.070 | 100958. | 5476. | 78090. | -3.279 | 0.144 | -31.23 | 4.06 | 723.75 | 19.44 | 0. |
| 0.075 | 102032. | 3026. | 76633. | -3.426 | 0.164 | -27.60 | 4.11 | 729.78 | -0.05 | 0. |
| 0.080 | 103554. | -160. | 74862. | -3.555 | 0.185 | -23.92 | 4.05 | 737.56 | -24.90 | 0. |
| 0.085 | 101469. | -2816. | 71023. | -3.666 | 0.204 | -20.26 | 3.87 | 718.32 | -45.23 | 0. |
| 0.090 | 108365. | -8029. | 71179. | -3.758 | 0.223 | -16.56 | 3.55 | 760.96 | -85.14 | 0. |
| 0.095 | 107697. | -12786. | 66477. | -3.831 | 0.240 | -12.76 | 3.03 | 746.55 | -120.19 | 0. |
| 0.100 | 105620. | -17179. | 61099. | -3.886 | 0.253 | -9.10 | 2.34 | 721.16 | -151.88 | 0. |
| 0.105 | 84323. | -15821. | 47577. | -3.923 | 0.263 | -5.82 | 1.59 | 563.78 | -138.66 | 0. |
| 0.110 | 55479. | -10556. | 32384. | -3.946 | 0.269 | -3.53 | 1.00 | 359.09 | -96.04 | 0. |
| 0.115 | 34046. | -5845. | 21834. | -3.959 | 0.273 | -2.14 | 0.62 | 209.20 | -58.67 | 0. |
| 0.120 | 21525. | -2875. | 15877. | -3.968 | 0.276 | -1.33 | 0.39 | 122.30 | -35.29 | 0. |
| 0.125 | 14764. | -1207. | 12721. | -3.973 | 0.277 | -0.85 | 0.25 | 75.58 | -22.22 | 0. |
| 0.130 | 11149. | -296. | 11053. | -3.977 | 0.278 | -0.54 | 0.16 | 50.68 | -15.10 | 0. |
| 0.135 | 9228. | 195. | 10173. | -3.979 | 0.279 | -0.32 | 0.10 | 37.45 | -11.26 | 0. |
| 0.140 | 8268. | 393. | 9692. | -3.980 | 0.279 | -0.15 | 0.04 | 32.03 | -9.69 | 0. |
| 0.145 | 7992. | 464. | 9567. | -3.980 | 0.279 | 0.01 | 0.00 | 30.13 | -9.13 | 0. |

TABLE 12.1

_DUA1:UPE12.PCR.PP.RPRTJX1SRQE70.CF2;1

ORCOEF = 14.40 Q.E. = 70.00 (DEGREES)

| TIME | U | Z | RPU | RPZ | TRU1 | TRZ1 | TRU2 | TRZ2 | FU | FZ |
|---|---|---|---|---|---|---|---|---|---|---|
| 0.000 | 0.000 | 0.000 | 4069. | 0. | 0. | 1379. | 0. | 102. | 4069. | 1481. |
| 0.005 | -0.033 | 0.000 | 44111. | 0. | 29. | 10922. | -14. | -5197. | 44126. | 5724. |
| 0.010 | -0.233 | 0.001 | 88123. | 8. | 86. | 20705. | -50. | -12160. | 88158. | 8537. |
| 0.015 | -0.548 | 0.003 | 105873. | 34. | 219. | 25485. | -118. | -13755. | 105974. | 11696. |
| 0.020 | -0.871 | 0.006 | 104929. | 79. | 377. | 25503. | -199. | -13429. | 105107. | 11995. |
| 0.025 | -1.183 | 0.012 | 103168. | 142. | 555. | 25387. | -284. | -12973. | 103439. | 12271. |
| 0.030 | -1.481 | 0.020 | 102798. | 224. | 766. | 25662. | -379. | -12684. | 103185. | 12754. |
| 0.035 | -1.766 | 0.030 | 101523. | 320. | 979. | 25236. | -508. | -13096. | 101995. | 11820. |
| 0.040 | -2.033 | 0.041 | 100179. | 428. | 1222. | 25050. | -641. | -13144. | 100760. | 11479. |
| 0.045 | -2.283 | 0.055 | 99180. | 549. | 1475. | 24750. | -810. | -13596. | 99845. | 10605. |
| 0.050 | -2.516 | 0.070 | 98447. | 680. | 1742. | 24470. | -1011. | -14194. | 99179. | 9526. |
| 0.055 | -2.732 | 0.087 | 98533. | 826. | 2034. | 24314. | -1260. | -15069. | 99306. | 8419. |
| 0.060 | -2.932 | 0.105 | 99121. | 984. | 2373. | 24387. | -1546. | -15093. | 99947. | 7510. |
| 0.065 | -3.114 | 0.124 | 100123. | 1156. | 2761. | 24493. | -1908. | -16924. | 100976. | 6413. |
| 0.070 | -3.279 | 0.144 | 100949. | 1333. | 3134. | 24102. | -2428. | -18672. | 101655. | 4997. |
| 0.075 | -3.426 | 0.164 | 102021. | 1518. | 3524. | 23656. | -3078. | -20662. | 102467. | 1478. |
| 0.080 | -3.555 | 0.185 | 103540. | 1713. | 3897. | 23033. | -3924. | -23191. | 103513. | -1871. |
| 0.085 | -3.666 | 0.204 | 101452. | 1840. | 4164. | 21807. | -4692. | -24573. | 100924. | -4696. |
| 0.090 | -3.758 | 0.223 | 108344. | 2127. | 4633. | 21635. | -6314. | -29486. | 106663. | -9928. |
| 0.095 | -3.831 | 0.240 | 107674. | 2256. | 4723. | 19917. | -7673. | -32358. | 104723. | -14697. |
| 0.100 | -3.886 | 0.253 | 105594. | 2326. | 4635. | 17984. | -8922. | -34619. | 101307. | -18961. |
| 0.105 | -3.923 | 0.263 | 84301. | 1923. | 3749. | 13690. | -7927. | -28950. | 80123. | -17102. |
| 0.110 | -3.946 | 0.269 | 55464. | 1293. | 2565. | 9008. | -5457. | -19160. | 52573. | -11415. |
| 0.115 | -3.959 | 0.273 | 34037. | 804. | 1689. | 5786. | -3326. | -11397. | 32399. | -6415. |
| 0.120 | -3.968 | 0.276 | 21519. | 513. | 1177. | 3973. | -1994. | -6729. | 20702. | -3269. |
| 0.125 | -3.973 | 0.277 | 14760. | 354. | 902. | 3014. | -1248. | -4170. | 14414. | -1510. |
| 0.130 | -3.977 | 0.278 | 11146. | 268. | 755. | 2507. | -840. | -2791. | 11061. | -551. |
| 0.135 | -3.979 | 0.279 | 9225. | 222. | 677. | 2240. | -621. | -2053. | 9282. | -35. |
| 0.140 | -3.980 | 0.279 | 8266. | 199. | 633. | 2089. | -519. | -1713. | 8380. | 177. |
| 0.145 | -3.980 | 0.279 | 7990. | 193. | 622. | 2050. | -487. | -1606. | 8125. | 251. |

TABLE 12.2

BEST AVAILABLE COPY

_DUA1:LPE12.PCR.PP. X1SRQE70.CP3;1

FORCES ON CRADLE AND TRAIL/LOWER CARRIAGE ********
ORCOEF = 14.40 Q.E. = 70.00 (DEGREES)

| TIME | F14_U | F14_Z | F13_U | F13_Z | F7_Y | R2_X | R2_Y | R1_Y | M2 |
|---|---|---|---|---|---|---|---|---|---|
| 0.000 | -485. | -2127. | 5898. | 4097. | 8078. | 0. | 7961. | 1039. | 0. |
| 0.005 | 25140. | -7904. | 20321. | 14117. | 48811. | 9713. | 40176. | 7917. | 21854. |
| 0.010 | 60361. | -11218. | 29141. | 20244. | 90851. | 22130. | 73841. | 16590. | 49791. |
| 0.015 | 69362. | -14184. | 37956. | 26368. | 109216. | 25255. | 89074. | 19179. | 56023. |
| 0.020 | 69363. | -13280. | 37088. | 25765. | 108179. | 24677. | 88499. | 19043. | 55522. |
| 0.025 | 68738. | -12280. | 36045. | 25041. | 106373. | 23847. | 87322. | 18746. | 53655. |
| 0.030 | 69043. | -11409. | 35406. | 24652. | 105967. | 23306. | 87308. | 18607. | 52439. |
| 0.035 | 72304. | -9251. | 31034. | 21560. | 103705. | 23777. | 85473. | 19004. | 53498. |
| 0.040 | 73776. | -7712. | 28328. | 19679. | 101059. | 23675. | 84104. | 19175. | 53269. |
| 0.045 | 76701. | -5861. | 24407. | 16956. | 99990. | 24183. | 82550. | 19562. | 54412. |
| 0.050 | 80165. | -4057. | 20350. | 14143. | 98318. | 24903. | 81109. | 20042. | 56033. |
| 0.055 | 84541. | -2283. | 16109. | 11191. | 97313. | 26053. | 80116. | 20751. | 58619. |
| 0.060 | 88660. | -776. | 12631. | 8774. | 96972. | 27127. | 79710. | 21448. | 61035. |
| 0.065 | 93434. | 729. | 8806. | 6173. | 96917. | 28509. | 79457. | 22293. | 64145. |
| 0.070 | 100341. | 2601. | 2858. | 1986. | 95972. | 30918. | 78090. | 23506. | 69564. |
| 0.075 | 107288. | 4375. | -3470. | -2411. | 98116. | 33659. | 76633. | 24829. | 75734. |
| 0.080 | 115739. | 6178. | -10883. | -7560. | 103658. | 37161. | 74862. | 26439. | 83613. |
| 0.085 | 118779. | 7353. | -16511. | -11470. | 104822. | 38046. | 71023. | 26910. | 87405. |
| 0.090 | 135423. | 9557. | -27416. | -19046. | 116786. | 45057. | 71179. | 30309. | 103178. |
| 0.095 | 142129. | 10845. | -36062. | -25052. | 120437. | 49628. | 66477. | 31574. | 111662. |
| 0.100 | 146100. | 11713. | -43450. | -30185. | 121980. | 52466. | 61099. | 32283. | 118049. |
| 0.105 | 119563. | 9773. | -38096. | -26466. | 99574. | 43549. | 47577. | 26507. | 97906. |
| 0.110 | 78956. | 6439. | -25039. | -17395. | 66623. | 28736. | 32384. | 17774. | 64655. |
| 0.115 | 47765. | 3815. | -14023. | -9741. | 41582. | 17109. | 21834. | 11087. | 38496. |
| 0.120 | 29282. | 2246. | -7236. | -5027. | 26814. | 10153. | 15877. | 7128. | 22843. |
| 0.125 | 19228. | 1390. | -3471. | -2411. | 18802. | 6349. | 12721. | 4977. | 14285. |
| 0.130 | 13832. | 929. | -1428. | -992. | 14507. | 4301. | 11053. | 3822. | 9677. |
| 0.135 | 10957. | 684. | -331. | -230. | 12221. | 3208. | 10173. | 3207. | 7217. |
| 0.140 | 9585. | 569. | 139. | 96. | 11237. | 2700. | 9692. | 2912. | 6075. |
| 0.145 | 9171. | 534. | 298. | 207. | 11047. | 2542. | 9567. | 2824. | 5721. |

TABLE 12.3

_DUA1:LPE12.PCR.PF.RPRTJX1SRQE70.CP4;1

FORCES ON UPPER CARRIAGE ********
ORCOEF = 14.40 Q.E. = 70.00 (DEGREES) F2_X CHOSEN= 0.

| TIME | F12_X | F12_Y | F11_X | F11_Y | F9_Y | F1_X | F2_Y | F3_Y |
|---|---|---|---|---|---|---|---|---|
| 0.000 | -1833. | 1183. | 1833. | -6943. | 6943. | 0. | -916. | -267. |
| 0.005 | -16028. | -20928. | 6316. | -23924. | 23924. | 9713. | -8636. | 29564. |
| 0.010 | -31186. | -52084. | 9057. | -34307. | 34307. | 22130. | -17009. | 69093. |
| 0.015 | -37051. | -60328. | 11796. | -44686. | 44686. | 25255. | -20142. | 80470. |
| 0.020 | -36203. | -60630. | 11526. | -43663. | 43663. | 24677. | -19681. | 80319. |
| 0.025 | -35049. | -60392. | 11202. | -42436. | 42436. | 23847. | -19051. | 79443. |
| 0.030 | -34335. | -60977. | 11029. | -41778. | 41778. | 23306. | -18659. | 79636. |
| 0.035 | -33422. | -64700. | 9645. | -36537. | 36537. | 23777. | -18233. | 83012. |
| 0.040 | -32479. | -66689. | 8804. | -33350. | 33350. | 23675. | -17755. | 84444. |
| 0.045 | -31768. | -70146. | 7585. | -28734. | 28734. | 24183. | -17432. | 87578. |
| 0.050 | -31230. | -73943. | 6327. | -23967. | 23967. | 24903. | -17209. | 91152. |
| 0.055 | -31060. | -78661. | 5007. | -18966. | 18966. | 26053. | -17197. | 95859. |
| 0.060 | -31052. | -83048. | 3925. | -14870. | 14870. | 27127. | -17262. | 100310. |
| 0.065 | -31271. | -88049. | 2762. | -10461. | 10461. | 28509. | -17460. | 105509. |
| 0.070 | -31806. | -94991. | 888. | -3365. | 3365. | 30918. | -17802. | 112873. |
| 0.075 | -32581. | -102307. | -1078. | 4085. | 0. | 33659. | -21483. | 119705. |
| 0.080 | -33779. | -110873. | -3382. | 12812. | 0. | 37161. | -20796. | 126857. |
| 0.085 | -33715. | -114131. | -5131. | 19439. | 0. | 38046. | -33800. | 128492. |
| 0.090 | -37336. | -130525. | -8521. | 32277. | 0. | 45857. | -45607. | 143855. |
| 0.095 | -38420. | -137267. | -11208. | 42456. | 0. | 49628. | -53960. | 148772. |
| 0.100 | -38963. | -141295. | -13504. | 51153. | 0. | 52466. | -60882. | 151024. |
| 0.105 | -31709. | -115695. | -11040. | 44851. | 0. | 43549. | -51997. | 122841. |
| 0.110 | -20954. | -76397. | -7782. | 29479. | 0. | 28736. | -34239. | 81157. |
| 0.115 | -12751. | -46190. | -4358. | 16509. | 0. | 17109. | -19748. | 49429. |
| 0.120 | -7904. | -28284. | -2249. | 8518. | 0. | 10153. | -10937. | 30703. |
| 0.125 | -5270. | -18544. | -1079. | 4086. | 0. | 6349. | -6080. | 20538. |
| 0.130 | -3857. | -13316. | -444. | 1681. | 0. | 4301. | -3454. | 15089. |
| 0.135 | -3105. | -10530. | -103. | 390. | 0. | 3208. | -2048. | 12188. |
| 0.140 | -2743. | -9201. | 43. | -164. | 164. | 2700. | -1544. | 10746. |
| 0.145 | -2635. | -8800. | 92. | -350. | 350. | 2542. | -1480. | 10281. |

TABLE 12.4

BEST AVAILABLE COPY

_DUA1:LPE12.PCR.1r~PRTJX1M20JQE05.CP1;1

ORCOEF = 14.40 Q.E. = 5.00 (DEGREES)

| TIME | RP | FTRACK | F-FLOAT_Y | U | Z | VU | VZ | AU | AZ | |
|---|---|---|---|---|---|---|---|---|---|---|
| 0.000 | 377. | 4314. | 9327. | 0.000 | 0.000 | 0.00 | 0.00 | 0.00 | 0.00 | 0. |
| 0.005 | 42751. | 8570. | 8832. | -0.032 | 0.000 | -19.45 | 0.05 | -7831.71 | 31.62 | 0. |
| 0.010 | 70701. | 11423. | 8438. | -0.232 | 0.001 | -56.50 | 0.23 | -4673.74 | 52.77 | 0. |
| 0.015 | 92753. | 14810. | 9334. | -0.548 | 0.003 | -65.91 | 0.57 | -172.44 | 77.75 | 0. |
| 0.020 | 96723. | 15273. | 9012. | -0.875 | 0.006 | -64.56 | 0.96 | 305.54 | 80.86 | 0. |
| 0.025 | 97238. | 15700. | 9082. | -1.191 | 0.012 | -61.99 | 1.37 | 517.28 | 83.56 | 0. |
| 0.030 | 97305. | 16402. | 9488. | -1.495 | 0.020 | -59.39 | 1.80 | 519.47 | 88.15 | 0. |
| 0.035 | 95308. | 15741. | 8503. | -1.784 | 0.030 | -56.22 | 2.22 | 676.50 | 82.53 | 0. |
| 0.040 | 92101. | 15724. | 8593. | -2.057 | 0.042 | -52.89 | 2.63 | 653.94 | 81.63 | 0. |
| 0.045 | 88611. | 15378. | 8270. | -2.313 | 0.057 | -49.68 | 3.03 | 629.16 | 78.24 | 0. |
| 0.050 | 84895. | 15084. | 8054. | -2.554 | 0.073 | -46.60 | 3.41 | 602.78 | 75.21 | 0. |
| 0.055 | 81010. | 15085. | 8202. | -2.779 | 0.091 | -43.66 | 3.78 | 575.39 | 74.36 | 0. |
| 0.060 | 81078. | 15559. | 8257. | -2.991 | 0.110 | -40.78 | 4.16 | 577.93 | 76.67 | 0. |
| 0.065 | 81068. | 15853. | 8097. | -3.187 | 0.132 | -37.89 | 4.54 | 580.14 | 77.52 | 0. |
| 0.070 | 79718. | 15630. | 7573. | -3.369 | 0.156 | -34.89 | 4.92 | 604.36 | 74.53 | 0. |
| 0.075 | 77249. | 15607. | 7512. | -3.536 | 0.181 | -31.90 | 5.29 | 580.85 | 73.59 | 0. |
| 0.080 | 79221. | 16671. | 7623. | -3.688 | 0.209 | -28.92 | 5.67 | 608.24 | 78.61 | 0. |
| 0.085 | 79926. | 17501. | 7673. | -3.825 | 0.238 | -25.84 | 6.07 | 619.36 | 82.15 | 0. |
| 0.090 | 78400. | 18040. | 7686. | -3.947 | 0.270 | -22.75 | 6.49 | 615.02 | 83.25 | 0. |
| 0.095 | 74481. | 18232. | 7636. | -4.053 | 0.303 | -19.72 | 6.90 | 593.83 | 81.43 | 0. |
| 0.100 | 68717. | 17632. | 7044. | -4.144 | 0.339 | -16.84 | 7.28 | 558.23 | 73.49 | 0. |
| 0.105 | 9674. | 123. | 2205. | -4.223 | 0.376 | -15.09 | 7.42 | 60.16 | -33.51 | 0. |
| 0.110 | 9079. | 392. | 2506. | -4.297 | 0.412 | -14.77 | 7.26 | 64.63 | -31.77 | 0. |
| 0.115 | 9113. | 402. | 2465. | -4.370 | 0.448 | -14.45 | 7.10 | 64.90 | -31.90 | 0. |
| 0.120 | 9145. | 411. | 2424. | -4.442 | 0.483 | -14.12 | 6.94 | 65.16 | -32.03 | 0. |
| 0.125 | 9178. | 420. | 2384. | -4.511 | 0.518 | -13.79 | 6.78 | 65.42 | -32.16 | 0. |
| 0.130 | 9208. | 428. | 2345. | -4.580 | 0.551 | -13.47 | 6.62 | 65.67 | -32.28 | 0. |
| 0.135 | 9238. | 437. | 2308. | -4.646 | 0.584 | -13.14 | 6.46 | 65.91 | -32.40 | 0. |
| 0.140 | 9267. | 370. | 2208. | -4.711 | 0.616 | -12.80 | 6.29 | 67.17 | -33.02 | 0. |
| 0.145 | 9294. | 378. | 2173. | -4.774 | 0.647 | -12.47 | 6.13 | 67.39 | -33.13 | 0. |
| 0.150 | 9320. | 386. | 2140. | -4.836 | 0.677 | -12.13 | 5.96 | 67.61 | -33.23 | 0. |
| 0.155 | 9344. | 395. | 2108. | -4.895 | 0.706 | -11.79 | 5.80 | 67.80 | -33.33 | 0. |
| 0.160 | 9369. | 403. | 2076. | -4.954 | 0.735 | -11.45 | 5.63 | 68.00 | -33.43 | 0. |
| 0.165 | 9391. | 411. | 2047. | -5.010 | 0.763 | -11.11 | 5.46 | 68.19 | -33.52 | 0. |
| 0.170 | 9412. | 419. | 2018. | -5.065 | 0.790 | -10.77 | 5.29 | 68.36 | -33.61 | 0. |
| 0.175 | 9433. | 426. | 1990. | -5.118 | 0.816 | -10.43 | 5.13 | 68.53 | -33.69 | 0. |
| 0.180 | 9451. | 434. | 1965. | -5.169 | 0.841 | -10.08 | 4.96 | 68.69 | -33.77 | 0. |
| 0.185 | 9471. | 440. | 1938. | -5.219 | 0.865 | -9.74 | 4.79 | 68.85 | -33.85 | 0. |
| 0.190 | 9489. | 448. | 1914. | -5.266 | 0.889 | -9.40 | 4.62 | 68.99 | -33.92 | 0. |
| 0.195 | 9505. | 456. | 1892. | -5.313 | 0.911 | -9.05 | 4.45 | 69.12 | -33.98 | 0. |
| 0.200 | 9520. | 462. | 1869. | -5.357 | 0.933 | -8.71 | 4.28 | 69.26 | -34.05 | 0. |
| 0.205 | 9532. | 469. | 1850. | -5.400 | 0.954 | -8.36 | 4.11 | 69.37 | -34.10 | 0. |
| 0.210 | 9545. | 477. | 1831. | -5.440 | 0.974 | -8.01 | 3.94 | 69.47 | -34.15 | 0. |
| 0.215 | 9555. | 484. | 1813. | -5.480 | 0.994 | -7.66 | 3.77 | 69.57 | -34.20 | 0. |
| 0.220 | 9563. | 491. | 1797. | -5.517 | 1.012 | -7.32 | 3.60 | 69.64 | -34.24 | 0. |
| 0.225 | 9569. | 499. | 1783. | -5.553 | 1.030 | -6.97 | 3.43 | 69.70 | -34.27 | 0. |
| 0.230 | 9571. | 507. | 1771. | -5.587 | 1.046 | -6.62 | 3.25 | 69.75 | -34.29 | 0. |
| 0.235 | 9574. | 515. | 1760. | -5.619 | 1.062 | -6.27 | 3.08 | 69.79 | -34.31 | 0. |
| 0.240 | 9572. | 524. | 1752. | -5.649 | 1.077 | -5.92 | 2.91 | 69.80 | -34.31 | 0. |
| 0.245 | 9568. | 534. | 1746. | -5.678 | 1.091 | -5.57 | 2.74 | 69.79 | -34.31 | 0. |
| 0.250 | 9561. | 544. | 1742. | -5.705 | 1.104 | -5.22 | 2.57 | 69.77 | -34.30 | 0. |
| 0.255 | 9547. | 555. | 1742. | -5.730 | 1.117 | -4.87 | 2.40 | 69.70 | -34.26 | 0. |
| 0.260 | 9534. | 566. | 1743. | -5.754 | 1.128 | -4.53 | 2.22 | 69.64 | -34.23 | 0. |
| 0.265 | 9513. | 580. | 1748. | -5.776 | 1.139 | -4.18 | 2.05 | 69.52 | -34.18 | 0. |
| 0.270 | 9485. | 596. | 1758. | -5.796 | 1.149 | -3.83 | 1.88 | 69.36 | -34.10 | 0. |
| 0.275 | 9457. | 610. | 1768. | -5.814 | 1.158 | -3.48 | 1.71 | 69.20 | -34.02 | 0. |
| 0.280 | 9419. | 629. | 1785. | -5.831 | 1.166 | -3.14 | 1.54 | 68.97 | -33.91 | 0. |
| 0.285 | 9372. | 649. | 1806. | -5.845 | 1.173 | -2.79 | 1.37 | 68.70 | -33.77 | 0. |
| 0.290 | 9325. | 670. | 1829. | -5.859 | 1.180 | -2.45 | 1.21 | 68.41 | -33.63 | 0. |
| 0.295 | 9269. | 694. | 1858. | -5.870 | 1.185 | -2.11 | 1.04 | 68.06 | -33.46 | 0. |
| 0.300 | 9207. | 718. | 1889. | -5.880 | 1.190 | -1.77 | 0.87 | 67.69 | -33.27 | 0. |
| 0.305 | 9143. | 743. | 1923. | -5.888 | 1.194 | -1.43 | 0.70 | 67.29 | -33.08 | 0. |
| 0.310 | 9085. | 765. | 1953. | -5.894 | 1.197 | -1.10 | 0.54 | 66.94 | -32.91 | 0. |
| 0.315 | 9034. | 785. | 1980. | -5.899 | 1.200 | -0.76 | 0.38 | 66.63 | -32.75 | 0. |
| 0.320 | 8997. | 800. | 2001. | -5.902 | 1.201 | -0.43 | 0.21 | 66.39 | -32.64 | 0. |
| 0.325 | 8979. | 806. | 2010. | -5.903 | 1.202 | -0.10 | 0.05 | 66.29 | -32.59 | 0. |

TABLE 13

_DUA1:[PEI2.FCR.--]FKTJX1M203QE20.CP1;1

ORCOEF = 15.00 Q.E. = 20.00 (DEGREES)

| TIME | HP | FTRACK | F-FLOAT_Y | U | Z | VU | VZ | AU | AZ | |
|---|---|---|---|---|---|---|---|---|---|---|
| 0.000 | 1481. | 4069. | 9209. | 0.000 | 0.000 | 0.00 | 0.00 | 0.00 | 0.00 | 0. |
| 0.005 | 44274. | 8319. | 18267. | -0.032 | 0.000 | -19.47 | 0.05 | -7028.60 | 31.58 | 0. |
| 0.010 | 73339. | 11170. | 24253. | -0.232 | 0.001 | -56.48 | 0.23 | -4662.35 | 52.71 | 0. |
| 0.015 | 96095. | 14518. | 30143. | -0.548 | 0.003 | -65.82 | 0.57 | -155.83 | 77.40 | 0. |
| 0.020 | 99953. | 14929. | 30665. | -0.874 | 0.006 | -64.39 | 0.96 | 401.29 | 80.11 | 0. |
| 0.025 | 100206. | 15310. | 30805. | -1.189 | 0.012 | -61.74 | 1.36 | 531.06 | 82.45 | 0. |
| 0.030 | 100078. | 15952. | 31191. | -1.491 | 0.020 | -59.08 | 1.78 | 531.17 | 86.59 | 0. |
| 0.035 | 97660. | 15244. | 29766. | -1.779 | 0.030 | -55.85 | 2.19 | 685.68 | 80.62 | 0. |
| 0.040 | 94104. | 15140. | 28969. | -2.050 | 0.042 | -52.49 | 2.60 | 660.37 | 79.07 | 0. |
| 0.045 | 90293. | 14823. | 27913. | -2.304 | 0.056 | -49.25 | 2.98 | 633.16 | 75.91 | 0. |
| 0.050 | 86289. | 14451. | 26796. | -2.543 | 0.072 | -46.16 | 3.35 | 604.52 | 72.32 | 0. |
| 0.055 | 82151. | 14295. | 25932. | -2.766 | 0.089 | -43.21 | 3.71 | 575.07 | 70.33 | 0. |
| 0.060 | 81684. | 14688. | 25950. | -2.975 | 0.109 | -40.35 | 4.06 | 573.45 | 72.10 | 0. |
| 0.065 | 81475. | 14989. | 25869. | -3.169 | 0.130 | -37.48 | 4.43 | 574.01 | 73.06 | 0. |
| 0.070 | 79940. | 14749. | 25092. | -3.349 | 0.153 | -34.52 | 4.78 | 596.62 | 70.01 | 0. |
| 0.075 | 77322. | 14622. | 24373. | -3.515 | 0.178 | -31.57 | 5.13 | 579.53 | 67.81 | 0. |
| 0.080 | 78275. | 15262. | 24677. | -3.665 | 0.204 | -28.67 | 5.47 | 590.44 | 70.60 | 0. |
| 0.085 | 78893. | 16011. | 25022. | -3.801 | 0.233 | -25.68 | 5.83 | 600.09 | 73.81 | 0. |
| 0.090 | 77444. | 16441. | 24854. | -3.922 | 0.263 | -22.69 | 6.21 | 595.19 | 74.48 | 0. |
| 0.095 | 73795. | 16349. | 23966. | -4.028 | 0.295 | -19.76 | 6.57 | 574.15 | 71.15 | 0. |
| 0.100 | 68133. | 15936. | 22595. | -4.120 | 0.328 | -16.97 | 6.91 | 538.37 | 65.26 | 0. |
| 0.105 | 28953. | 13071. | 18423. | -4.198 | 0.364 | -14.62 | 7.18 | 248.15 | 55.65 | 0. |
| 0.110 | 9026. | 673. | 4847. | -4.270 | 0.399 | -14.26 | 7.01 | 56.95 | -28.00 | 0. |
| 0.115 | 9061. | 681. | 4813. | -4.341 | 0.434 | -13.98 | 6.87 | 57.23 | -28.13 | 0. |
| 0.120 | 9094. | 689. | 4779. | -4.410 | 0.468 | -13.69 | 6.73 | 57.49 | -28.26 | 0. |
| 0.125 | 9127. | 697. | 4746. | -4.478 | 0.501 | -13.40 | 6.59 | 57.76 | -28.39 | 0. |
| 0.130 | 9159. | 704. | 4714. | -4.544 | 0.534 | -13.11 | 6.45 | 58.02 | -28.52 | 0. |
| 0.135 | 9189. | 712. | 4683. | -4.609 | 0.566 | -12.82 | 6.30 | 58.26 | -28.64 | 0. |
| 0.140 | 9220. | 644. | 4580. | -4.672 | 0.597 | -12.53 | 6.16 | 59.53 | -29.26 | 0. |
| 0.145 | 9248. | 651. | 4551. | -4.734 | 0.627 | -12.23 | 6.01 | 59.76 | -29.37 | 0. |
| 0.150 | 9277. | 658. | 4523. | -4.795 | 0.657 | -11.93 | 5.86 | 59.98 | -29.49 | 0. |
| 0.155 | 9304. | 665. | 4495. | -4.854 | 0.686 | -11.63 | 5.72 | 60.20 | -29.59 | 0. |
| 0.160 | 9329. | 673. | 4468. | -4.911 | 0.714 | -11.33 | 5.57 | 60.40 | -29.69 | 0. |
| 0.165 | 9356. | 679. | 4442. | -4.967 | 0.741 | -11.02 | 5.42 | 60.61 | -29.80 | 0. |
| 0.170 | 9380. | 686. | 4417. | -5.021 | 0.768 | -10.72 | 5.27 | 60.80 | -29.89 | 0. |
| 0.175 | 9404. | 692. | 4392. | -5.074 | 0.794 | -10.42 | 5.12 | 60.99 | -29.98 | 0. |
| 0.180 | 9427. | 698. | 4368. | -5.125 | 0.819 | -10.11 | 4.97 | 61.18 | -30.07 | 0. |
| 0.185 | 9447. | 704. | 4345. | -5.175 | 0.844 | -9.81 | 4.82 | 61.35 | -30.16 | 0. |
| 0.190 | 9471. | 710. | 4323. | -5.224 | 0.868 | -9.50 | 4.67 | 61.53 | -30.25 | 0. |
| 0.195 | 9492. | 715. | 4301. | -5.270 | 0.891 | -9.19 | 4.52 | 61.69 | -30.33 | 0. |
| 0.200 | 9512. | 720. | 4280. | -5.315 | 0.913 | -8.88 | 4.37 | 61.85 | -30.41 | 0. |
| 0.205 | 9532. | 725. | 4260. | -5.359 | 0.934 | -8.57 | 4.21 | 62.01 | -30.48 | 0. |
| 0.210 | 9550. | 732. | 4242. | -5.401 | 0.955 | -8.26 | 4.06 | 62.14 | -30.55 | 0. |
| 0.215 | 9569. | 735. | 4222. | -5.442 | 0.975 | -7.95 | 3.91 | 62.30 | -30.63 | 0. |
| 0.220 | 9584. | 740. | 4204. | -5.481 | 0.994 | -7.64 | 3.75 | 62.43 | -30.69 | 0. |
| 0.225 | 9600. | 745. | 4188. | -5.518 | 1.012 | -7.33 | 3.60 | 62.54 | -30.75 | 0. |
| 0.230 | 9615. | 749. | 4171. | -5.554 | 1.030 | -7.01 | 3.45 | 62.67 | -30.81 | 0. |
| 0.235 | 9625. | 755. | 4158. | -5.588 | 1.047 | -6.70 | 3.29 | 62.76 | -30.85 | 0. |
| 0.240 | 9639. | 759. | 4143. | -5.621 | 1.063 | -6.38 | 3.14 | 62.87 | -30.91 | 0. |
| 0.245 | 9649. | 764. | 4130. | -5.652 | 1.078 | -6.07 | 2.98 | 62.95 | -30.95 | 0. |
| 0.250 | 9658. | 769. | 4118. | -5.682 | 1.093 | -5.76 | 2.83 | 63.03 | -30.98 | 0. |
| 0.255 | 9665. | 774. | 4107. | -5.710 | 1.107 | -5.44 | 2.67 | 63.10 | -31.02 | 0. |
| 0.260 | 9667. | 780. | 4098. | -5.736 | 1.120 | -5.12 | 2.52 | 63.13 | -31.04 | 0. |
| 0.265 | 9674. | 785. | 4089. | -5.761 | 1.132 | -4.81 | 2.36 | 63.19 | -31.06 | 0. |
| 0.270 | 9673. | 792. | 4083. | -5.784 | 1.143 | -4.49 | 2.21 | 63.19 | -31.07 | 0. |
| 0.275 | 9671. | 798. | 4077. | -5.806 | 1.154 | -4.18 | 2.05 | 63.20 | -31.07 | 0. |
| 0.280 | 9667. | 805. | 4073. | -5.826 | 1.164 | -3.86 | 1.90 | 63.19 | -31.06 | 0. |
| 0.285 | 9652. | 815. | 4073. | -5.844 | 1.173 | -3.54 | 1.74 | 63.11 | -31.02 | 0. |
| 0.290 | 9643. | 823. | 4072. | -5.861 | 1.181 | -3.23 | 1.59 | 63.06 | -31.00 | 0. |
| 0.295 | 9624. | 836. | 4076. | -5.877 | 1.189 | -2.91 | 1.43 | 62.93 | -30.94 | 0. |
| 0.300 | 9589. | 850. | 4083. | -5.890 | 1.195 | -2.60 | 1.28 | 62.75 | -30.85 | 0. |
| 0.305 | 9550. | 865. | 4092. | -5.903 | 1.201 | -2.29 | 1.12 | 62.56 | -30.75 | 0. |
| 0.310 | 9505. | 886. | 4100. | -5.913 | 1.207 | -1.97 | 0.97 | 62.24 | -30.60 | 0. |
| 0.315 | 9438. | 913. | 4131. | -5.922 | 1.211 | -1.66 | 0.82 | 61.83 | -30.39 | 0. |
| 0.320 | 9366. | 941. | 4156. | -5.930 | 1.215 | -1.36 | 0.67 | 61.38 | -30.17 | 0. |
| 0.325 | 9269. | 977. | 4191. | -5.936 | 1.218 | -1.05 | 0.52 | 60.79 | -29.88 | 0. |
| 0.330 | 9161. | 1017. | 4230. | -5.940 | 1.220 | -0.75 | 0.37 | 60.12 | -29.55 | 0. |
| 0.335 | 9066. | 1052. | 4265. | -5.943 | 1.222 | -0.45 | 0.22 | 59.53 | -29.26 | 0. |
| 0.340 | 9008. | 1073. | 4286. | -5.945 | 1.222 | -0.15 | 0.08 | 59.17 | -29.09 | 0. |

TABLE 14

BEST AVAILABLE COPY

_DUA1:[FE12.PCR.PF.RPRTJX1P1MPQE00.CF1;1

ORCOEF = 14.40 Q.E. = 0.00 (DEGREES)

| TIME | RP | FTRACK | F-FLOAT_Y | U | Z | VU | VZ | AU | AZ | |
|---|---|---|---|---|---|---|---|---|---|---|
| 0.000 | 0. | 4330. | 9335. | 0.000 | 0.000 | 0.00 | 0.00 | 0.00 | 0.00 | 0. |
| 0.005 | 62799. | 10019. | 3133. | -0.034 | 0.000 | -24.66 | 0.07 | -10074.72 | 42.26 | 0. |
| 0.010 | 84048. | 13064. | 2251. | -0.272 | 0.001 | -63.31 | 0.29 | -4125.08 | 64.82 | 0. |
| 0.015 | 99420. | 15273. | 1392. | -0.607 | 0.003 | -67.89 | 0.66 | 232.06 | 81.01 | 0. |
| 0.020 | 102061. | 16259. | 1469. | -0.942 | 0.008 | -66.11 | 1.08 | 403.99 | 87.94 | 0. |
| 0.025 | 103394. | 16565. | 1295. | -1.266 | 0.014 | -63.38 | 1.52 | 556.98 | 89.65 | 0. |
| 0.030 | 102480. | 16765. | 1271. | -1.575 | 0.023 | -60.32 | 1.97 | 650.63 | 90.44 | 0. |
| 0.035 | 100192. | 16696. | 1210. | -1.869 | 0.034 | -57.00 | 2.42 | 706.83 | 89.11 | 0. |
| 0.040 | 96669. | 16465. | 1230. | -2.145 | 0.047 | -53.53 | 2.86 | 681.91 | 86.53 | 0. |
| 0.045 | 92842. | 16072. | 1142. | -2.404 | 0.062 | -50.19 | 3.28 | 654.75 | 82.69 | 0. |
| 0.050 | 88775. | 15769. | 1223. | -2.647 | 0.080 | -46.99 | 3.69 | 625.89 | 79.50 | 0. |
| 0.055 | 85602. | 15493. | 1146. | -2.874 | 0.099 | -43.78 | 4.07 | 644.33 | 76.42 | 0. |
| 0.060 | 85492. | 15966. | 1162. | -3.085 | 0.120 | -40.56 | 4.46 | 645.80 | 78.50 | 0. |
| 0.065 | 84375. | 16124. | 1045. | -3.280 | 0.144 | -37.34 | 4.86 | 639.96 | 78.35 | 0. |
| 0.070 | 82219. | 16217. | 1075. | -3.459 | 0.169 | -34.17 | 5.25 | 626.79 | 77.58 | 0. |
| 0.075 | 81975. | 16885. | 1195. | -3.622 | 0.196 | -31.06 | 5.64 | 629.06 | 80.61 | 0. |
| 0.080 | 83684. | 18023. | 1202. | -3.769 | 0.225 | -27.86 | 6.05 | 647.75 | 86.36 | 0. |
| 0.085 | 83104. | 18653. | 1112. | -3.900 | 0.257 | -24.61 | 6.49 | 650.33 | 88.05 | 0. |
| 0.090 | 79907. | 18913. | 1154. | -4.015 | 0.290 | -21.39 | 6.93 | 634.50 | 86.68 | 0. |
| 0.095 | 74138. | 18531. | 1093. | -4.114 | 0.326 | -18.29 | 7.35 | 599.61 | 80.26 | 0. |
| 0.100 | 30691. | 15996. | 9056. | -4.199 | 0.364 | -15.65 | 7.69 | 278.01 | 67.47 | 0. |
| 0.105 | 9117. | 279. | 1739. | -4.276 | 0.402 | -15.24 | 7.49 | 66.32 | -32.60 | 0. |
| 0.110 | 9153. | 288. | 1693. | -4.351 | 0.439 | -14.91 | 7.33 | 66.61 | -32.74 | 0. |
| 0.115 | 9187. | 297. | 1648. | -4.425 | 0.475 | -14.58 | 7.17 | 66.89 | -32.88 | 0. |
| 0.120 | 9222. | 306. | 1604. | -4.497 | 0.510 | -14.24 | 7.00 | 67.16 | -33.02 | 0. |
| 0.125 | 9255. | 315. | 1562. | -4.567 | 0.545 | -13.91 | 6.84 | 67.42 | -33.14 | 0. |
| 0.130 | 9287. | 323. | 1520. | -4.636 | 0.579 | -13.57 | 6.67 | 67.68 | -33.27 | 0. |
| 0.135 | 9318. | 332. | 1480. | -4.703 | 0.612 | -13.23 | 6.50 | 67.93 | -33.39 | 0. |
| 0.140 | 9348. | 340. | 1441. | -4.768 | 0.644 | -12.89 | 6.34 | 68.18 | -33.51 | 0. |
| 0.145 | 9378. | 348. | 1403. | -4.832 | 0.675 | -12.55 | 6.17 | 68.41 | -33.63 | 0. |
| 0.150 | 9405. | 355. | 1366. | -4.894 | 0.705 | -12.20 | 6.00 | 68.64 | -33.74 | 0. |
| 0.155 | 9433. | 362. | 1330. | -4.954 | 0.735 | -11.86 | 5.83 | 68.86 | -33.85 | 0. |
| 0.160 | 9459. | 370. | 1296. | -5.012 | 0.764 | -11.52 | 5.66 | 69.07 | -33.95 | 0. |
| 0.165 | 9484. | 377. | 1263. | -5.069 | 0.792 | -11.17 | 5.49 | 69.27 | -34.05 | 0. |
| 0.170 | 9509. | 384. | 1231. | -5.124 | 0.819 | -10.82 | 5.32 | 69.46 | -34.15 | 0. |
| 0.175 | 9530. | 255. | 1097. | -5.177 | 0.845 | -10.47 | 5.15 | 71.49 | -35.14 | 0. |
| 0.180 | 9554. | 261. | 1067. | -5.229 | 0.870 | -10.11 | 4.97 | 71.67 | -35.23 | 0. |
| 0.185 | 9574. | 267. | 1039. | -5.278 | 0.895 | -9.75 | 4.79 | 71.84 | -35.32 | 0. |
| 0.190 | 9594. | 274. | 1013. | -5.326 | 0.918 | -9.39 | 4.62 | 71.99 | -35.39 | 0. |
| 0.195 | 9613. | 280. | 987. | -5.372 | 0.941 | -9.03 | 4.44 | 72.15 | -35.47 | 0. |
| 0.200 | 9630. | 286. | 964. | -5.416 | 0.962 | -8.67 | 4.26 | 72.29 | -35.54 | 0. |
| 0.205 | 9647. | 292. | 941. | -5.459 | 0.983 | -8.31 | 4.08 | 72.43 | -35.60 | 0. |
| 0.210 | 9659. | 299. | 921. | -5.499 | 1.003 | -7.95 | 3.91 | 72.53 | -35.66 | 0. |
| 0.215 | 9674. | 305. | 901. | -5.538 | 1.022 | -7.58 | 3.73 | 72.65 | -35.71 | 0. |
| 0.220 | 9684. | 310. | 883. | -5.575 | 1.041 | -7.22 | 3.55 | 72.75 | -35.76 | 0. |
| 0.225 | 9694. | 317. | 867. | -5.611 | 1.058 | -6.86 | 3.37 | 72.83 | -35.80 | 0. |
| 0.230 | 9701. | 324. | 853. | -5.644 | 1.074 | -6.49 | 3.19 | 72.90 | -35.83 | 0. |
| 0.235 | 9705. | 331. | 840. | -5.675 | 1.090 | -6.13 | 3.01 | 72.95 | -35.86 | 0. |
| 0.240 | 9710. | 338. | 829. | -5.705 | 1.104 | -5.76 | 2.83 | 73.00 | -35.88 | 0. |
| 0.245 | 9706. | 347. | 824. | -5.733 | 1.118 | -5.40 | 2.65 | 72.99 | -35.88 | 0. |
| 0.250 | 9706. | 354. | 816. | -5.759 | 1.131 | -5.03 | 2.47 | 73.01 | -35.89 | 0. |
| 0.255 | 9697. | 364. | 814. | -5.783 | 1.143 | -4.67 | 2.29 | 72.97 | -35.87 | 0. |
| 0.260 | 9685. | 374. | 814. | -5.806 | 1.154 | -4.30 | 2.11 | 72.92 | -35.85 | 0. |
| 0.265 | 9669. | 385. | 818. | -5.826 | 1.164 | -3.94 | 1.94 | 72.84 | -35.81 | 0. |
| 0.270 | 9639. | 402. | 831. | -5.845 | 1.173 | -3.57 | 1.76 | 72.65 | -35.72 | 0. |
| 0.275 | 9614. | 415. | 842. | -5.862 | 1.182 | -3.21 | 1.58 | 72.52 | -35.65 | 0. |
| 0.280 | 9572. | 434. | 863. | -5.877 | 1.189 | -2.85 | 1.40 | 72.26 | -35.52 | 0. |
| 0.285 | 9516. | 458. | 894. | -5.891 | 1.196 | -2.49 | 1.22 | 71.93 | -35.36 | 0. |
| 0.290 | 9457. | 481. | 926. | -5.902 | 1.201 | -2.13 | 1.05 | 71.57 | -35.18 | 0. |
| 0.295 | 9377. | 513. | 973. | -5.912 | 1.206 | -1.77 | 0.87 | 71.07 | -34.94 | 0. |
| 0.300 | 9280. | 551. | 1031. | -5.920 | 1.210 | -1.42 | 0.70 | 70.47 | -34.64 | 0. |
| 0.305 | 9180. | 585. | 1085. | -5.926 | 1.213 | -1.07 | 0.53 | 69.91 | -34.37 | 0. |
| 0.310 | 9096. | 619. | 1141. | -5.931 | 1.215 | -0.72 | 0.35 | 69.34 | -34.08 | 0. |
| 0.315 | 9025. | 645. | 1184. | -5.933 | 1.217 | -0.37 | 0.18 | 68.89 | -33.87 | 0. |
| 0.320 | 8995. | 656. | 1202. | -5.934 | 1.217 | -0.03 | 0.02 | 68.71 | -33.78 | 0. |

TABLE 15

BEST AVAILABLE COPY

_DUA1:[PEI2.PCR.__RPRTJX1M119QE00.CF1;1

DRCOEF = 14.40  Q.E. = 0.00 (DEGREES)

| TIME | RP | FTRACK | F-FLOAT_Y | U | Z | VU | VZ | AU | AZ | |
|---|---|---|---|---|---|---|---|---|---|---|
| 0.000 | 0. | 4330. | 9335. | 0.000 | 0.000 | 0.00 | 0.00 | 0.00 | 0.00 | 0 |
| 0.005 | 25192. | 6696. | 6950. | -0.022 | 0.000 | -11.33 | 0.02 | -4656.81 | 17.50 | 0 |
| 0.010 | 44619. | 8685. | 5257. | -0.153 | 0.000 | -40.27 | 0.14 | -5433.62 | 32.34 | 0 |
| 0.015 | 59141. | 10578. | 4381. | -0.391 | 0.002 | -52.60 | 0.32 | -1298.65 | 46.34 | 0 |
| 0.020 | 63456. | 11187. | 4022. | -0.656 | 0.004 | -52.84 | 0.56 | 100.85 | 50.73 | 0 |
| 0.025 | 64835. | 11403. | 3878. | -0.917 | 0.007 | -51.62 | 0.81 | 257.10 | 52.73 | 0 |
| 0.030 | 64434. | 11389. | 3631. | -1.170 | 0.012 | -49.66 | 1.07 | 399.56 | 51.70 | 0 |
| 0.035 | 63771. | 11539. | 3722. | -1.414 | 0.018 | -47.67 | 1.33 | 395.19 | 52.59 | 0 |
| 0.040 | 62947. | 11635. | 3773. | -1.647 | 0.025 | -45.71 | 1.60 | 389.71 | 52.95 | 0 |
| 0.045 | 61972. | 11846. | 3980. | -1.871 | 0.034 | -43.70 | 1.86 | 383.18 | 54.12 | 0 |
| 0.050 | 60036. | 11235. | 3462. | -2.084 | 0.044 | -41.57 | 2.11 | 439.45 | 49.18 | 0 |
| 0.055 | 57945. | 10987. | 3400. | -2.287 | 0.055 | -39.41 | 2.35 | 424.54 | 46.93 | 0 |
| 0.060 | 55775. | 10706. | 3327. | -2.478 | 0.067 | -37.32 | 2.58 | 409.04 | 44.42 | 0 |
| 0.065 | 53547. | 10451. | 3307. | -2.660 | 0.081 | -35.32 | 2.80 | 393.13 | 42.10 | 0 |
| 0.070 | 51571. | 10431. | 3495. | -2.832 | 0.095 | -33.39 | 3.01 | 379.26 | 41.52 | 0 |
| 0.075 | 51475. | 10610. | 3467. | -2.994 | 0.111 | -31.49 | 3.22 | 379.60 | 42.25 | 0 |
| 0.080 | 51048. | 10701. | 3411. | -3.147 | 0.127 | -29.60 | 3.43 | 377.56 | 42.31 | 0 |
| 0.085 | 50135. | 10502. | 3159. | -3.290 | 0.145 | -27.67 | 3.63 | 382.37 | 40.24 | 0 |
| 0.090 | 48873. | 10378. | 3065. | -3.423 | 0.164 | -25.78 | 3.83 | 374.17 | 38.71 | 0 |
| 0.095 | 47292. | 10254. | 3045. | -3.548 | 0.183 | -23.94 | 4.02 | 363.70 | 37.18 | 0 |
| 0.100 | 47874. | 10517. | 2887. | -3.663 | 0.204 | -22.10 | 4.21 | 370.02 | 38.15 | 0 |
| 0.105 | 47888. | 10702. | 2755. | -3.769 | 0.225 | -20.24 | 4.40 | 372.37 | 38.48 | 0 |
| 0.110 | 47189. | 10793. | 2670. | -3.865 | 0.248 | -18.39 | 4.59 | 369.71 | 38.05 | 0 |
| 0.115 | 45743. | 10622. | 2486. | -3.953 | 0.271 | -16.56 | 4.77 | 361.38 | 35.68 | 0 |
| 0.120 | 43574. | 10265. | 2287. | -4.031 | 0.296 | -14.78 | 4.94 | 347.60 | 31.94 | 0 |
| 0.125 | 40777. | 9820. | 2150. | -4.101 | 0.321 | -13.09 | 5.09 | 329.07 | 27.53 | 0 |
| 0.130 | 37190. | 8579. | 1536. | -4.162 | 0.346 | -11.50 | 5.21 | 302.26 | 17.76 | 0 |
| 0.135 | 9356. | 38. | 1514. | -4.216 | 0.373 | -10.53 | 5.18 | 69.38 | -34.11 | 0. |
| 0.140 | 8573. | 376. | 1968. | -4.268 | 0.398 | -10.21 | 5.02 | 64.68 | -31.79 | 0. |
| 0.145 | 8583. | 380. | 1947. | -4.318 | 0.423 | -9.88 | 4.86 | 64.78 | -31.84 | 0. |
| 0.150 | 8592. | 399. | 1927. | -4.367 | 0.447 | -9.56 | 4.70 | 64.86 | -31.89 | 0. |
| 0.155 | 8599. | 410. | 1907. | -4.414 | 0.470 | -9.23 | 4.54 | 64.96 | -31.93 | 0. |
| 0.160 | 8605. | 421. | 1890. | -4.459 | 0.492 | -8.91 | 4.38 | 65.03 | -31.97 | 0. |
| 0.165 | 8610. | 431. | 1873. | -4.503 | 0.514 | -8.58 | 4.22 | 65.11 | -32.01 | 0. |
| 0.170 | 8614. | 442. | 1857. | -4.545 | 0.534 | -8.26 | 4.06 | 65.16 | -32.03 | 0. |
| 0.175 | 8617. | 453. | 1843. | -4.586 | 0.554 | -7.93 | 3.90 | 65.21 | -32.06 | 0. |
| 0.180 | 8619. | 463. | 1830. | -4.625 | 0.573 | -7.61 | 3.74 | 65.26 | -32.08 | 0. |
| 0.185 | 8620. | 473. | 1818. | -4.662 | 0.592 | -7.28 | 3.58 | 65.30 | -32.10 | 0. |
| 0.190 | 8620. | 483. | 1807. | -4.697 | 0.609 | -6.95 | 3.42 | 65.33 | -32.11 | 0. |
| 0.195 | 8619. | 493. | 1797. | -4.731 | 0.626 | -6.63 | 3.26 | 65.35 | -32.12 | 0. |
| 0.200 | 8618. | 503. | 1788. | -4.764 | 0.642 | -6.30 | 3.10 | 65.36 | -32.13 | 0. |
| 0.205 | 8615. | 513. | 1781. | -4.794 | 0.657 | -5.97 | 2.94 | 65.37 | -32.14 | 0. |
| 0.210 | 8612. | 521. | 1773. | -4.823 | 0.671 | -5.65 | 2.78 | 65.38 | -32.14 | 0. |
| 0.215 | 8609. | 531. | 1767. | -4.851 | 0.684 | -5.32 | 2.62 | 65.38 | -32.14 | 0. |
| 0.220 | 8605. | 540. | 1762. | -4.877 | 0.697 | -4.99 | 2.45 | 65.37 | -32.14 | 0. |
| 0.225 | 8600. | 548. | 1757. | -4.901 | 0.709 | -4.67 | 2.29 | 65.37 | -32.13 | 0. |
| 0.230 | 8595. | 556. | 1754. | -4.923 | 0.720 | -4.34 | 2.13 | 65.35 | -32.13 | 0. |
| 0.235 | 8590. | 564. | 1751. | -4.944 | 0.730 | -4.01 | 1.97 | 65.33 | -32.12 | 0. |
| 0.240 | 8585. | 571. | 1748. | -4.963 | 0.740 | -3.69 | 1.81 | 65.32 | -32.11 | 0. |
| 0.245 | 8579. | 578. | 1746. | -4.981 | 0.748 | -3.36 | 1.65 | 65.30 | -32.10 | 0. |
| 0.250 | 8574. | 584. | 1744. | -4.997 | 0.756 | -3.03 | 1.49 | 65.28 | -32.09 | 0. |
| 0.255 | 8569. | 590. | 1743. | -5.011 | 0.763 | -2.71 | 1.33 | 65.26 | -32.08 | 0. |
| 0.260 | 8564. | 595. | 1742. | -5.024 | 0.770 | -2.38 | 1.17 | 65.24 | -32.07 | 0. |
| 0.265 | 8560. | 600. | 1742. | -5.035 | 0.775 | -2.05 | 1.01 | 65.22 | -32.06 | 0. |
| 0.270 | 8556. | 604. | 1741. | -5.045 | 0.780 | -1.73 | 0.85 | 65.20 | -32.05 | 0. |
| 0.275 | 8553. | 607. | 1741. | -5.052 | 0.784 | -1.40 | 0.69 | 65.19 | -32.05 | 0. |
| 0.280 | 8550. | 610. | 1741. | -5.059 | 0.787 | -1.08 | 0.53 | 65.18 | -32.04 | 0. |
| 0.285 | 8548. | 599. | 1730. | -5.063 | 0.789 | -0.75 | 0.37 | 65.35 | -32.12 | 0. |
| 0.290 | 8547. | 600. | 1730. | -5.066 | 0.790 | -0.42 | 0.21 | 65.34 | -32.12 | 0. |
| 0.295 | 8546. | 600. | 1730. | -5.067 | 0.791 | -0.10 | 0.05 | 65.35 | -32.12 | 0. |

TABLE 16

Figure 29:
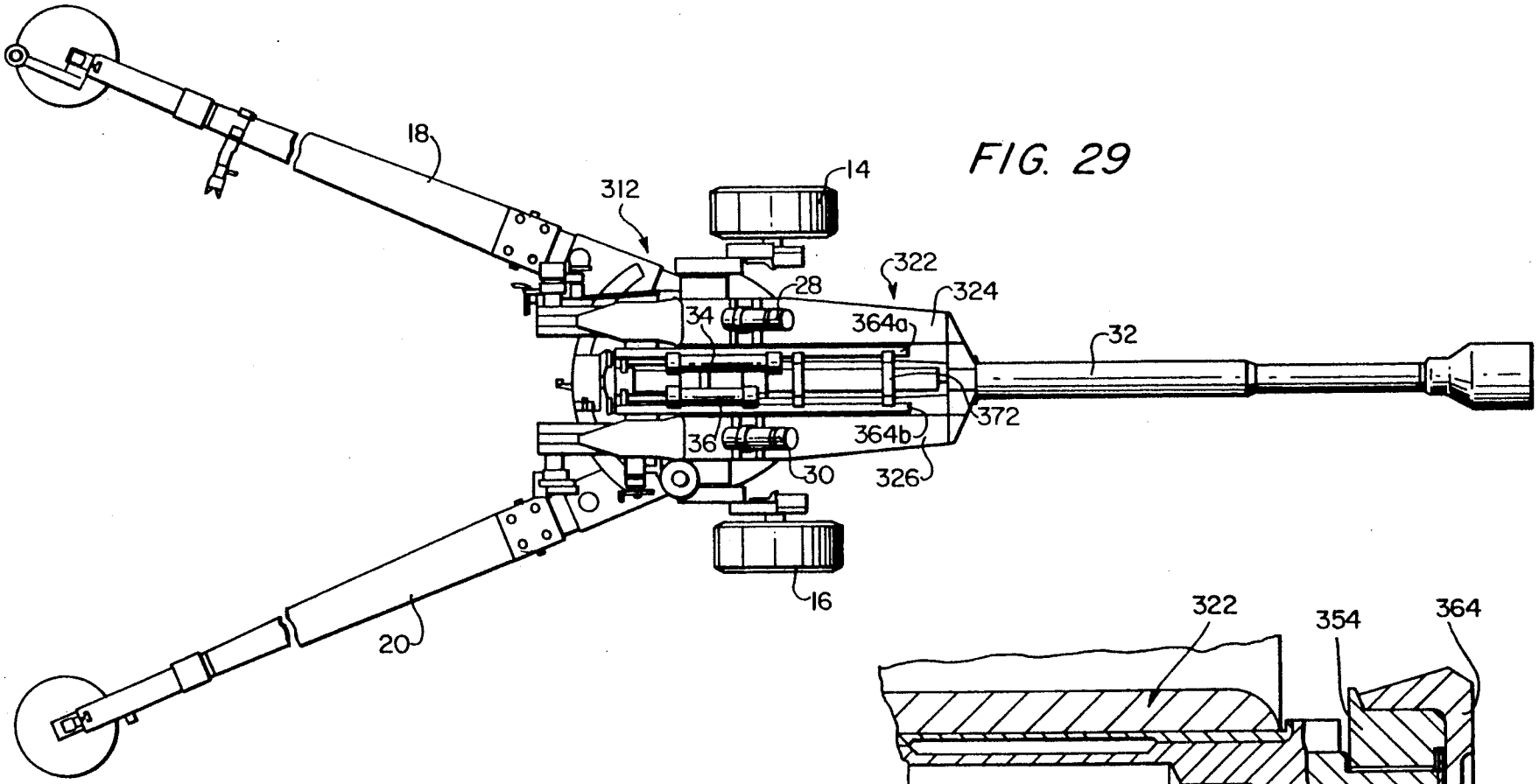
FIG. 29 is a top, plan view of a light weight towed Howitzer incorporating a third embodiment of the stabilizing system of the invention.
Figure 30:
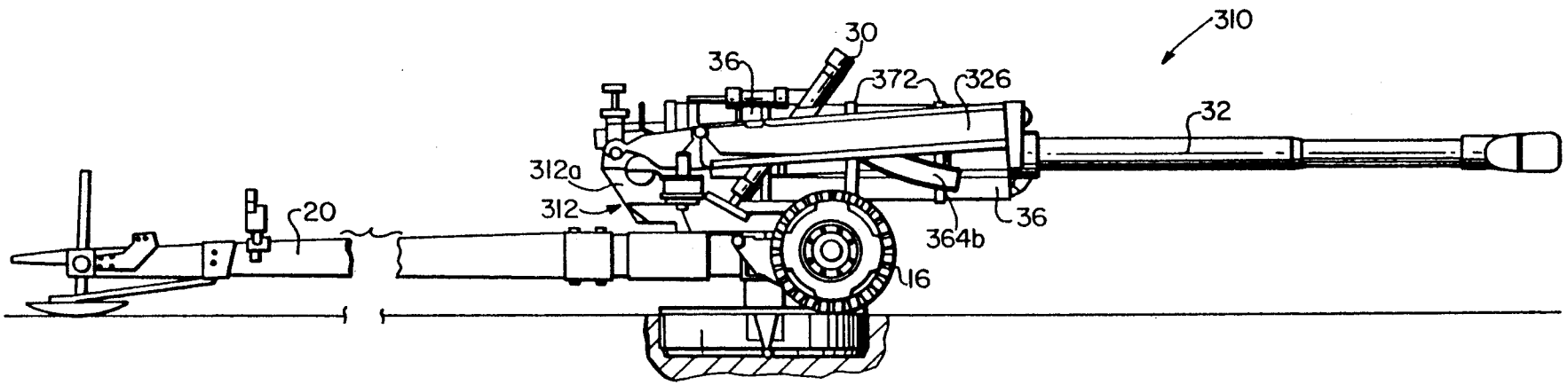
FIG. 30 is a right elevational view of FIG. 29.

Referring now to FIGS. 29 and 30, there is shown a lightweight towed 155 millimeter Howitzer 310 incorporating a third embodiment of the stabilizing system of the invention. Howitzer 310 also comprises a carriage assembly 312, wheels 14 and 16, and trails 18 and 20. A cradle assembly 322 having left and right sides 324 and 326 and modified according to the third embodiment of the invention as will be described in greater detail hereinafter is pivotally mounted on carriage assembly 312. Cradle assembly 322 is pivoted up and down by left and right pistons 28 and 30. The third embodiment of the invention is similar to the embodiment shown in FIGS. 8–11, insofar as the campaths are provided on the cannon assembly and the cam followers are provided on the cradle assembly. As in the previously described embodiments, a curved set of tracks is used to constrain the recoil path of the recoiling parts.

Cannon assembly 32, cradle assembly 322, and recoil mechanism assembly 34, 36 define the elevating mass of Howitzer 310. Cannon assembly 32, cradle assembly 322, recoil mechanism assembly 34, 36, and upper carriage 312*a* define the traversing mass of Howitzer 310. Cannon assembly 32 and recoil mechanism assembly 34, 36 define the recoiling mass of Howitzer 310.

Figure 31A:
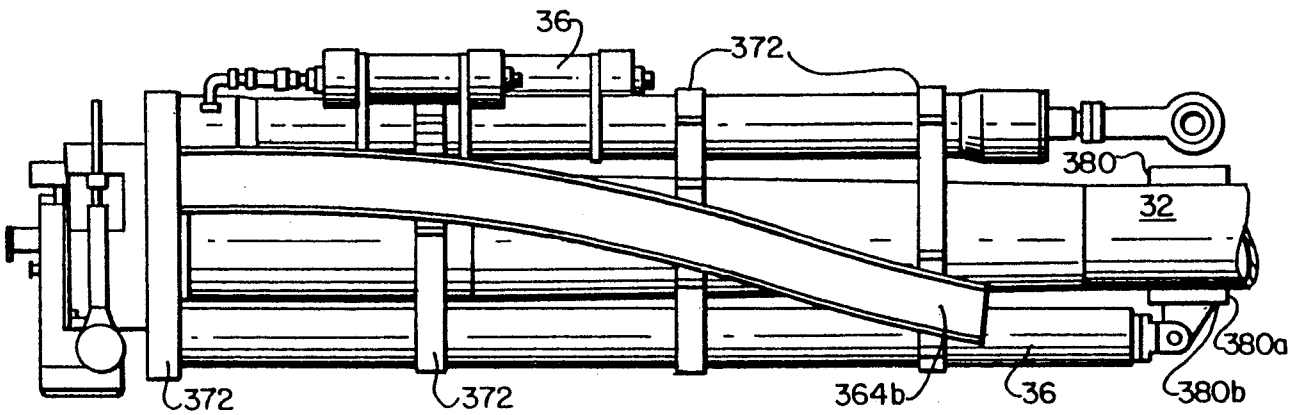
FIG. 31*a* is an enlarged right elevational view of the cannon and its mounting mechanism as shown in FIG. 30.
Figure 31B:
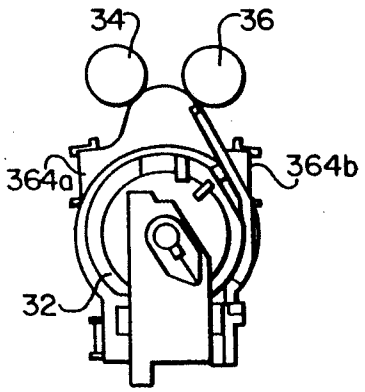
FIG. 31*b* is a rear elevational view of FIG. 31*a*.

As shown in FIGS. 29–31, a single pair of curved campaths or tracks 364*a* and 364*b* are positioned one on the left side and one on the right side of cannon assembly 32. Left and right tracks 364*a* and 364*b* are secured to cannon assembly 32 by suitable structural parts, such as track support collars 372 which also provide support and location for the cylinders of the recoil mechanism 34, 36.

Figure 32:
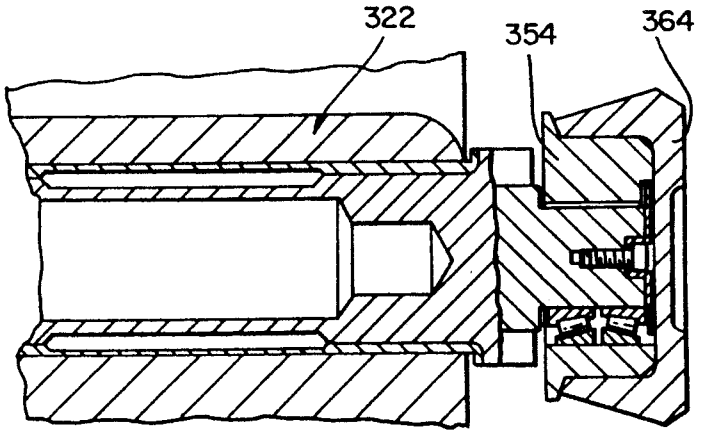
FIG. 32 is a partial cross-sectional view of the right side of the roller assembly and right track of the mounting mechanism shown in FIG. 31*a*.

The tracks 364*a* and 364*b* are fabricated with a certain unique curve whose shape is determined according to the precepts of the Curvilinear Recoil technique. Left and right tracks 364*a* and 364*b* interact with a single pair of roller assemblies 354, the right roller assembly 354 being shown in FIG. 32. Each track 364 interacts with a respective roller assembly 354 which is mounted on the side of cradle assembly 322. In the initial, or "in battery," position of Howitzer 310 as shown in FIG. 30, the position of roller assemblies 354 is towards the extreme rear (i.e., the breech end) of tracks 364*a* and 364*b*, respectively. When the recoiling parts move to the rear (i.e. towards the breech end) under the firing impetus, the interaction of the roller assemblies 354 and their respective tracks 364 causes the breech end of the recoiling mass to be displaced upwards with respect to its original orientation.

Forward support for the recoiling mass is provided by a pivoting sliding interface 380, represented in FIG. 31*a* as a bushing 380*a* mounted in a spherical seat 380*b*. This seat 380*b* is part of the forward crosspiece of cradle assembly 322. During recoil motion, the recoiling parts are constrained to pivot about the interface 380 while the rear end of the recoiling parts is displaced upwards by the interaction of tracks 364 and their respective roller assemblies 354. The pivoting sliding interface 380 can be formed by any suitable alternative mechanical arrangement which provides constraint in the vertical and side-to-side directions, while permitting rotation about a pivot point and the sliding motion required during recoil. One such suitable alternative could employ two straight rails positioned parallel to the prefiring longitudinal axis of the tube, one on the left side and one on the right side of cannon assembly 32, and securely attached to the cannon tube at the three o'clock and nine o'clock positions looking towards the muzzle. Two slidable runners, pivotably mounted to the cradle, one on the left side and one on the right side would interface with the straight rails, permitting longitudinal recoil motion and a simultaneous rotation about the center of rotation of the pivoted runners. Equally, the pivotable runners could be securely mounted to the recoiling cannon assembly and the straight rails mounted to the cradle.

Figure 33A:
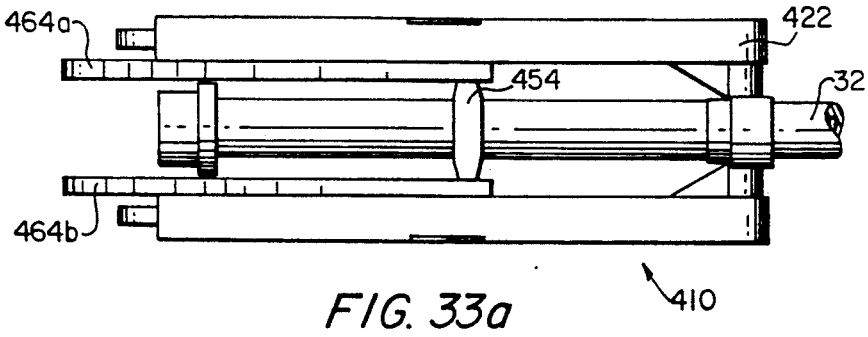
FIG. 33*a*, is a top, plan view of a mounting mechanism for a cannon of a light weight towed Howitzer incorporating a fourth embodiment of the stabilizing system of the invention.
Figure 33B:
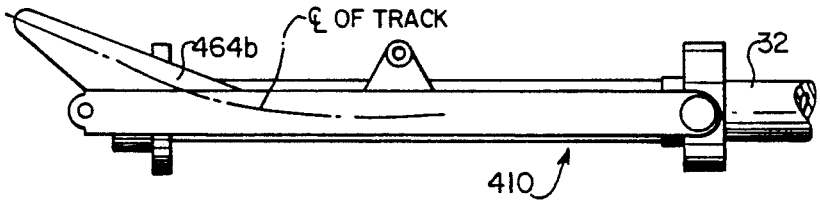
FIG. 33*b* is a right elevational view of FIG. 33*a*.
Figure 34A:
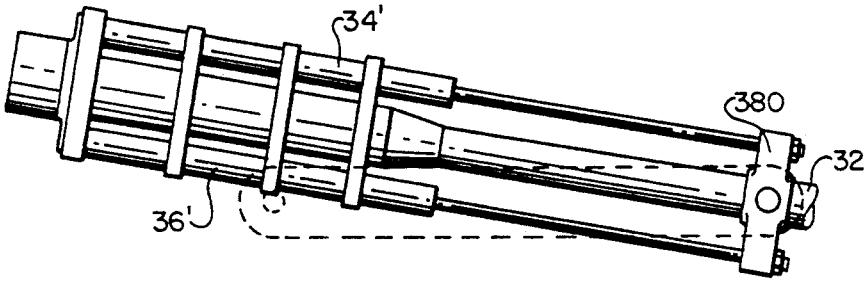
FIG. 34*a* is a top, plan view of the cannon and its mounting mechanism as shown in FIG. 29, in the fully recoiled position.
Figure 34C:
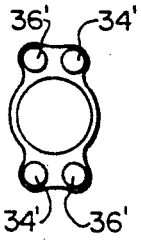
FIG. 34*c* is a rear elevation of FIG. 34*b;*
Figure 34B:
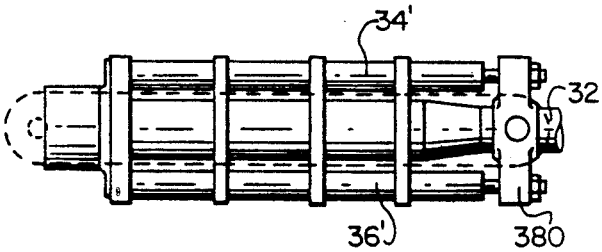
FIG. 34*b* is a top, plan view of the cannon and its mounting mechanism as shown in FIG. 29, at rest.
Figure 34D:
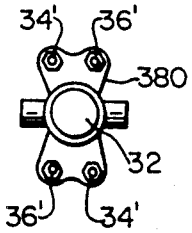
FIG. 34*d* is a front elevation of FIG. 34*b;*

In an alternative arrangement as illustrated in FIGS. 33*a* and 33*b*, the curvilinear tracks 464*a* and 464*b* are positioned on the cradle assembly 422, while a single roller assembly 454 is attached to cannon assembly 32.

The recoil system of the third and fourth embodiments of the invention consists of one subsystem which provides a predictable and controllable deceleration of the recoiling parts, and a second subsystem which stores a portion of the recoil energy and utilizes this stored energy to return the recoiling parts to their initial prefiring position.

The magnitude of the retarding force generated by the recoil cylinders (or buffers) must at all times bear a specific relationship to the shape of the curvilinear tracks. This specific relationship results from the application of the curvilinear recoil technique, as described in detail above. An essential feature of recoil systems designed for use in curvilinear applications is that of two stage function. In stage one, the initial portion of the recoil stroke, the buffer applies a high retardation force to the recoiling parts. At the end of stage one recoil, the recoiling parts have been slowed to a fraction of their maximum rearward velocity, and have acquired an upward velocity. In stage two recoil, the retardation of the recoil buffer is reduced to a low value. By the end of stage two recoil, the recoiling parts have been brought to rest in both the vertical and horizontal senses by the combined action of the recuperator (which is absorbing recoil energy throughout the recoil stroke), gravity, and the small residual braking action of the recoil buffer. The recoiling parts are then returned to their initial prefiring position by the action of the recuperator.

Any convenient arrangement can be employed for the configuration of the recoil mechanism assembly, provided that the recoil buffer is designed to generate the required retardation force-time and force-distance curves. One such arrangement is illustrated in FIGS. 34*a*, 34*b*, 34*c* and 34*d*, in which two recoil cylinders 34' and two recuperator cylinders 36' are disposed symmetrically about the cannon tube axis such that the resultant retardation force (excluding gravity components) lies along the tube axis. At the rear, or breech, end the recoiling portion of the recoil mechanism is securely attached to the recoiling parts. At the forward end, the non-recoiling portion of the recoil mechanism is attached to the structure which contains the bushing 380*a* through which the tube slides during recoil.

When the weapon is fired, the recoiling parts are accelerated rearward by a force resulting from the reaction to the acceleration of the projectile in the forward direction. The path of the center of mass of the recoiling parts is guided by the pivoting sliding interface at the forward extremity of the cradle assembly 322 or 422 and by the interaction of the roller assemblies 354 or 454 and the curvilinear tracks 364 or 464 which form the rearmost support point.

During the time that the projectile is still within the bore of the cannon tube during firing the recoiling parts are caused to move in a straight line, maintaining the initial prefiring orientation of the cannon tube. This aids in accuracy and is ensured by providing an initial straight section of track. After departure of the projectile from the muzzle, which corresponds in the example cited to a longitudinal recoil motion of about six inches of the recoiling parts, the rollers enter a section of tracks curved so as to cause an upward displacement of the recoiling parts center of mass with the recoiling parts simultaneously rotating about the pivoting sliding interface at the forward end of the cradle.

The shape of the curvilinear tracks is determined by application of the curvilinear technique so that the force generated between the tracks and the rollers, together with the reaction forces at the cradle interface, produces a net downward reaction force on the cradle. The moment of this force about the trail ends 18 plus the moment of the static weight of the weapon about the trail ends 18 is required to be greater than the moment of the retarding force of the recoil mechanism about the trail ends 18. When this condition is fulfilled, the weapon will not exhibit any tendency towards instability, that is to rotate upwards about the trail ends 18.

The curvilinear force generated between the tracks and the rollers is a function of the instantaneous recoil velocity, the slope and the rate of change of slope of the tracks at the contact point between the rollers and the tracks with respect to the initial tube axis orientation. Since the recoil velocity of the recoiling parts is continuously diminishing throughout recoil under the braking action of the recoil mechanism, it follows that an essentially constant value of the curvilinear force requires a gradually increasing rate of change of slope of the tracks. If this slope is too shallow, the resultant curvilinear force will be insufficient to produce a stable weapon. If the slope is too steep, the weapon will be stable, but the recoiling parts will be given an upward velocity vector which is too great. This latter effect, as is made clear shortly, will produce instability towards the end of the recoil stroke.

At the end of stage one recoil, the velocity of the recoiling parts in the direction of recoil has been reduced to a fraction of its maximum value. However the center of mass of the recoiling parts has acquired also a velocity component upwards at the right angles to the initial tube axis orientation. In addition, the center of mass of the recoiling parts is rotating about the center of rotation of the pivoting sliding interface at the forward end of the cradle, following a path whose radius of curvature is increasing. Both the vertical velocity and the rotational velocity of the recoiling parts must be returned to zero by the end of the recoil stroke.

This is accomplished during the stage two portion of recoil by the following means:

(i) causing the retardation force applied by the recoil buffer to be reduced to a very low value and (ii) shaping the curvilinear tracks so that as the recoil stroke continues, the interaction of the rollers and the tracks causes a downward force to be exerted on the recoiling parts.

The combined action of the recuperator, the small residual buffer force and gravity effects bring the recoiling parts to rest by the end of the recoil stroke. Stage two produces a net upward force on the cradle. However, the combined moment about the trail ends of the braking forces plus the stage two curvilinear forces is designed to be less than the moment of the static weight about the trail ends. Thus the weapon remains stable throughout stage two recoil, and hence throughout the entire firing cycle. If the slope of the track in stage one of recoil is too steep, the recoiling parts will have attained an excessive upward velocity by the end of stage one, requiring application of a large downward force in order to arrest the upward motion by the end of stage two. In this event, the combined moment about the trail ends of the braking forces plus the excessive stage two curvilinear forces may exceed the moment of the static weight about the trail ends, resulting in instability, or lifting of the weapon.

While both the first and second embodiments of the invention and the third and fourth embodiments of the invention employ the curvilinear recoil technique to generate supplementary down forces to stabilize the weapon during the period of high recoil loads, there are fundamental differences in the devices employed and the manner in which the stabilizing forces are generated.

In the first and second embodiments of the invention, the recoiling mass is supported by two sets of roller assemblies running in two sets of curvilinear tracks, positioned one forward of and one aft of the center of mass of the recoiling parts. As a result, during recoil motion the recoiling parts are displaced rearward and upward as dictated by the shape of the tracks, maintaining their longitudinal axis at all times parallel to the initial prefiring orientation.

Figure 35:
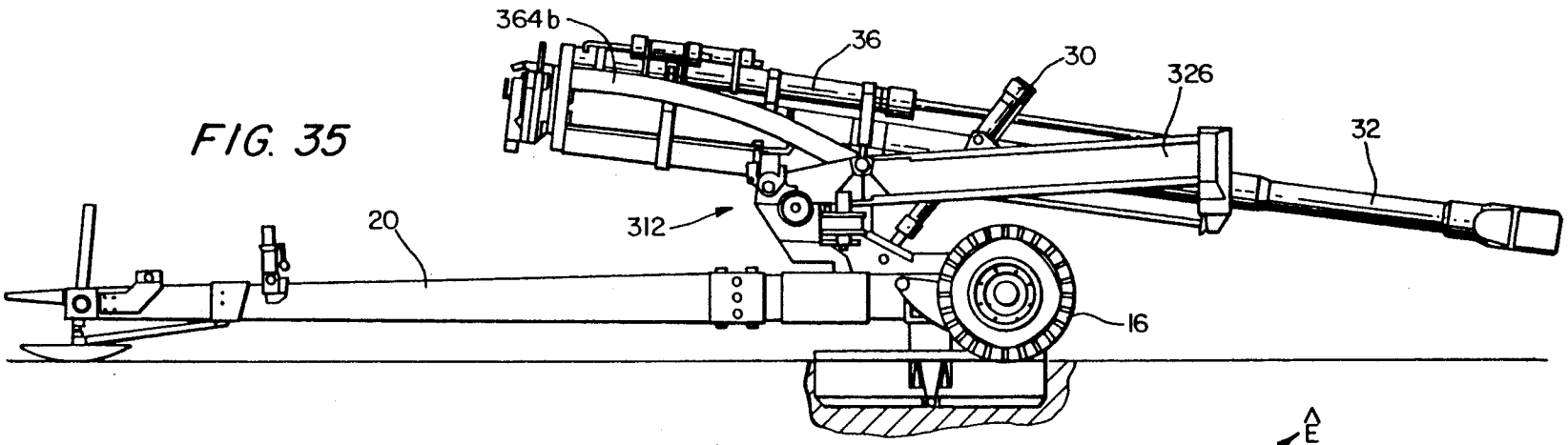
FIG. 35 is a right elevational view of the Howitzer of FIG. 29, in the fully recoiled position.

In contrast, in the third and fourth embodiments of the invention, a single set of curvilinear tracks is positioned aft of the center of mass of the recoiling parts. A pivoting, sliding interface supports the recoiling parts at the forward end of the cradle, permitting the recoiling parts both to slide through as required by the recoil function and to pivot as dictated by the interaction of the rollers with the single set of curvilinear tracks. This motion is depicted in FIG. 35 and may be contrasted with the motion of the recoiling parts as described with respect to the first and second embodiments of the invention and as shown in FIG. 1.

The computations required to define the shape of the curvilinear tracks of the third and fourth embodiments of the invention are fundamentally different from those required to define the shape of the curvilinear tracks of the first and second embodiments, since they must address the rotation of the recoiling parts during the recoil motion. Account must be taken of the inertia of the recoiling parts, the location of the center of mass of the recoiling parts, and the rotational as well as translational velocity of the recoiling parts.

The dynamic analysis of the third and fourth embodiment of the stabilizing system of the invention is based on a planar model of rigid bodies. There are two stationary bodies-cradle and carriage, and one recoiling body-cannon.

The first fixed body (cradle) elevates the gun tube by rotating about the trunnions, while the carriage remains fixed in ground contact. Ideally during the firing cycle, no motion occurs between the cradle and the carriage therefore only the cannon's motion will be considered. The cradle and carriage ar accounted for when considering the overall system stability.

Figure 36:
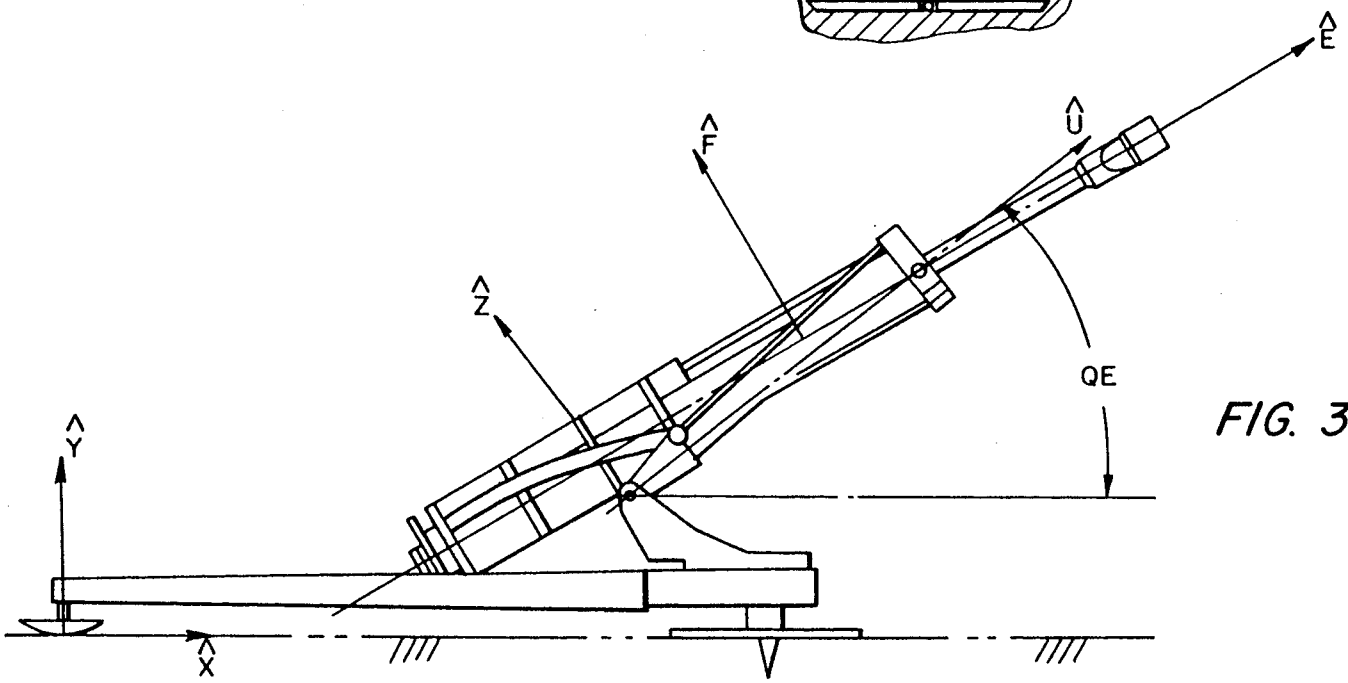
FIG. 36 is a diagrammatic representation of the general gun configuration for the second embodiment of the stabilizing system of the invention.

The general gun configuration is shown diagrammatically in FIG. 36. There are three coordinate systems associated with the cannon model. The first is a ground fixed system centered at the rear trail pad contact with ground, and its directions are horizontal from trail to muzzle, and vertical upwards. It is regarded as a global coordinate system. Displacements, velocities and accelerations referred to this system contain (X,Y) for horizontal and vertical values respectively. The second coordinate system is centered at the trunnion and elevates with the cradle. When the cradle is not elevated this coordinate system is parallel to the global (X,Y) system. Variables referred to in this local system are identified with a (U,Z) appended. The third coordinate system is fixed always at the cannon center of mass and rotates with the cannon. It is parallel with the global system when the cannon is unelevated and "in-battery". Variables referred to in this local system are identified with (E,F) appended.

The cannon slides through its front support and rotates in it as the rear of the cannon follows the fixed track path. A dynamical description of its motion therefore requires three degrees of freedom: two translations and a rotation, each interacting with the others. The impetus for its motion will come not only from forces but also torques acting on the cannon. All torques on the cannon will be defined with respect to the tube center of gravity. To describe the methods used in analyzing the motion of this variant of the curvilinear recoil system, we establish some notation and other preliminaries.

Displacements, velocities, accelerations and forces are two dimensional vector quantities. Directions are represented by unit vectors $\hat{x},\hat{y};\hat{u},\hat{z};\hat{e},\hat{f}$; see FIG. 36. $\hat{k}$ represents a unit vector normal to the plane containing $(\hat{x},\hat{y})$, $(\hat{u},\hat{z})$ or $(\hat{e},\hat{f})$ and it forms a Cartesian triad with any of the planar set.

A general vector, $\vec{A}$, is represented as follows:

$$\vec{A}=A_x\hat{x}+A_y\hat{y}=A_u\hat{u}+A_z\hat{z}=A_e\hat{e}+A_f\hat{f} \quad (17)$$

where $A_x$, $A_y$; $A_u$, $A_z$; $A_e$, $A_f$ are scalar quantities.

Two vector products are used; they are the dot product and cross product. Given two vectors $\vec{A}$ and $\vec{B}$ where $$\vec{A}=A_e\hat{e}+A_f\hat{f} \quad (18)$$

$$\vec{B}=B_e\hat{e}+B_f\hat{f} \quad (19)$$

The dot product $\vec{A}$ with $\vec{B}$ is represented as $\vec{A}.\vec{B}$ where $$\vec{A}.\vec{B}+\vec{B}.\vec{A}=A_eB_e+A_fB_f \quad (20)$$

The cross product of $\vec{A}$ with $\vec{B}$ is represented as $\vec{A}\times\vec{B}$ where $$\vec{A}\times\vec{B}=-\vec{B}\times\vec{A}=(\vec{A}_e\vec{B}_f-\vec{A}_f\vec{B}_e)\hat{k} \quad (21)$$

The length of a vector $\vec{A}$ is represented by $|\vec{A}|$

One dot over a letter indicates its first time derivative, while two dots indicate its second time derivative.

We use QE to represent the cradle's angle of rotation (quadrant elevation) with respect to the global $\hat{x}$ axis, and $\theta$ to represent the cannon s rotation with respect to its in-battery position. All transformations between unit vectors can be obtained using the following:

$$\hat{u}=\text{Cos } QE\ \hat{x}+\text{Sin } QE\ \hat{y} \quad (21)$$

$$\hat{z}=-\text{Sin } QE\ \hat{x}+\text{Cos } QE\ \hat{y} \quad (22)$$

$$\hat{e}=\text{Cos}\theta\hat{u}+\text{Sin}\theta\hat{z} \quad (23)$$

$$\hat{f}=-\text{Sin}\theta\hat{u}+\text{Cos}\theta\hat{z} \quad (24)$$

Figure 39:
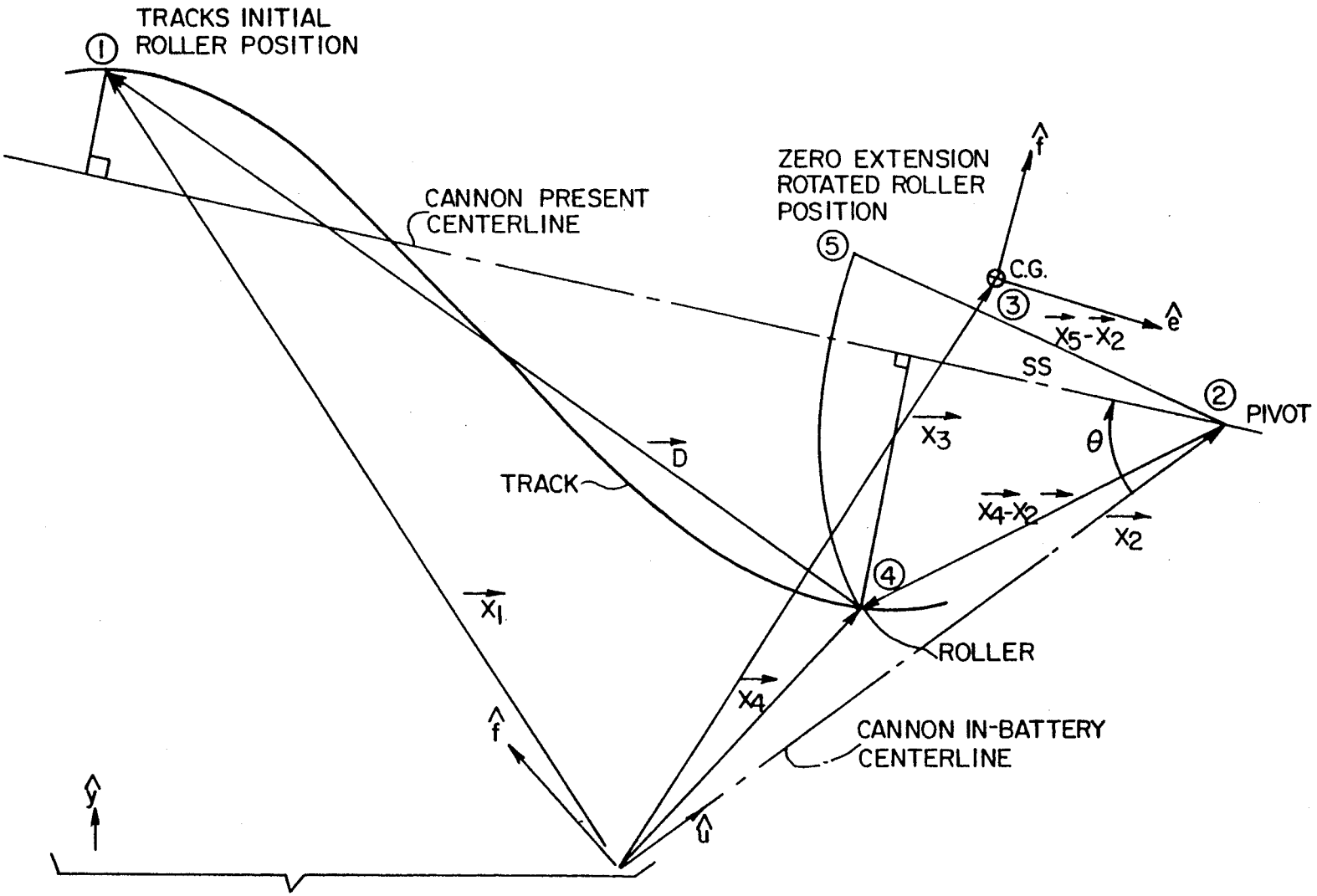
FIG. 39 is a vector diagram illustrating the points used to describe the cannon's position and orientation relative to the trunnion, for the second embodiment of the stabilizing system of the invention.

Essential points used to describe the cannon's position and orientation relative to the trunnion are illustrated vectorially in FIG. 39. They are:

(1) Track's initial roller position, $\vec{X}_1$
(2) Pivot position, $\vec{X}_2$
(3) Cannon center of mass, $\vec{X}_3$
(4) Roller position, $\vec{X}_4$
(5) Apparent rotated roller position, $\vec{X}_5$ Track's initial roller position displacement, $\vec{D}=e\hat{e}+f\hat{f}$.

The magnitude of the scalars e,f are the track run along the cannon and its rise perpendicular to it. Positions 1-5 (see FIG. 38) are written below in terms of their in-battery configuration values and the displacement D. Let SS be the projected distance from roller to pivot along the cannon centerline, i .e.:

$$SS=\sqrt{[(HT2-HT1)^2+VT1^2-(VT1-f)^2]} \quad (26)$$

Then, relative to the trunnion, $$\textit{Roller position, } \vec{X}_4=HT1\hat{u}+VT1\hat{z} \quad (27)$$

Track's initial roller position, $$\vec{X}_1=\vec{X}_4+D \quad (28)$$

Pivot position, $$\vec{X}_2=HT2\hat{u}=\vec{X}_1+(SS-e)\hat{e}-VT1\hat{f} \quad (29)$$

Roller relative to pivot, $$\vec{X}_4-\vec{X}_2=-SS\hat{e}+(VT1-f)\hat{f} \quad (30)$$

Apparent rotated roller position relative to pivot, $$\vec{X}_5-\vec{X}_2=(HT1-HT2)\hat{e}+VT1\hat{f} \quad (31)$$

Cannon center of gravity, $$\vec{X}_3=\vec{X}_1+(HCGR-HT1)\hat{e}+(VCGR-VT1)\hat{f} \quad (32)$$

Equations (30) and (31) are used to define trigonometric functions of the cannon's rotation angle. Thus:

$$\cos\theta = \frac{(\vec{X}_4 - \vec{X}_2)}{|\vec{X}_4 - \vec{X}_2|} \cdot \frac{(\vec{X}_5 - \vec{X}_2)}{|\vec{X}_5 - \vec{X}_2|} = \frac{SS(HT2 - HT1) + VT1(VT1 - f)}{(HT2 - HT1)^2 + VT1^2} \quad (33)$$

$$\sin\theta = \frac{(\vec{X}_4 - \vec{X}_2)}{|X_4 - X_2|} \times \frac{(\vec{X}_5 - \vec{X}_2)}{|X_5 - X_2|} \cdot \hat{k} = \frac{SS\ VT1 + (VT1 - f)(HT2 - HT1)}{(HT2 - HT1)^2 + VT1^2} \quad (34)$$

Equations (21)–(34) above are used to define the cannon's orientation and displacement, as well as its velocity and acceleration through the time derivative of the center of gravity vector $\vec{X}_3$ (equation 32).

Figure 37:
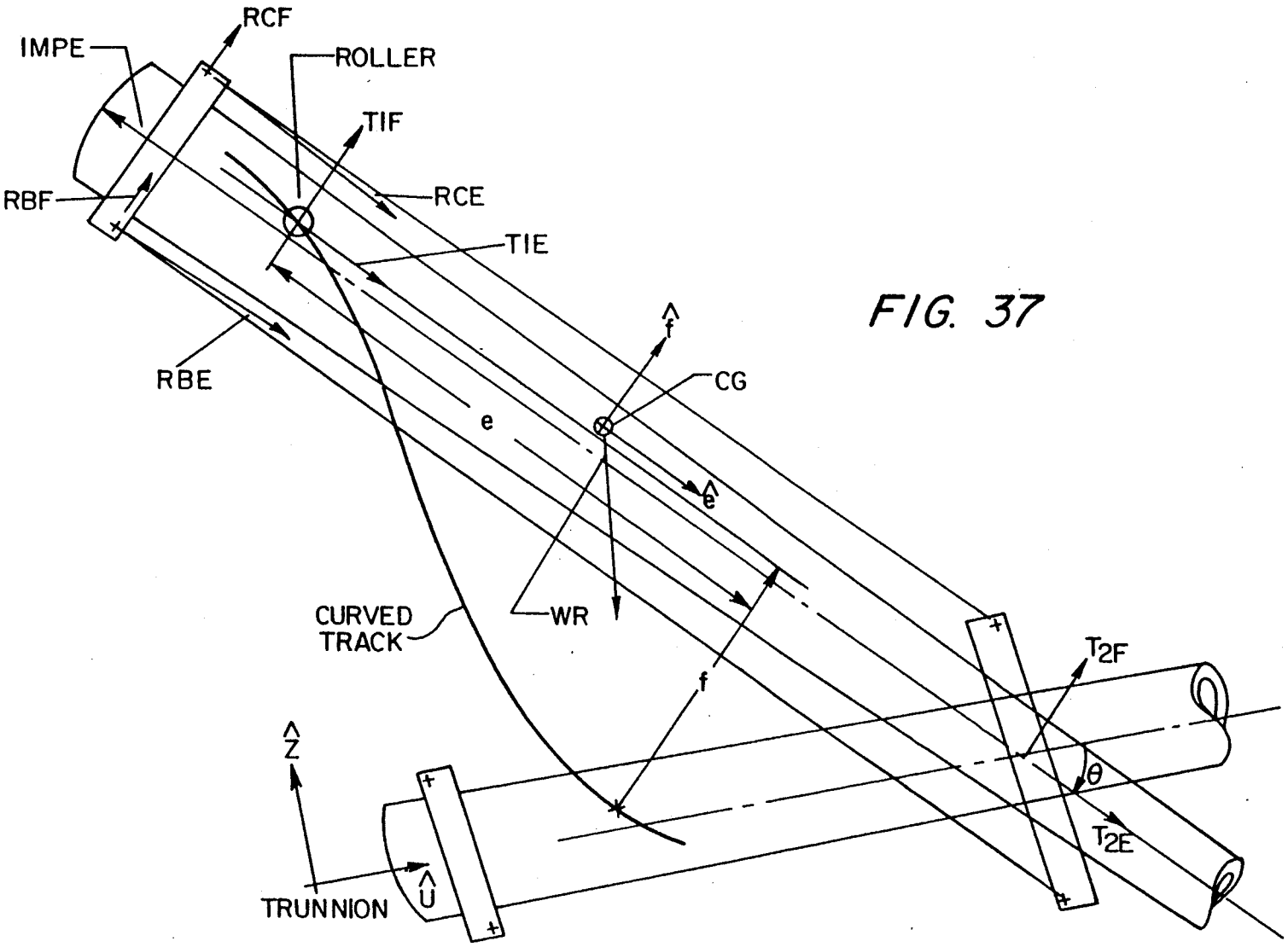
FIG. 37 is a diagrammatic representation of the driving force acting on the cannon assembly and its application points, for the second embodiment of the stabilizing system of the invention.
Figure 38:
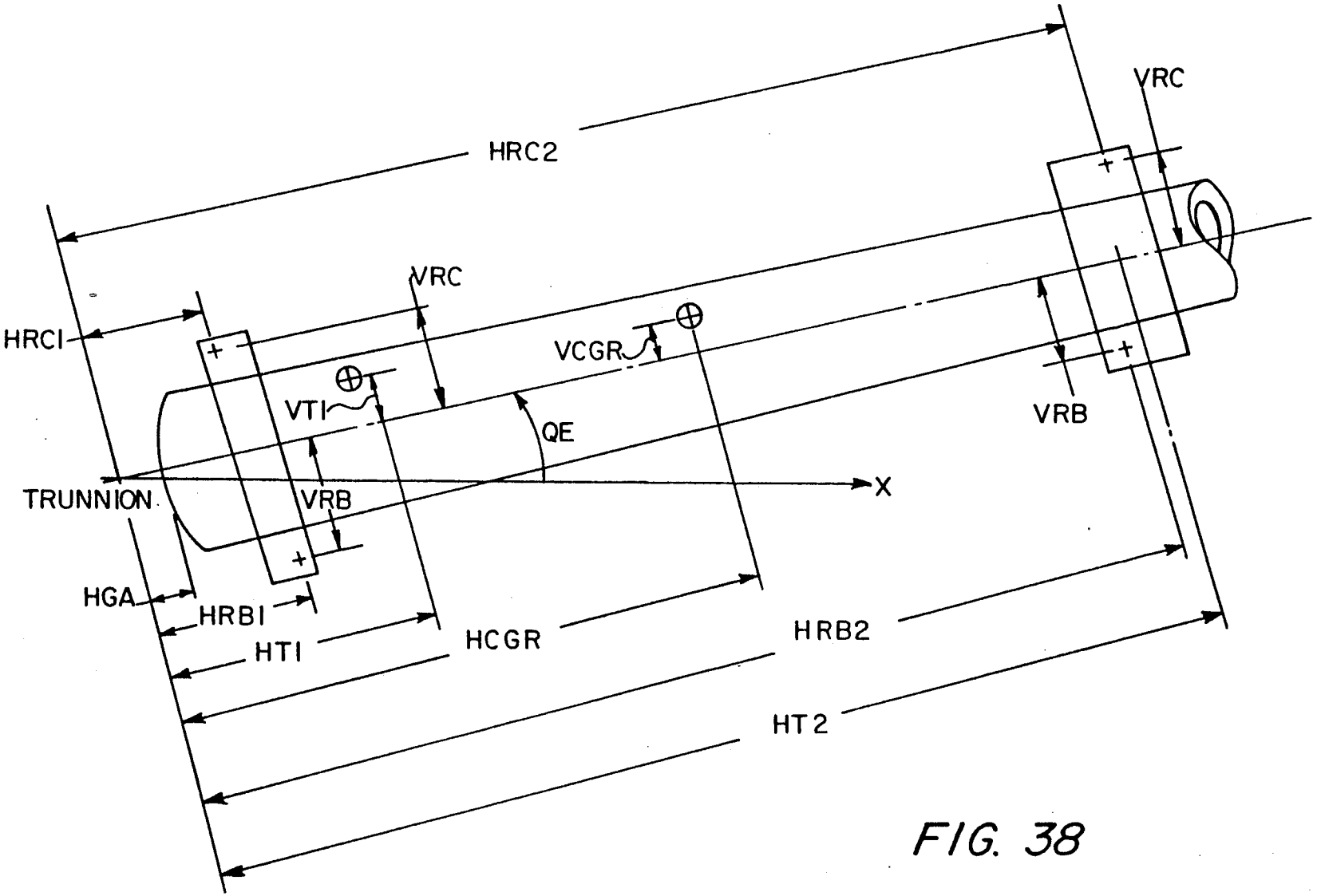
FIG. 38 is a diagrammatic representation of the conservative force acting on the cannon assembly and its application points, for the second embodiment of the stabilizing system of the invention.

Any resulting cannon motion is produced by driving forces as well as constraints on its motion. The cannon is supported both by the pivot through which it slides, and the rollers which follow a curved track fixed to the cannon. Braking action is supplied by a recoil brake and to a smaller extent by the recuperator. Gas propellant pressure acting at the breech supplies the driving force and the weight supplies a conservative force through the center of gravity. These forces and their application points are illustrated in FIGS. 37 and 38. Their vectorial representation in the cannon fixed coordinate system ($\hat{e}$,$\hat{f}$) follows:

| | Force | Point of action relative to cannon C.G. | |
|---|---|---|---|
| Propellant gas: | $IMPE\hat{e}$ | $(HGA - HCGR)\hat{e} - VCGR\hat{f}$ | (35) |
| Recoil brake: | $RBE\hat{e} + RBF\hat{f}$ | $(HRB1 - HCGR)\hat{e} + (VRB - VCGR)\hat{f}$ | (36) |
| Recuperator: | $RCE\hat{e} + RCF\hat{f}$ | $(HCR1 - HCGR)\hat{e} + (VCR - VCGR)\hat{f}$ | (37) |
| Track force: | $T1E\hat{e} + T1F\hat{f}$ | $(HT1 - HCGR)\hat{e} + (VT1 - VCGR)\hat{f}$ | (38) |
| Pivot force: | $T2E\hat{e} + T2F\hat{f}$ | $HT2\hat{u} - \bar{X}_3$ | (39) |
| Recoil weight: | $-WR\hat{y}$ | $\bar{0}$ | (40) |

The cannon is viewed as a free rigid body moving under the influence of these forces. An application of Newton's laws of motion to all parts of the cannon results in three equations of motion for the three degrees of freedom of the cannon. They are the two translational equations depending on the net force and one rotational equation depending on the torque produced by these forces about the center of gravity.

The velocity, $\vec{V}_3$ and acceleration, $\vec{A}_3$ of cannon center of gravity are given by the first and second time derivatives of equation (32) respectively, i.e.

$$\vec{V}_3 = \frac{d\vec{X}_3}{dt} = \dot{\vec{X}}_3 = V3Ee + V3F\hat{f} \quad (41)$$

$$\vec{A}_3 = \frac{d\vec{V}_3}{dt} = \dot{\vec{V}}_3 = A3Ee + A3F\hat{f} \quad (42)$$

where $$V3E = \dot{e} - S\dot{S} - VCGR\dot{\theta} \quad (43)$$

$$V3F = (HCGR - HT1 + e - SS)\dot{\theta} \quad (44)$$

$$A3E = (e - SS - VCGR\theta) - (HCGR - HT1 + e - SS)\theta^2 \quad (45)$$

$$A3F = (HCGR - HT1 + e - SS)\theta + (2(e - SS) - VCGR\theta)\theta \quad (46)$$

These are velocities and accelerations as seen in the cannon fixed coordinate system.

From the geometric relations—equations (33), (34)—we obtain the angular velocity and acceleration:

$$\dot{\theta} = \frac{-\dot{f}}{SS} \quad (47)$$

$$\ddot{\theta} = \frac{-\ddot{f}}{SS} + \frac{\dot{f}\dot{SS}}{SS^2} \quad (48)$$

where $$\dot{SS} = \frac{-(f - VT1)\dot{f}}{SS} \quad (49)$$

and $$\ddot{SS} = \frac{-(f - VT1)\ddot{f}}{SS} - \frac{(\dot{SS}^2 + \dot{f}^2)}{SS} \quad (50)$$

Equation (45) above introduces the centrifugal acceleration:

$$-(HCGR - HT1 + e - SS)\dot{\theta}^2 \quad (51)$$

where the radius $R = (HCGR - HT1 + e - SS)$ is the center of gravity to pivot distance.

Equation (46) introduces a Coriolis type term:

$$2(\dot{e} - \dot{SS})\dot{\theta} \quad (52)$$

as well as a centrifugal contribution $$-VCGR\dot{\theta}^2 \quad (53)$$

to the angular motion of the cannon. Expression, $\dot{SS} - \dot{e}$, in equation (52) is the radial velocity of recoil. Equations (51)–(53) are accelerations experienced in the cannon fixed coordinate system.

Stability of the gun system exists when no motion occurs in the cradle/carriage. Thus the forces acting on this system resulting from the cannon recoil and ground reactions produce no translation or rotation. With an adequate spade system planted into the ground, enough ground reaction can be established to prevent any translation of the system. If a -net positive moment (relative to the out of plane normal, $\hat{k}$; i .e. a counter clockwise moment) exists, then the gun system front end will lift from the ground. We design our system to forestall this possibility. Net clockwise moments (excess stabilizing) result in a positive ground reaction at the forward platform.

Because clockwise moments imply a stable system, our goal is to maintain a clockwise moment on the cradle/carriage system throughout the recoil cycle. This condition is satisfied if the vertical ground reaction on the firing platform (R2Y) remains positive.

We set the amount of stability we require through a value for the ground reaction (R2Y) and design a track path to produce the required dynamic support forces thus yielding this ground reaction. The derivation of a stability criterion follows.

Let the point of action of the cannon forces relative to the cannon center of gravity as defined by equations (35)- (40) be represented by the following vectors:

| | Point of action relative to cannon C.G. | |
|---|---|---|
| Propellant gas action: | $REIM\hat{e} + RFIM\hat{f}$ | (54) |
| Recoil brake force: | $REBM\hat{e} + RFBM\hat{f}$ | (55) |
| Recuperator force: | $RECM\hat{e} + RFCM\hat{f}$ | (56) |
| Track force at roller: | $RE1M\hat{e} + RF1M\hat{f}$ | (57) |
| Pivot force on cannon: | $RE2M\hat{e} + RF2M\hat{f}$ | (58) |

Stability considerations are addressed by considering the moment equation for the cradle/carriage system. Taking these moments about the global origin at the trail rear, we require vector from this global origin to the application point of all the forces on the free body system comprising the cradle and carriage. Applying Newton's third equation of equal and opposite reaction between cannon and cradle/carriage, we represent these vectors as follows:

| | Force | Point of action relative to Global Origin | |
|---|---|---|---|
| Roller force at track: | $-T1E\hat{e} - T1F\hat{f}$ | $RE1S\hat{e} + RF1S\hat{f}$ | (59) |
| Cannon force on pivot: | $-T2E\hat{e} - T2F\hat{f}$ | $RE2S\hat{e} + RF2S\hat{f}$ | (60) |
| Recoil force on cradle: | $-RBE\hat{e} - RBF\hat{f}$ | $REBSe + RFBS\hat{f}$ | (61) |
| Recuperator force on cradle: | $-RCE\hat{e} - RCF\hat{f}$ | $RECS\hat{e} + RFCS\hat{f}$ | (62) |
| Cradle weight: | $-WE\hat{y}$ | $RXES\hat{x} + RYES\hat{y}$ | (63) |
| Carriage weight: | $-WF\hat{y}$ | $RXFS\hat{x} + RYFS\hat{y}$ | (64) |
| Forward ground reaction: | $R2X\hat{x} + R2Y\hat{y}$ | $RXGS\hat{x} + RYGS\hat{y}$ | (65) |
| Rear ground reaction: | $R1X\hat{x} + R1Y\hat{y}$ | $O\hat{x} + O\hat{y}$ | (66) |

Coordinate values in equations (54)-(66) are calculated from the in-battery configuration and the displacement vector $\vec{D}$.

The equations of motion for the cannon as a free body are given below, where MR and I are its mass and moment of inertia about its center of gravity respectively, and (WRE, WRF) are the recoiling weight components in the rotating coordinates:

$$MR\ A3E = IMPE + RBE + RCE + WRE + T1E + T2E \quad (67)$$

$$MR\ A3F = RBF + RCF + WRF + T1F + T2F \quad (68)$$

$$I\ddot{\theta} = (RE1M\ T1F - RF1M\ T1E) + (RE2M\ T2F - RF2M\ T2E) + (REBM\ RBF - RFBM\ RBE) + (RECM\ RCF - RFCM\ RCE) - RFIM\ IMPE \quad (69)$$

Stability of the cradle/carriage as a free body implies no net torque; with respect to the global origin, this implies the following:

$$(RE1S\ T1F - RF1S\ T1E) + (RE2S\ T2F - RF2S\ T2E) + (REBS\ RBF - RFBS\ RBE) + (RECS\ RCF - RFCS\ RCE) + RXES\ WE + RXFS\ WF - (RXGS\ R2Y - RYGS\ R2X) = 0 \quad (70)$$

No translational motion of the cradle/carriage system requires zero net force on this system. In terms of their global coordinate values, this requires the following two equations be satisfied:

$$-T1X - T2X - RCX - RBX + R1X + R2X = O \quad (71)$$

$$-T1Y - T2Y - RCY - RBY + R1Y + R2Y - WE - WF = O \quad (72)$$

Equations (67)-(72) are the complete equations of motion which our two body planar system must satisfy.

Conventional recoil systems produce no vertical acceleration, A3F, on the recoiling cannon as well as no rotation, leading to equations (68) and (69) being equal to zero. These equations then provide a means of finding the forces distributed at the rear and forward supports. Stabilizing moments, $M_{st}$ on the cradle/carriage system are deduced from equation (70) as follows:

$$M_{st} = RE1S\ T1F + RE2S\ T2F + REBS\ RBF + RECS\ RCF + RXES\ WE + RXFS\ WF \quad (73)$$

while overturning moments are the collection of moments tending to rotate the cradle/carriage counter clockwise, i.e.:

$$M_{ov} = RF1S\ T1E + RF2S\ T2E + RFBS\ RBE + RFCS\ RCE - RYGS\ R2X \quad (74)$$

For stability $$M_{st} > M_{ov} \quad (75)$$

which from equation (70) implies $$RXGS\ R2Y > 0 \quad (76)$$

$$\text{where } R2Y = \frac{M_{st} - M_{ov}}{RXGS} \quad (77)$$

Because no cannon rotation occurs in conventional systems, the (E,F) values will correspond to the (U,Z) values which are the same as global (X,Y) values at zero quadrant elevation.

Equations (67)-(74) produces the following equation after some algebraic manipulation:

$$M_{st} - M_{ov} = I\ddot{\theta} + [RE3S\,(MR\,A3F - WRF) - RF3S\,(MR\,A3E - WRE)] + RXES\,WE + RXFS\,WF + RYGS\,R2X \quad (78)$$

Conventional cannon systems have both A3F and $\ddot{\theta}$ equal to zero, therefore $$M_{st} - M_{ov} = -RF3S\ MR\ A3E - RE3S\ WRF + RF3S\ WRE + RXES\ WE + RXFS\ WF + RYGS\ R2X \quad (79)$$

With its recoil acceleration, A3E equal to zero, at zero quadrant elevation equation (79) reduces to the expected static case:

$$M_{st} - M_{ov} = RE3S\ WR + RXES\ WE + RXFS\ WF, \quad (80)$$

when WRF = −WR and horizontal ground reaction R2X = 0

The curvilinear recoil system according to the first and second embodiments of the invention provides an acceleration, A3F in the cannon normal direction with no rotation, i.e. A3F≠0 and $\theta = 0$. Stability is increased when A3F > 0. This we called stage one of the recoil cycle. The resulting increase in normal velocity must then be reduced to zero by imparting a negative normal acceleration, A3F < 0. This characterizes stage two of the recoil cycle. Stage two negative acceleration corresponds to a reduced stabilizing moment, $M_{st}$. To maintain stability the overturning moment, $M_{ov}$, must also be reduced in stage two. A reduction in recoil force, RBE and/or a reduction in tangential component of support forces, T1E, T2E reduces the overturning moment (equation 74).

A pivoted/sliding system is described specifically by equations (67)–(78) where a nonzero rotational acceleration is provided to the cannon, i .e.

$$\ddot{\theta} \neq 0 \quad (81)$$

Equation (78) shows that for $\theta > 0$ stability is increased, and correspondingly, for $\ddot{\theta} < 0$ stability is decreased. Undesirable effects such as increased component stresses accompany increased stability. Maximum stability would result from a combined positive normal acceleration, A3F > 0, and positive (counterclockwise) rotational acceleration, $\ddot{\theta} > 0$. Center of gravity and other design considerations dictate the kinematics of the single lift/pivot system. These kinematics result in a combination of negative rotational acceleration, $\ddot{\theta} < 0$, and positive normal acceleration, A3F > 0, during stage one, and positive rotational acceleration, $\ddot{\theta} > 0$ and negative normal acceleration, A3F < 0 during stage two. This is accomplished by the pivoted/sliding system where a clockwise angular acceleration is supplied in stage one followed by a counterclockwise angular acceleration in stage two.

Determining an appropriate track profile to give the required stabilizing forces requires a solution of the planar two body system of equations (67)–(72). Additional equations are required to solve this system. We now consider such additions.

Gun systems with forward and aft ground spades presents a statically indeterminate problem for the determination of horizontal ground reactions R1X and R2X. From a dynamic analysis view we simplify this by considering a system with forward spade and aft float with a combined horizontal ground reaction R1X + R2X = SPX acting on the forward spade, then set the aft float horizontal ground reaction to be zero, i.e.:

$$R1X = 0 \quad (82)$$

A sliding pivoted system provides tangential reaction at the supports. These tangential reactions are friction at the pivot and the cannon axis component of the roller normal reaction. The roller constraint force is normal to the track and roller surface at their contact point for frictionless rollers (no structural change occurs in the equation with friction). This fact produces a constraint equation:

$$T1E = \frac{-V4F}{V4F}\,T1F \quad (83)$$

where (V4E, V4F) are the velocity components of point 4 (see FIG. 39).

Frictional forces in the pivot account for tangential reaction, T2E, i.e.:

$$T2E = -\mu\,|T2F|\,Sign\,(V2E) \quad (84)$$

where $\mu$, V2E are the coefficient of friction and cannon tangential velocity at the pivot respectively.

Of the forces applied to the sliding/pivoted system, the propellant gas action, IMPE, is known a priori. Previous firings with known projectile, charge, cannon, and muzzle brake have produced impulse versus time data which are used to obtain the force IMPE as a function of time. Its value is always negative in our coordinate system.

Recoil force depends on the recoil brake in use. Generally, fluid is forced from a large chamber through position-dependent orifices to provide a braking force depending on fluid flow speed and orifice area. The fluid flow speed has a well defined relationship to recoil rod speed which can be determined from the cannon's recoil velocity. Knowing the recoil force and the recoil brake line of action, we have values for the recoil force components (RBE, RBF) defined in terms of the cannon's velocity displacement.

The recuperator, which functions as a gas spring storing energy for the counter recoil cycle, produces a well-defined force in terms of the cannon's displacement.

The weight components (WRE, WRF) are also known when the cannon's orientation is known.

Equations (67)–(72) and (82)–(84) are nine equations involving the ten quantities: (T1E, T1F), (T2E, T2F), (e,f), (R1X, R1Y) and (R2X, R2Y) as well as the cannon's velocity and displacement.

Equations (26)–(34) and (43)–(50) give the cannon's acceleration, velocity and displacement in terms of the track displacements (e,f) and their first and second time derivatives. Using these equations we produce a system of nine algebraic and second order differential equations in the unknown quantities (T1E, T1F), (T2E, T2F), ë, , (R1X, R1Y) and (R2Y, R2Y). One other equation is required to solve this system, and it is provided by either supplying the predetermined amount of stability required, i.e.

$$R2Y = h(e) \quad (85)$$

where h is a well defined function of track run (usually a constant); or supplying a predefined track profile in terms of a functional relation between track run and track rise, i.e.:

$$f=f(e) \tag{86}$$

These two cases are used to define a track profile as well as to check the stability produced by a given track profile Using equations (43)–(50) to substitute into equations (67)–(72) in addition to equations (82)–(85/86) produces ten linear equations in the ten unknowns, (T1E, T1F), (T2E, T2F), (e,f), (R1X, R1Y) and (R2X, R2Y) with coefficients depending on $(\dot{e},\dot{f})$ as well as (e,f).

Matrix methods are used to solve for the unknowns, (thereby producing two differential equations for $\ddot{e}$ and $\ddot{f}$ and algebraic equations for the other quantities), when a predetermined stability is used to determine track profile. Matrix methods are also used to solve the system when-a track profile is known (f can be defined in terms of $\ddot{e}$, and the track profile f(e) and-first derivatives); one differential equation for $\ddot{e}$ is produced together with algebraic equations.

Integration routines (e.g. Runge-Kutta) are used to advance the differential solution in time and the other unknowns are advanced in time by the algebraic equations using the advanced values of $(\dot{e},\dot{f})$, (e,f) or $(\dot{e},e)$.

Sample input and output for the predefined track follows. A wealth of additional output information is also generated but not included in this sample.

| Table | Description |
|---|---|
| 1 | Input data file of "in-battery" configuration data |
| 2 | Propellant Gas impulse |
| 3.1–3.2 | Short recoil orifice data |
| 4.1–4.3 | Long recoil differential orifice data |
| 5.1–5.4 | Track profile |
| 6.1–6.2 | Output data at zero degrees quadrant elevation |
| 7.1–7.2 | Output data at zero degrees quadrant elevation |
| 8 | Output data at 70 degrees quadrant elevation |
| 9 | Output data at 70 degrees quadrant elevation |

A description of the table data follows:

| | | |
|---|---|---|
| Units - | Time: | seconds |
| | Displacements: | ft |
| | Velocities: | ft/sec |
| | Accelerations: | ft/sec/sec |
| | Mass: | slugs |
| | Force: | lbf |
| | Impulse: | lbf-sec |
| | "In-battery" lengths: | inches |

-continued

| | |
|---|---|
| Orifice areas: | $inch^2$ |

Table 1 contains "in-battery" configurational data, time increment, printing data, weights, moment of inertia, recoil and recuperator data, discharge coefficients and coefficients of friction.

TABLE 6.1

| Output data at zero degrees quadrant elevation. Columns in order are: | |
|---|---|
| Time - | Since recoil initiation |
| RBE - | Cannon-axial recoil brake force |
| RCE - | Cannon-axial recuperator force |
| R2Y - | Forward vertical ground reaction |
| U - | Cannon's center of gravity cradle-axial displacement |
| Z - | Cannon's center of gravity cradle-normal displacement |
| VU - | Cannon's center of gravity cradle-axial velocity |
| VZ - | Cannon's center of gravity cradle-normal velocity |
| AU - | Cannon's center of gravity cradle-axial acceleration |
| AZ - | Cannon's center of gravity cradle-normal acceleration |
| IMPE - | Propellant gas force |

TABLE 7.1

| output data at zero degrees quadrant elevation Columns in order are: | |
|---|---|
| Time - | Same as 6.1 |
| U - | Same as 6.1 |
| Z - | Same as 6.1 |
| RBU - | Cradle-axial recoil brake force |
| RBZ - | Cradle-normal recoil brake force |
| RCU - | Cradle-axial recuperator force |
| RCZ - | Cradle-normal recuperator force |
| T1U - | Cradle-axial roller force on cannon |
| T1Z - | Cradle-normal roller force on cannon |
| T2U - | Cradle-axial pivot force on cannon |
| T2Z - | Cradle-normal pivot force on cannon |

Table 8 - Output data at seventy (70) degrees quadrant elevation. All columns similar to Table 6.1 above.

Table 9 - output data at seventy (70) degrees quadrant elevation. All columns similar to Table 7.1 above.

Thus, it can be seen that curvilinear recoil will ensure stability for a 9000 pound, 155 mm towed Howitzer under all firing conditions. While preferred embodiments of the invention have been disclosed, it should be understood that the spirit and scope of the invention are to be limited solely by the appended claims, since numerous modifications of the disclosed embodiments will undoubtedly occur to those of skill in the art.

TABLE 1

| | | | | | | | | | |
|---|---|---|---|---|---|---|---|---|---|
| 0.001 | 5 | | | | | | | | |
| 2937 | 863 | 4200 | 5300. | | | | | | |
| 180.0 | −15.25 | 64.26 | 84.28 | 42.0 | 46.0 | | | | |
| 23.25 | 5.5 | 116.0 | −3.0 | 0.61 | 2.41 | 15.0 | 10.25 | 15.0 | −10.25 |
| 650. | 2500. | 1.6 | 10.16 | 500.0 | | | | | |
| 7.9901E-05 | 16.53 | 3.972 | 0.03 | 500.0 | | | | | |
| 0.65 | 0.65 | 0.95 | 0.12 | | | | | | |
| 50.25 | 7.0 | 29.0 | 19.5 | 13.71 | | | | | |
| 178.3 | 25.4 | 11.19 | 17.5 | 10.5 | | | | | |
| DT | IPR | | | | | | | | |
| WF | WE | WR | MOI | | | | | | |
| HTN | HCGF | HCGE | HCGR | HP | VTN | | | | |
| HT1 | VT1 | HT2 | VSP | VCGR | VCGE | HRB | VRB | HRC | VRC |
| PO | VO | XK | ACR | FRC | | | | | |
| RHO | ACL | ARL | ALEAK | FRB | | | | | |
| CP | CG | CL | UT2 | | | | | | |

TABLE 1-continued

| | | | | |
|---|---|---|---|---|
| HE1 | VE1 | HE2 | VE2 | HBP |
| HTJ | L1 | L2 | L3 | L4 |

TABLE 2

M203PIMP - MI07 - BRAKE INDEX = 0.7

| | |
|---|---|
| 20 | |
| .0000 | 000. |
| .0023 | −502. |
| .0031 | −1073. |
| .0040 | −2051. |
| .0047 | −3016. |
| .0054 | −4075. |
| .0060 | −4994. |
| .0067 | −6025. |
| .0075 | −7096. |
| .0085 | −8076. |
| .0100 | −9035. |
| .0123 | −9913. |
| .0133 | −10006. |
| .0163 | −10211. |
| .0203 | −10406. |
| .0271 | −10602. |
| .0337 | −10704. |
| .0514 | −10806. |
| .1711 | −10843. |
| 10.00 | −10843. |

M203 SHOT IMPULSE DATA
(PIMP) M483 0.7 M.B.

TABLE 3.1

| | | | |
|---|---|---|---|
| 102 | | | |
| −1.0000000 | 1.013851 | 0.0000000E+00 | −0.8000000 |
| 0.0000000 | 1.013851 | 0.0000000E+00 | −0.8000000 |
| 0.8000000 | 1.013851 | 0.0000000E+00 | −0.8000000 |
| 1.291688 | 1.013851 | 0.0000000E+00 | −0.8000000 |
| 1.361470 | 1.010653 | 0.0000000E+00 | −0.8000000 |
| 1.430830 | 1.006768 | 0.0000000E+00 | −0.8000000 |
| 1.499755 | 1.003023 | 0.0000000E+00 | −0.8000000 |
| 1.568197 | 0.9977548 | 0.0000000E+00 | −0.8000000 |
| 1.636092 | 0.9918589 | 0.0000000E+00 | −0.8000000 |
| 1.703422 | 0.9860185 | 0.0000000E+00 | −0.8000000 |
| 1.770196 | 0.9802295 | 0.0000000E+00 | −0.8000000 |
| 1.836365 | 0.9728431 | 0.0000000E+00 | −0.8000000 |
| 1.901858 | 0.9647829 | 0.0000000E+00 | −0.8000000 |
| 1.966662 | 0.9567522 | 0.0000000E+00 | −0.8000000 |
| 2.030781 | 0.9487485 | 0.0000000E+00 | −0.8000000 |
| 2.094217 | 0.9407656 | 0.0000000E+00 | −0.8000000 |
| 2.156980 | 0.9328006 | 0.0000000E+00 | −0.8000000 |
| 2.219074 | 0.9248479 | 0.0000000E+00 | −0.8000000 |
| 2.280457 | 0.9154636 | 0.0000000E+00 | −0.8000000 |
| 2.341081 | 0.9059149 | 0.0000000E+00 | −0.8000000 |
| 2.400949 | 0.8963661 | 0.0000000E+00 | −0.8000000 |
| 2.460064 | 0.8868158 | 0.0000000E+00 | −0.8000000 |
| 2.518429 | 0.8772637 | 0.0000000E+00 | −0.8000000 |
| 2.576050 | 0.8677055 | 0.0000000E+00 | −0.8000000 |
| 2.632918 | 0.8577856 | 0.0000000E+00 | −0.8000000 |
| 2.689002 | 0.8470286 | 0.0000000E+00 | −0.8000000 |
| 2.744279 | 0.8362536 | 0.0000000E+00 | −0.8000000 |
| 2.798753 | 0.8254657 | 0.0000000E+00 | −0.8000000 |
| 2.852428 | 0.8146650 | 0.0000000E+00 | −0.8000000 |
| 2.905309 | 0.8038510 | 0.0000000E+00 | −0.8000000 |
| 2.957396 | 0.7930219 | 0.0000000E+00 | −0.8000000 |
| 3.008698 | 0.7821763 | 0.0000000E+00 | −0.8000000 |
| 3.059215 | 0.7713152 | 0.0000000E+00 | −0.8000000 |
| 3.108953 | 0.7604378 | 0.0000000E+00 | −0.8000000 |
| 3.157912 | 0.7495444 | 0.0000000E+00 | −0.8000000 |
| 3.206097 | 0.7386346 | 0.0000000E+00 | −0.8000000 |
| 3.253514 | 0.7277098 | 0.0000000E+00 | −0.8000000 |
| 3.300163 | 0.7167687 | 0.0000000E+00 | −0.8000000 |
| 3.346048 | 0.7058118 | 0.0000000E+00 | −0.8000000 |
| 3.391173 | 0.6948378 | 0.0000000E+00 | −0.8000000 |
| 3.435541 | 0.6838474 | 0.0000000E+00 | −0.8000000 |
| 3.479154 | 0.6728390 | 0.0000000E+00 | −0.8000000 |
| 3.522004 | 0.6614068 | 0.0000000E+00 | −0.8000000 |
| 3.564073 | 0.6496811 | 0.0000000E+00 | −0.8000000 |
| 3.605354 | 0.6379321 | 0.0000000E+00 | −0.8000000 |
| 3.645854 | 0.6261651 | 0.0000000E+00 | −0.8000000 |
| 3.685571 | 0.6143809 | 0.0000000E+00 | −0.8000000 |

TABLE 3.1-continued

| | | | |
|---|---|---|---|
| 3.724512 | 0.6025827 | 0.0000000E+00 | −0.8000000 |
| 3.762677 | 0.5907704 | 0.0000000E+00 | −0.8000000 |
| 3.800072 | 0.5789457 | 0.0000000E+00 | −0.8000000 |
| 3.836696 | 0.5671085 | 0.0000000E+00 | −0.8000000 |
| 3.872556 | 0.5552604 | 0.0000000E+00 | −0.8000000 |

TABLE 3.2

| | | | |
|---|---|---|---|
| 3.907655 | 0.5434052 | 0.0000000E+00 | −0.8000000 |
| 3.941993 | 0.5315396 | 0.0000000E+00 | −0.8000000 |
| 3.975575 | 0.5196669 | 0.0000000E+00 | −0.8000000 |
| 4.008404 | 0.5077910 | 0.0000000E+00 | −0.8000000 |
| 4.040482 | 0.4959071 | 0.0000000E+00 | −0.8000000 |
| 4.071813 | 0.4840214 | 0.0000000E+00 | −0.8000000 |
| 4.102400 | 0.4721371 | 0.0000000E+00 | −0.8000000 |
| 4.132247 | 0.4602543 | 0.0000000E+00 | −0.8000000 |
| 4.161355 | 0.4483750 | 0.0000000E+00 | −0.8000000 |
| 4.189729 | 0.4364989 | 0.0000000E+00 | −0.8000000 |
| 4.217372 | 0.4246299 | 0.0000000E+00 | −0.8000000 |
| 4.244287 | 0.4127684 | 0.0000000E+00 | −0.8000000 |
| 4.270477 | 0.4009196 | 0.0000000E+00 | −0.8000000 |
| 4.295947 | 0.3890818 | 0.0000000E+00 | −0.8000000 |
| 4.320699 | 0.3772583 | 0.0000000E+00 | −0.8000000 |
| 4.344735 | 0.3654509 | 0.0000000E+00 | −0.8000000 |
| 4.368062 | 0.3536639 | 0.0000000E+00 | −0.8000000 |
| 4.390681 | 0.3419012 | 0.0000000E+00 | −0.8000000 |
| 4.412597 | 0.3301641 | 0.0000000E+00 | −0.8000000 |
| 4.433813 | 0.3184554 | 0.0000000E+00 | −0.8000000 |
| 4.454334 | 0.3067786 | 0.0000000E+00 | −0.8000000 |
| 4.474162 | 0.2951317 | 0.0000000E+00 | −0.8000000 |
| 4.493303 | 0.2835223 | 0.0000000E+00 | −0.8000000 |
| 4.511761 | 0.2719530 | 0.0000000E+00 | −0.8000000 |
| 4.529538 | 0.2604267 | 0.0000000E+00 | −0.8000000 |
| 4.546641 | 0.2489453 | 0.0000000E+00 | −0.8000000 |
| 4.563074 | 0.2375086 | 0.0000000E+00 | −0.8000000 |
| 4.578839 | 0.2261211 | 0.0000000E+00 | −0.8000000 |
| 4.593944 | 0.2147837 | 0.0000000E+00 | −0.8000000 |
| 4.608391 | 0.2035037 | 0.0000000E+00 | −0.8000000 |
| 4.622185 | 0.1922801 | 0.0000000E+00 | −0.8000000 |
| 4.635331 | 0.1811257 | 0.0000000E+00 | −0.8000000 |
| 4.647835 | 0.1700397 | 0.0000000E+00 | −0.8000000 |
| 4.659702 | 0.1590218 | 0.0000000E+00 | −0.8000000 |
| 4.670936 | 0.1480701 | 0.0000000E+00 | −0.8000000 |
| 4.681543 | 0.1371804 | 0.0000000E+00 | −0.8000000 |
| 4.691526 | 0.1263494 | 0.0000000E+00 | −0.8000000 |
| 4.700891 | 0.1155722 | 0.0000000E+00 | −0.8000000 |
| 4.709641 | 0.1048450 | 0.0000000E+00 | −0.8000000 |
| 4.717778 | 9.4164133E−02 | 0.0000000E+00 | −0.8000000 |
| 4.725308 | 8.3525240E−02 | 0.0000000E+00 | −0.8000000 |
| 4.732232 | 7.2923653E−02 | 0.0000000E+00 | −0.8000000 |
| 4.738556 | 6.2357269E−02 | 0.0000000E+00 | −0.8000000 |
| 4.744277 | 5.1821385E−02 | 0.0000000E+00 | −0.8000000 |
| 4.749400 | 4.1312072E−02 | 0.0000000E+00 | −0.8000000 |
| 4.753928 | 3.0826291E−02 | 0.0000000E+00 | −0.8000000 |
| 4.757862 | 2.0361101E−02 | 0.0000000E+00 | −0.8000000 |
| 4.761202 | 9.9128205E−03 | 0.0000000E+00 | −0.8000000 |
| 4.763951 | 0.0000000E+00 | 0.0000000E+00 | −0.8000000 |
| 7.800000 | 0.0000000E+00 | 0.0000000E+00 | −0.8000000 |

TABLE 4.1

| | | | | |
|---|---|---|---|---|
| 175 | | | | |
| −1.0000000E+00 | 0.0 | −1.057697 | 0.0000000E+00 | 0.8000000 |
| 0.0000000E+00 | 0.0 | −1.057697 | 0.0000000E+00 | 0.8000000 |
| 4.102004 | 0.0000000E+00 | −4.148945 | 4.902004 | |
| 4.124434 | 7.5165126E−03 | −4.172558 | 4.924435 | |
| 4.146324 | 1.5395834E−02 | −4.195659 | 4.946324 | |
| 4.167700 | 2.3687208E−02 | −4.218267 | 4.967700 | |
| 4.188581 | 3.2456566E−02 | −4.240403 | 4.988581 | |
| 4.208988 | 4.1823525E−02 | −4.262086 | 5.008988 | |
| 4.228943 | 5.1778372E−02 | −4.283338 | 5.028943 | |
| 4.248466 | 6.2370304E−02 | −4.304178 | 5.048467 | |
| 4.267582 | 7.3725037E−02 | −4.324625 | 5.067582 | |
| 4.286306 | 8.5960262E−02 | −4.344701 | 5.086307 | |

TABLE 4.1-continued

| | | | |
|---|---|---|---|
| 4.304664 | 9.9147059E−02 | −4.364424 | 5.104664 |
| 4.322675 | 0.1134252 | −4.383814 | 5.122675 |
| 4.340361 | 0.1290231 | −4.402894 | 5.140361 |
| 4.357744 | 0.1461041 | −4.421682 | 5.157744 |
| 4.374850 | 0.1648802 | −4.440202 | 5.174850 |
| 4.391703 | 0.1856409 | −4.458474 | 5.191703 |
| 4.408321 | 0.2083413 | −4.476517 | 5.208322 |
| 4.424724 | 0.2335584 | −4.494348 | 5.224724 |
| 4.440928 | 0.2617374 | −4.511982 | 5.240928 |
| 4.456945 | 0.2935334 | −4.529437 | 5.256946 |
| 4.472798 | 0.3298665 | −4.546726 | 5.272799 |
| 4.488500 | 0.3719839 | −4.563867 | 5.288500 |
| 4.504067 | 0.4216233 | −4.580874 | 5.304068 |
| 4.519519 | 0.4814890 | −4.597763 | 5.319519 |
| 4.534875 | 0.5645148 | −4.614552 | 5.334875 |
| 4.550135 | 0.5730968 | −4.631256 | 5.350135 |
| 4.565312 | 0.5819987 | −4.647871 | 5.365313 |
| 4.580406 | 0.5911774 | −4.664399 | 5.380406 |
| 4.595414 | 0.6006702 | −4.680839 | 5.395414 |
| 4.610336 | 0.6105203 | −4.697188 | 5.410336 |
| 4.625172 | 0.6207827 | −4.713449 | 5.425172 |
| 4.639920 | 0.6315119 | −4.729618 | 5.439920 |
| 4.654583 | 0.6427865 | −4.745697 | 5.454583 |
| 4.669158 | 0.6547033 | −4.761683 | 5.469158 |
| 4.683643 | 0.6675034 | −4.777578 | 5.483644 |
| 4.698042 | 0.6814049 | −4.793379 | 5.498042 |
| 4.712351 | 0.6967719 | −4.809087 | 5.512351 |
| 4.726571 | 0.7142264 | −4.824701 | 5.526571 |
| 4.740701 | 0.7351209 | −4.840221 | 5.540701 |
| 4.754742 | 0.7625305 | −4.855646 | 5.554742 |
| 4.768691 | 0.7888100 | −4.870975 | 5.568691 |
| 4.782552 | 0.7863806 | −4.886209 | 5.582552 |
| 4.796321 | 0.7839052 | −4.901346 | 5.596321 |
| 4.809999 | 0.7813838 | −4.916386 | 5.609999 |
| 4.823585 | 0.7788160 | −4.931329 | 5.623585 |
| 4.837078 | 0.7762013 | −4.946175 | 5.637078 |
| 4.850480 | 0.7735409 | −4.960922 | 5.650480 |
| 4.863790 | 0.7708337 | −4.975571 | 5.663790 |
| 4.877007 | 0.7680807 | −4.990121 | 5.677007 |
| 4.890130 | 0.7652809 | −5.004572 | 5.690130 |

TABLE 4.2

| | | | |
|---|---|---|---|
| 4.903161 | 0.7624352 | −5.018924 | 5.703161 |
| 4.916099 | 0.7595432 | −5.033176 | 5.716099 |
| 4.928943 | 0.7566041 | −5.047328 | 5.728943 |
| 4.941692 | 0.7536188 | −5.061378 | 5.741693 |
| 4.954348 | 0.7505875 | −5.075329 | 5.754348 |
| 4.966908 | 0.7475097 | −5.089178 | 5.766909 |
| 4.979375 | 0.7443847 | −5.102926 | 5.779375 |
| 4.991747 | 0.7412136 | −5.116572 | 5.791747 |
| 5.004024 | 0.7379950 | −5.130116 | 5.804024 |
| 5.016206 | 0.7347298 | −5.143558 | 5.816206 |
| 5.028294 | 0.7314178 | −5.156898 | 5.828294 |
| 5.040284 | 0.7280592 | −5.170135 | 5.840284 |
| 5.052180 | 0.7246527 | −5.183269 | 5.852180 |
| 5.063980 | 0.7211998 | −5.196300 | 5.863980 |
| 5.075685 | 0.7176988 | −5.209227 | 5.875685 |
| 5.087292 | 0.7141504 | −5.222051 | 5.887292 |
| 5.098804 | 0.7105551 | −5.234771 | 5.898805 |
| 5.110220 | 0.7069119 | −5.247387 | 5.910220 |
| 5.121539 | 0.7032204 | −5.259899 | 5.921539 |
| 5.132761 | 0.6994810 | −5.272306 | 5.932761 |
| 5.143888 | 0.6956941 | −5.284609 | 5.943888 |
| 5.154916 | 0.6918588 | −5.296807 | 5.954916 |
| 5.165848 | 0.6879748 | −5.308900 | 5.965848 |
| 5.176682 | 0.6840428 | −5.320889 | 5.976683 |
| 5.187421 | 0.6800618 | −5.332771 | 5.987421 |
| 5.198060 | 0.6760318 | −5.344549 | 5.998060 |
| 5.208604 | 0.6719536 | −5.356221 | 6.008604 |
| 5.219049 | 0.6678264 | −5.367788 | 6.019050 |
| 5.229398 | 0.6636494 | −5.379249 | 6.029398 |
| 5.239649 | 0.6594236 | −5.390604 | 6.039649 |
| 5.249802 | 0.6551480 | −5.401853 | 6.049802 |
| 5.259857 | 0.6506745 | −5.412994 | 6.059857 |
| 5.269811 | 0.6461316 | −5.424028 | 6.069811 |
| 5.279665 | 0.6415369 | −5.434953 | 6.079665 |
| 5.279665 | 0.6415369 | −5.434953 | 6.079663 |
| 5.289419 | 0.6368909 | −5.445768 | 6.089419 |
| 5.299074 | 0.6321936 | −5.456475 | 6.099074 |
| 5.308627 | 0.6274447 | −5.467073 | 6.108627 |

TABLE 4.2-continued

| | | | |
|---|---|---|---|
| 5.318081 | 0.6226439 | −5.477562 | 6.118081 |
| 5.327434 | 0.6177914 | −5.487942 | 6.127434 |
| 5.336687 | 0.6128870 | −5.498213 | 6.136687 |
| 5.345839 | 0.6079304 | −5.508374 | 6.145839 |
| 5.354889 | 0.6029212 | −5.518426 | 6.154889 |
| 5.363839 | 0.5978610 | −5.528369 | 6.163839 |
| 5.372691 | 0.5927479 | −5.538202 | 6.172691 |
| 5.381442 | 0.5875819 | −5.547926 | 6.181442 |
| 5.390091 | 0.5823646 | −5.557540 | 6.190091 |
| 5.398639 | 0.5770949 | −5.567045 | 6.198639 |
| 5.407088 | 0.5717717 | −5.576440 | 6.207088 |
| 5.415436 | 0.5663966 | −5.585725 | 6.215436 |
| 5.423683 | 0.5609694 | −5.594901 | 6.223683 |
| 5.431829 | 0.5554887 | −5.603967 | 6.231830 |
| 5.439876 | 0.5499563 | −5.612923 | 6.239876 |
| 5.447821 | 0.5443711 | −5.621769 | 6.247821 |

TABLE 4.3

| | | | |
|---|---|---|---|
| 5.455667 | 0.5387336 | −5.630506 | 6.255667 |
| 5.463410 | 0.5330437 | −5.639133 | 6.263411 |
| 5.471054 | 0.5273016 | −5.647650 | 6.271054 |
| 5.478599 | 0.5215071 | −5.656057 | 6.278599 |
| 5.486041 | 0.5156605 | −5.664354 | 6.286041 |
| 5.493383 | 0.5097619 | −5.672542 | 6.293384 |
| 5.500626 | 0.5038114 | −5.680619 | 6.300626 |
| 5.507768 | 0.4978091 | −5.688587 | 6.307768 |
| 5.514810 | 0.4917553 | −5.696445 | 6.314810 |
| 5.521751 | 0.4856501 | −5.704193 | 6.321752 |
| 5.528591 | 0.4794935 | −5.711832 | 6.328591 |
| 5.535334 | 0.4732860 | −5.719360 | 6.335334 |
| 5.541973 | 0.4670278 | −5.726779 | 6.341973 |
| 5.548512 | 0.4607189 | −5.734087 | 6.348513 |
| 5.554954 | 0.4543600 | −5.741287 | 6.354954 |
| 5.561296 | 0.4479508 | −5.748376 | 6.361296 |
| 5.567534 | 0.4414923 | −5.755355 | 6.367535 |
| 5.573675 | 0.4349844 | −5.762225 | 6.373675 |
| 5.579715 | 0.4284276 | −5.768985 | 6.379715 |
| 5.585656 | 0.4218221 | −5.775636 | 6.385656 |
| 5.591497 | 0.4151680 | −5.782177 | 6.391498 |
| 5.597239 | 0.4084676 | −5.788609 | 6.397239 |
| 5.602880 | 0.4017200 | −5.794930 | 6.402881 |
| 5.608422 | 0.3949243 | −5.801143 | 6.408422 |
| 5.613866 | 0.3880831 | −5.807246 | 6.413866 |
| 5.619209 | 0.3811967 | −5.813240 | 6.419209 |
| 5.624454 | 0.3742642 | −5.819125 | 6.424454 |
| 5.629598 | 0.3672876 | −5.824900 | 6.429598 |
| 5.634644 | 0.3602673 | −5.830566 | 6.434644 |
| 5.639591 | 0.3532037 | −5.836123 | 6.439591 |
| 5.644439 | 0.3460975 | −5.841571 | 6.444439 |
| 5.649188 | 0.3389492 | −5.846910 | 6.449188 |
| 5.653838 | 0.3317598 | −5.852140 | 6.453838 |
| 5.658389 | 0.3245301 | −5.857261 | 6.458389 |
| 5.662842 | 0.3172601 | −5.862274 | 6.462842 |
| 5.667197 | 0.3099524 | −5.867177 | 6.467197 |
| 5.671453 | 0.3026066 | −5.871973 | 6.471454 |
| 5.675611 | 0.2952224 | −5.876659 | 6.475612 |
| 5.679671 | 0.2878024 | −5.881237 | 6.479671 |
| 5.683633 | 0.2803468 | −5.885707 | 6.483633 |
| 5.687497 | 0.2728565 | −5.890069 | 6.487497 |
| 5.691264 | 0.2653325 | −5.894322 | 6.491264 |
| 5.694932 | 0.2577755 | −5.898467 | 6.494932 |
| 5.698503 | 0.2501863 | −5.902504 | 6.498504 |
| 5.701977 | 0.2425659 | −5.906434 | 6.501977 |
| 5.705355 | 0.2349149 | −5.910256 | 6.505355 |
| 5.708633 | 0.2272340 | −5.913970 | 6.508634 |
| 5.711816 | 0.2195240 | −5.917577 | 6.511816 |
| 5.714901 | 0.2117851 | −5.921076 | 6.514901 |
| 5.717891 | 0.2040171 | −5.924469 | 6.517891 |
| 5.720783 | 0.1962218 | −5.927753 | 6.520783 |
| 5.723580 | 0.1883974 | −5.930932 | 6.523581 |
| 5.726279 | 0.1805417 | −5.934003 | 6.526279 |

TABLE 4.4

| | | | |
|---|---|---|---|
| 5.728883 | 0.1726547 | −5.936967 | 6.528883 |
| 5.731391 | 0.1647332 | −5.939825 | 6.531391 |
| 5.733804 | 0.1567701 | −5.942576 | 6.533804 |
| 5.736119 | 0.1487590 | −5.945220 | 6.536119 |
| 5.738339 | 0.1406854 | −5.947758 | 6.538340 |

TABLE 4.4-continued

| | | | |
|---|---|---|---|
| 5.740462 | 0.1325258 | −5.950189 | 6.540462 |
| 5.742491 | 0.1242374 | −5.952513 | 6.542491 |
| 5.744420 | 0.1157338 | −5.954730 | 6.544420 |
| 5.746252 | 0.1068154 | −5.956837 | 6.546252 |
| 5.747664 | 7.1621984E−02 | −5.958584 | 6.547665 |
| 5.748933 | 5.8495335E−02 | −5.960172 | 6.548933 |

TABLE 4.4-continued

| | | | |
|---|---|---|---|
| 5.750051 | 4.5882042E−02 | −5.961608 | 6.550051 |
| 5.751024 | 3.3621687E−02 | −5.962897 | 6.551024 |
| 5.751854 | 2.1621225E−02 | −5.964041 | 6.551854 |
| 5.752546 | 9.8252241E−03 | −5.965043 | 6.552547 |
| 5.753103 | 0.0 | | |
| 7.0 | 0.0 | | |

TABLE 5.1

| | | | | |
|---|---|---|---|---|
| 1.0000000E+00 | 0.0000000E+00 | 0.0000000E+00 | 0.0000000E+00 | 0.0000000E+00 |
| 0.0000000E+00 | 0.0000000E+00 | 0.0000000E+00 | 0.0000000E+00 | 0.0000000E+00 |
| −3.5704297E−03 | 8.3244095E−06 | 0.1674310 | 0.0000000E+00 | 8.6834490E−02 |
| −1.4932416E−02 | 4.3696153E−05 | 0.1841606 | 0.0000000E+00 | 1.1518633E−02 |
| −3.5885897E−02 | 1.1213515E−04 | 0.1899721 | 0.0000000E+00 | 4.5756041E−03 |
| −6.7924976E−02 | 2.2034568E−04 | 0.1971494 | 0.0000000E+00 | 4.0169014E−03 |
| −0.1109685 | 3.7251806E−04 | 0.2099580 | 0.0000000E+00 | 8.6186277E−03 |
| −0.1634544 | 6.3164369E−04 | 0.3800094 | 0.0000000E+00 | 7.6783627E−02 |
| −0.2228303 | 1.2062216E−03 | 0.7308369 | 0.0000000E+00 | 0.1041230 |
| −0.2869636 | 2.2549042E−03 | 1.13383 | 0.0000000E+00 | 0.1052306 |
| −0.3541118 | 3.8504284E−03 | 1.574254 | 0.0000000E+00 | 0.1051424 |
| −0.4232292 | 5.9886868E−03 | 1.959915 | 0.0000000E+00 | 9.0383865E−02 |
| −0.4935006 | 8.6432789E−03 | 2.355692 | 0.0000000E+00 | 9.0458959E−02 |
| −0.5637445 | 1.1766551E−02 | 2.725955 | 0.0000000E+00 | 8.4948830E−02 |
| −0.6335507 | 1.5288736E−02 | 3.043031 | 0.0000000E+00 | 7.3744558E−02 |
| −0.7029095 | 1.9146206E−02 | 3.317888 | 0.0000000E+00 | 6.5248840E−02 |
| −0.7717823 | 2.3291418E−02 | 3.565840 | 0.0000000E+00 | 5.9523795E−02 |
| −0.8401089 | 2.7684886E−02 | 3.788318 | 0.0000000E+00 | 5.4053593E−02 |
| −0.9078820 | 3.2292500E−02 | 3.986916 | 0.0000000E+00 | 4.8835676E−02 |
| −0.9751166 | 3.7085511E−02 | 4.165398 | 0.0000000E+00 | 4.4404998E−02 |
| −1.041774 | 4.2040113E−02 | 4.333901 | 0.0000000E+00 | 4.2416457E−02 |
| −1.107795 | 4.7135282E−02 | 4.490047 | 0.0000000E+00 | 3.9809976E−02 |
| −1.173172 | 5.2352011E−02 | 4.632472 | 0.0000000E+00 | 3.6782403E−02 |
| −1.237922 | 5.7673849E−02 | 4.763078 | 0.0000000E+00 | 3.4155738E−02 |
| −1.302061 | 6.3086770E−02 | 4.883511 | 0.0000000E+00 | 3.1968132E−02 |
| −1.365602 | 6.8579562E−02 | 4.996962 | 0.0000000E+00 | 3.0850388E−02 |
| −1.428558 | 7.4144699E−02 | 5.105991 | 0.0000000E+00 | 3.0095341E−02 |
| −1.490890 | 7.9776704E−02 | 5.219314 | 0.0000000E+00 | 3.1586748E−02 |
| −1.552559 | 8.5470237E−02 | 5.330114 | 0.0000000E+00 | 3.1476215E−02 |
| −1.613569 | 9.1220804E−02 | 5.438952 | 0.0000000E+00 | 3.1404216E−02 |
| −1.673929 | 9.7025134E−02 | 5.546644 | 0.0000000E+00 | 3.1461231E−02 |
| −1.733647 | 0.1028805 | 5.653447 | 0.0000000E+00 | 3.1577103E−02 |
| −1.792730 | 0.1087846 | 5.759626 | 0.0000000E+00 | 3.1875271E−02 |
| −1.851176 | 0.1147358 | 5.868659 | 0.0000000E+00 | 3.3242926E−02 |
| −1.908954 | 0.1207333 | 5.984429 | 0.0000000E+00 | 3.5752531E−02 |
| −1.966043 | 0.1267768 | 6.101442 | 0.0000000E+00 | 3.6601558E−02 |
| −2.022452 | 0.1328652 | 6.219788 | 0.0000000E+00 | 3.7494771E−02 |
| −2.078186 | 0.1389981 | 6.339553 | 0.0000000E+00 | 3.8433917E−02 |
| −2.133252 | 0.1451747 | 6.460821 | 0.0000000E+00 | 3.9418448E−02 |
| −2.187657 | 0.1513945 | 6.583677 | 0.0000000E+00 | 4.0449996E−02 |
| −2.241407 | 0.1576571 | 6.708256 | 0.0000000E+00 | 4.1636456E−02 |
| −2.294508 | 0.1639622 | 6.835520 | 0.0000000E+00 | 4.3214798E−02 |
| −2.346965 | 0.1703106 | 6.966019 | 0.0000000E+00 | 4.4903845E−02 |
| −2.398783 | 0.1767029 | 7.099882 | 0.0000000E+00 | 4.6657074E−02 |
| −2.449965 | 0.1831398 | 7.237181 | 0.0000000E+00 | 4.8478406E−02 |
| −2.500517 | 0.1896220 | 7.377980 | 0.0000000E+00 | 5.0368331E−02 |
| −2.550442 | 0.1961502 | 7.522369 | 0.0000000E+00 | 5.2334573E−02 |
| −2.599745 | 0.2027252 | 7.670446 | 0.0000000E+00 | 5.4407306E−02 |
| −2.648431 | 0.2093475 | 7.822538 | 0.0000000E+00 | 5.6680486E−02 |
| −2.696502 | 0.2160183 | 7.979294 | 0.0000000E+00 | 5.9355419E−02 |
| −2.743963 | 0.2227388 | 8.141224 | 0.0000000E+00 | 6.2153094E−02 |
| −2.790803 | 0.2295106 | 8.312848 | 0.0000000E+00 | 6.6762939E−02 |
| −2.837005 | 0.2363349 | 8.492768 | 0.0000000E+00 | 7.1002141E−02 |

TABLE 5.2

| | | | | |
|---|---|---|---|---|
| −2.882564 | 0.2432127 | 8.678021 | 0.0000000E+00 | 7.4209087E−02 |
| −2.927484 | 0.2501449 | 8.868761 | 0.0000000E+00 | 7.7572688E−02 |
| −2.971770 | 0.2571324 | 9.065155 | 0.0000000E+00 | 8.1110306E−02 |
| −3.015425 | 0.2641760 | 9.267386 | 0.0000000E+00 | 8.4839061E−02 |
| −3.058452 | 0.2712766 | 9.475646 | 0.0000000E+00 | 8.8761605E−02 |
| −3.100857 | 0.2784351 | 9.690118 | 0.0000000E+00 | 9.2885643E−02 |
| −3.142641 | 0.2856525 | 9.911029 | 0.0000000E+00 | 9.7227745E−02 |
| −3.183810 | 0.2929294 | 10.13860 | 0.0000000E+00 | 0.1018042 |
| −3.224367 | 0.3002670 | 10.37305 | 0.0000000E+00 | 0.1066312 |
| −3.264316 | 0.3076659 | 10.61462 | 0.0000000E+00 | 0.1117381 |
| −3.303659 | 0.3151272 | 10.86354 | 0.0000000E+00 | 0.1171284 |
| −3.342402 | 0.3226516 | 11.12008 | 0.0000000E+00 | 0.1228177 |
| −3.380548 | 0.3302402 | 11.38452 | 0.0000000E+00 | 0.1288294 |
| −3.418100 | 0.3378938 | 11.65714 | 0.0000000E+00 | 0.1351817 |
| −3.455062 | 0.3456132 | 11.93823 | 0.0000000E+00 | 0.1419259 |

TABLE 5.2-continued

| | | | | |
|---|---|---|---|---|
| −3.491437 | 0.3533996 | 12.22811 | 0.0000000E+00 | 0.1490768 |
| −3.527230 | 0.3612537 | 12.52719 | 0.0000000E+00 | 0.1568507 |
| −3.562443 | 0.3691767 | 12.83633 | 0.0000000E+00 | 0.1653148 |
| −3.597079 | 0.3771698 | 13.15631 | 0.0000000E+00 | 0.1744635 |
| −3.631140 | 0.3852347 | 13.48765 | 0.0000000E+00 | 0.1842310 |
| −3.664631 | 0.3933727 | 13.83078 | 0.0000000E+00 | 0.1946681 |
| −3.697552 | 0.4015852 | 14.18619 | 0.0000000E+00 | 0.2058053 |
| −3.729908 | 0.4098738 | 14.55437 | 0.0000000E+00 | 0.2176912 |
| −3.761699 | 0.4182400 | 14.93587 | 0.0000000E+00 | 0.2303870 |
| −3.792929 | 0.4266852 | 15.33123 | 0.0000000E+00 | 0.2439988 |
| −3.823601 | 0.4352110 | 15.74103 | 0.0000000E+00 | 0.2586228 |
| −3.853717 | 0.4438190 | 16.16584 | 0.0000000E+00 | 0.2742925 |
| −3.883279 | 0.4525107 | 16.60633 | 0.0000000E+00 | 0.2911108 |
| −3.912289 | 0.4612877 | 17.06318 | 0.0000000E+00 | 0.3091656 |
| −3.940752 | 0.4701516 | 17.53706 | 0.0000000E+00 | 0.3286582 |
| −3.968668 | 0.4791041 | 18.02872 | 0.0000000E+00 | 0.3496960 |
| −3.996040 | 0.4881469 | 18.53943 | 0.0000000E+00 | 0.3732518 |
| −4.022870 | 0.4972820 | 19.07087 | 0.0000000E+00 | 0.3988177 |
| −4.049159 | 0.5065117 | 19.62401 | 0.0000000E+00 | 0.4265805 |
| −4.074910 | 0.5158380 | 20.19984 | 0.0000000E+00 | 0.4569118 |
| −4.100123 | 0.5252634 | 20.79943 | 0.0000000E+00 | 0.4899313 |
| −4.124801 | 0.5347900 | 21.42399 | 0.0000000E+00 | 0.5259587 |
| −4.148945 | 0.5444205 | 22.07476 | 0.0000000E+00 | 0.5653435 |
| −4.172558 | 0.5541550 | 22.73156 | 0.0000000E+00 | 0.5704826 |
| −4.195659 | 0.5639858 | 23.37232 | 0.0000000E+00 | 0.5731761 |
| −4.218267 | 0.5739028 | 23.99483 | 0.0000000E+00 | 0.5729105 |
| −4.240403 | 0.5838960 | 24.59655 | 0.0000000E+00 | 0.5691178 |
| −4.262087 | 0.5939553 | 25.17450 | 0.0000000E+00 | 0.5612221 |
| −4.283340 | 0.6040705 | 25.72698 | 0.0000000E+00 | 0.5520959 |
| −4.304180 | 0.6142315 | 26.25338 | 0.0000000E+00 | 0.5390363 |
| −4.324629 | 0.6244286 | 26.75086 | 0.0000000E+00 | 0.5210612 |
| −4.344705 | 0.6346517 | 27.21624 | 0.0000000E+00 | 0.4976775 |
| −4.364429 | 0.6448904 | 27.64621 | 0.0000000E+00 | 0.4683522 |
| −4.383821 | 0.6551341 | 28.03765 | 0.0000000E+00 | 0.4326746 |
| −4.402902 | 0.6653718 | 28.38703 | 0.0000000E+00 | 0.3902606 |
| −4.421692 | 0.6755922 | 28.69075 | 0.0000000E+00 | 0.3409378 |
| −4.440213 | 0.6857837 | 28.94543 | 0.0000000E+00 | 0.2846863 |
| −4.458487 | 0.6959344 | 29.14820 | 0.0000000E+00 | 0.2216208 |

TABLE 5.3

| | | | | |
|---|---|---|---|---|
| −4.476532 | 0.7060357 | 29.31682 | 0.0000000E+00 | 0.1518268 |
| −4.494365 | 0.7160827 | 29.45459 | 0.0000000E+00 | 7.5847223E−02 |
| −4.512001 | 0.7260705 | 29.56060 | 0.0000000E+00 | −5.9956508E−03 |
| −4.529456 | 0.7359943 | 29.63408 | 0.0000000E+00 | −9.3253933E−02 |
| −4.546746 | 0.7458493 | 29.67421 | 0.0000000E+00 | −0.1852967 |
| −4.563887 | 0.7556304 | 29.68017 | 0.0000000E+00 | −0.2813488 |
| −4.580893 | 0.7653329 | 29.65123 | 0.0000000E+00 | −0.3804579 |
| −4.597781 | 0.7749518 | 29.58662 | 0.0000000E+00 | −0.4816123 |
| −4.614566 | 0.7844822 | 29.48491 | 0.0000000E+00 | −0.5839424 |
| −4.631261 | 0.7939202 | 29.37258 | 0.0000000E+00 | −0.5774940 |
| −4.647868 | 0.8032656 | 29.26228 | 0.0000000E+00 | −0.5704675 |
| −4.664387 | 0.8125194 | 29.15387 | 0.0000000E+00 | −0.5636431 |
| −4.680816 | 0.8216825 | 29.04735 | 0.0000000E+00 | −0.5569660 |
| −4.697155 | 0.8307557 | 28.94268 | 0.0000000E+00 | −0.5504304 |
| −4.713404 | 0.8397400 | 28.83983 | 0.0000000E+00 | −0.5440625 |
| −4.729562 | 0.8486362 | 28.73876 | 0.0000000E+00 | −0.5378585 |
| −4.745628 | 0.8574450 | 28.63946 | 0.0000000E+00 | −0.5317617 |
| −4.761602 | 0.8661674 | 28.54189 | 0.0000000E+00 | −0.5258374 |
| −4.777483 | 0.8748041 | 28.44606 | 0.0000000E+00 | −0.5200351 |
| −4.793271 | 0.8833559 | 28.35190 | 0.0000000E+00 | −0.5143393 |
| −4.808965 | 0.8918237 | 28.25941 | 0.0000000E+00 | −0.5087974 |
| −4.824564 | 0.9002082 | 28.16851 | 0.0000000E+00 | −0.5033960 |
| −4.840069 | 0.9085101 | 28.07918 | 0.0000000E+00 | −0.4980925 |
| −4.855479 | 0.9167302 | 27.99125 | 0.0000000E+00 | −0.4929546 |
| −4.870792 | 0.9248693 | 27.90728 | 0.0000000E+00 | −0.4872006 |
| −4.886009 | 0.9329282 | 27.82289 | 0.0000000E+00 | −0.4829326 |
| −4.901129 | 0.9409075 | 27.74005 | 0.0000000E+00 | −0.4780694 |
| −4.916152 | 0.9488080 | 27.65873 | 0.0000000E+00 | −0.4733257 |
| −4.931078 | 0.9566302 | 27.57891 | 0.0000000E+00 | −0.4686628 |
| −4.945906 | 0.9643748 | 27.50059 | 0.0000000E+00 | −0.4640783 |
| −4.960635 | 0.9720426 | 27.42372 | 0.0000000E+00 | −0.4596237 |
| −4.975266 | 0.9796342 | 27.34831 | 0.0000000E+00 | −0.4552219 |
| −4.989798 | 0.9871503 | 27.27432 | 0.0000000E+00 | −0.4509473 |
| −5.004230 | 0.9945914 | 27.20175 | 0.0000000E+00 | −0.4467189 |
| −5.018563 | 1.001958 | 27.13057 | 0.0000000E+00 | −0.4426112 |
| −5.032796 | 1.009251 | 27.06077 | 0.0000000E+00 | −0.4385654 |
| −5.046929 | 1.016472 | 26.99234 | 0.0000000E+00 | −0.4345767 |
| −5.060961 | 1.023619 | 26.92526 | 0.0000000E+00 | −0.4306833 |
| −5.074892 | 1.030695 | 26.85950 | 0.0000000E+00 | −0.4268841 |
| −5.088722 | 1.037700 | 26.79505 | 0.0000000E+00 | −0.4231338 |

TABLE 5.3-continued

| | | | | |
|---|---|---|---|---|
| −5.102450 | 1.044633 | 26.73191 | 0.0000000E+00 | −0.4194322 |
| −5.116077 | 1.051497 | 26.67005 | 0.0000000E+00 | −0.4158379 |
| −5.129601 | 1.058291 | 26.60947 | 0.0000000E+00 | −0.4122671 |
| −5.143024 | 1.065016 | 26.55016 | 0.0000000E+00 | −0.4087794 |
| −5.156344 | 1.071672 | 26.49207 | 0.0000000E+00 | −0.4053725 |
| −5.169561 | 1.078261 | 26.43521 | 0.0000000E+00 | −0.4020027 |
| −5.182676 | 1.084782 | 26.37959 | 0.0000000E+00 | −0.3986662 |
| −5.195687 | 1.091236 | 26.32516 | 0.0000000E+00 | −0.3954290 |
| −5.208595 | 1.097623 | 26.27194 | 0.0000000E+00 | −0.3922006 |
| −5.221399 | 1.103945 | 26.21990 | 0.0000000E+00 | −0.3890430 |
| −5.234100 | 1.110201 | 26.16901 | 0.0000000E+00 | −0.3859587 |
| −5.246696 | 1.116391 | 26.11929 | 0.0000000E+00 | −0.3828973 |
| −5.259189 | 1.122518 | 26.07073 | 0.0000000E+00 | −0.3798579 |

TABLE 5.4

| | | | | |
|---|---|---|---|---|
| −5.271577 | 1.128580 | 26.02331 | 0.0000000E+00 | −0.3768845 |
| −5.283861 | 1.134578 | 25.97699 | 0.0000000E+00 | −0.3739793 |
| −5.296040 | 1.140514 | 25.93180 | 0.0000000E+00 | −0.3710848 |
| −5.308115 | 1.146386 | 25.88773 | 0.0000000E+00 | −0.3682073 |
| −5.320084 | 1.152196 | 25.84474 | 0.0000000E+00 | −0.3654132 |
| −5.331948 | 1.157945 | 25.80286 | 0.0000000E+00 | −0.3626057 |
| −5.343708 | 1.163631 | 25.76206 | 0.0000000E+00 | −0.3598533 |
| −5.355361 | 1.169257 | 25.72231 | 0.0000000E+00 | −0.3571623 |
| −5.366910 | 1.174822 | 25.68363 | 0.0000000E+00 | −0.3544686 |
| −5.378352 | 1.180326 | 25.64603 | 0.0000000E+00 | −0.3517788 |
| −5.389689 | 1.185771 | 25.60945 | 0.0000000E+00 | −0.3491696 |
| −5.400920 | 1.191156 | 25.57393 | 0.0000000E+00 | −0.3465271 |
| −5.412045 | 1.196481 | 25.54382 | 0.0000000E+00 | −0.3355323 |
| −5.423060 | 1.201748 | 25.51526 | 0.0000000E+00 | −0.3320866 |
| −5.433968 | 1.206957 | 25.48786 | 0.0000000E+00 | −0.3295306 |
| −5.444767 | 1.212107 | 25.46155 | 0.0000000E+00 | −0.3270847 |
| −5.455457 | 1.217199 | 25.43637 | 0.0000000E+00 | −0.3246208 |
| −5.466039 | 1.222234 | 25.41229 | 0.0000000E+00 | −0.3221672 |
| −5.476511 | 1.227212 | 25.38933 | 0.0000000E+00 | −0.3197219 |
| −5.486875 | 1.232134 | 25.36748 | 0.0000000E+00 | −0.3172847 |
| −5.497130 | 1.236998 | 25.34673 | 0.0000000E+00 | −0.3148528 |
| −5.507276 | 1.241807 | 25.32709 | 0.0000000E+00 | −0.3124244 |
| −5.517313 | 1.246560 | 25.30858 | 0.0000000E+00 | −0.3099578 |
| −5.527240 | 1.251257 | 25.29114 | 0.0000000E+00 | −0.3076025 |
| −5.537059 | 1.255899 | 25.27483 | 0.0000000E+00 | −0.3051362 |
| −5.546768 | 1.260486 | 25.25964 | 0.0000000E+00 | −0.3026612 |
| −5.556368 | 1.265018 | 25.24552 | 0.0000000E+00 | −0.3002926 |
| −5.565859 | 1.269496 | 25.23252 | 0.0000000E+00 | −0.2978378 |
| −5.575241 | 1.273920 | 25.22066 | 0.0000000E+00 | −0.2952898 |
| −5.584513 | 1.278290 | 25.20991 | 0.0000000E+00 | −0.2928488 |
| −5.593676 | 1.282606 | 25.20026 | 0.0000000E+00 | −0.2903972 |
| −5.602729 | 1.286870 | 25.19177 | 0.0000000E+00 | −0.2877895 |
| −5.611673 | 1.291080 | 25.18439 | 0.0000000E+00 | −0.2852976 |
| −5.620508 | 1.295237 | 25.17814 | 0.0000000E+00 | −0.2827311 |
| −5.629233 | 1.299341 | 25.17304 | 0.0000000E+00 | −0.2801442 |
| −5.637849 | 1.303394 | 25.16908 | 0.0000000E+00 | −0.2775141 |
| −5.646355 | 1.307394 | 25.16628 | 0.0000000E+00 | −0.2748623 |
| −5.654752 | 1.311342 | 25.16463 | 0.0000000E+00 | −0.2721685 |
| −5.663039 | 1.315238 | 25.16416 | 0.0000000E+00 | −0.2694353 |
| −5.671217 | 1.319083 | 25.16488 | 0.0000000E+00 | −0.2666625 |
| −5.679286 | 1.322877 | 25.16678 | 0.0000000E+00 | −0.2638456 |
| −5.687244 | 1.326620 | 25.16988 | 0.0000000E+00 | −0.2609775 |
| −5.695094 | 1.330312 | 25.17420 | 0.0000000E+00 | −0.2580685 |
| −5.702834 | 1.333953 | 25.17974 | 0.0000000E+00 | −0.2550804 |
| −5.710465 | 1.337543 | 25.18653 | 0.0000000E+00 | −0.2520579 |

TABLE 5.4-continued

| | | | | |
|---|---|---|---|---|
| −5.717986 | 1.341084 | 25.19458 | 0.0000000E+00 | −0.2489655 |
| −5.725398 | 1.344574 | 25.20390 | 0.0000000E+00 | −0.2458049 |
| −5.732701 | 1.348014 | 25.21451 | 0.0000000E+00 | −0.2425825 |
| −5.739894 | 1.351405 | 25.22643 | 0.0000000E+00 | −0.2392884 |
| −5.746978 | 1.354745 | 25.23969 | 0.0000000E+00 | −0.2359446 |
| −5.753953 | 1.358037 | 25.25429 | 0.0000000E+00 | −0.2324957 |
| −5.760818 | 1.361279 | 25.27028 | 0.0000000E+00 | −0.2289709 |
| −5.767574 | 1.364472 | 25.28766 | 0.0000000E+00 | −0.2253571 |

TABLE 5.5

| | | | | |
|---|---|---|---|---|
| −5.774221 | 1.367615 | 25.30648 | 0.0000000E+00 | −0.2216822 |
| −5.780760 | 1.370710 | 25.32678 | 0.0000000E+00 | −0.2178419 |
| −5.787189 | 1.373756 | 25.34852 | 0.0000000E+00 | −0.2141866 |
| −5.793509 | 1.376754 | 25.37178 | 0.0000000E+00 | −0.2102601 |
| −5.799720 | 1.379703 | 25.39665 | 0.0000000E+00 | −0.2060806 |
| −5.805823 | 1.382604 | 25.42310 | 0.0000000E+00 | −0.2021061 |
| −5.811816 | 1.385456 | 25.45117 | 0.0000000E+00 | −0.1981003 |
| −5.817701 | 1.388261 | 25.48098 | 0.0000000E+00 | −0.1937122 |
| −5.823477 | 1.391017 | 25.51249 | 0.0000000E+00 | −0.1895715 |
| −5.829144 | 1.393726 | 25.54580 | 0.0000000E+00 | −0.1853276 |
| −5.834703 | 1.396386 | 25.58096 | 0.0000000E+00 | −0.1810680 |
| −5.840154 | 1.398999 | 25.61804 | 0.0000000E+00 | −0.1767929 |
| −5.845496 | 1.401565 | 25.65711 | 0.0000000E+00 | −0.1725833 |
| −5.850730 | 1.404082 | 25.69823 | 0.0000000E+00 | −0.1684862 |
| −5.855855 | 1.406553 | 25.74151 | 0.0000000E+00 | −0.1644871 |
| −5.860873 | 1.408976 | 25.78705 | 0.0000000E+00 | −0.1606068 |
| −5.865782 | 1.411352 | 25.83486 | 0.0000000E+00 | −0.1574685 |
| −5.870584 | 1.413681 | 25.88513 | 0.0000000E+00 | −0.1543865 |
| −5.875277 | 1.415962 | 25.93806 | 0.0000000E+00 | −0.1514768 |
| −5.879863 | 1.418197 | 25.99367 | 0.0000000E+00 | −0.1498647 |
| −5.884341 | 1.420385 | 26.05217 | 0.0000000E+00 | −0.1489142 |
| −5.888711 | 1.422526 | 26.11373 | 0.0000000E+00 | −0.1491590 |
| −5.892974 | 1.424620 | 26.17856 | 0.0000000E+00 | −0.1508744 |
| −5.897130 | 1.426667 | 26.24689 | 0.0000000E+00 | −0.1545835 |
| −5.901178 | 1.428668 | 26.31900 | 0.0000000E+00 | −0.1606915 |
| −5.905120 | 1.430623 | 26.39522 | 0.0000000E+00 | −0.1699711 |
| −5.908954 | 1.432531 | 26.47590 | 0.0000000E+00 | −0.1834360 |
| −5.912682 | 1.434392 | 26.56149 | 0.0000000E+00 | −0.2021620 |
| −5.916302 | 1.436208 | 26.65253 | 0.0000000E+00 | −0.2278197 |
| −5.919816 | 1.437977 | 26.74965 | 0.0000000E+00 | −0.2626066 |
| −5.923224 | 1.439700 | 26.85371 | 0.0000000E+00 | −0.3093497 |
| −5.926525 | 1.441377 | 26.96555 | 0.0000000E+00 | −0.3734396 |
| −5.929720 | 1.443009 | 27.08655 | 0.0000000E+00 | −0.4592334 |

TABLE 6.1

TUBE DYNAMIC AND VERTICAL GROUND REACTION**********

Q.E. = 0.00 (DEGREES) SC (FEEF) = 0.000 DATE 9-NOV-89 TIME 08:17:58

| TIME | RBE | RCE | R2Y | U | Z | VU | VZ | AU | AZ | IMPE E-3 |
|---|---|---|---|---|---|---|---|---|---|---|
| 0.000 | 500. | 7104. | 8129. | 0.000 | 0.000 | 0.00 | 0.00 | 0.00 | 0.00 | 0. |
| 0.001 | 500. | 7104. | 8129. | 0.000 | 0.000 | 0.00 | 0.00 | 0.00 | 0.00 | 0. |
| 0.002 | 500. | 7104. | 8129. | 0.000 | 0.000 | 0.00 | 0.00 | 0.00 | 0.00 | 0. |
| 0.003 | 1727. | 7106. | 9114. | −0.004 | 0.000 | −7.14 | 0.02 | −7129.13 | 23.23 | −939. |
| 0.004 | 6347. | 7112. | 8825. | −0.015 | 0.000 | −15.58 | 0.05 | −8421.17 | 37.75 | −1112. |
| 0.005 | 17182. | 7123. | 7338. | −0.036 | 0.000 | −26.31 | 0.09 | −10689.63 | 39.21 | −1419. |
| 0.006 | 34828. | 7139. | 3901. | −0.068 | 0.000 | −37.74 | 0.13 | −11361.14 | 45.13 | −1524. |
| 0.007 | 56761. | 7162. | 22. | −0.111 | 0.000 | −48.32 | 0.19 | −10487.89 | 105.62 | −1433. |
| 0.008 | 77749. | 7189. | −691. | −0.163 | 0.001 | −56.63 | 0.39 | −8219.05 | 326.10 | −1159. |
| 0.009 | 93349. | 7221. | −652. | −0.223 | 0.001 | −62.11 | 0.80 | −5407.06 | 485.86 | −810. |
| 0.010 | 105776. | 7255. | −136. | −0.287 | 0.002 | −66.16 | 1.33 | −3997.46 | 574.66 | −639. |
| 0.011 | 112149. | 7291. | −883. | −0.354 | 0.004 | −68.15 | 1.87 | −1972.96 | 543.51 | −382. |
| 0.012 | 118531. | 7329. | −88. | −0.423 | 0.006 | −70.10 | 2.41 | −1921.16 | 548.34 | −382. |

TABLE 6.1-continued

TUBE DYNAMIC AND VERTICAL GROUND REACTION**********
Q.E. = 0.00 (DEGREES) SC (FEEF) = 0.000 DATE 9-NOV-89 TIME 08:17:58

| TIME | RBE | RCE | R2Y | U | Z | VU | VZ | AU | AZ | IMPE E-3 |
|---|---|---|---|---|---|---|---|---|---|---|
| 0.013 | 119693. | 7367. | −471. | −0.494 | 0.009 | −70.47 | 2.91 | −364.96 | 487.74 | −180. |
| 0.014 | 118187. | 7406. | −1069. | −0.564 | 0.012 | −70.05 | 3.33 | 414.43 | 400.07 | −76. |
| 0.015 | 116565. | 7446. | −1189. | −0.634 | 0.015 | −69.59 | 3.70 | 454.11 | 334.78 | −68. |
| 0.016 | 115014. | 7485. | −1040. | −0.703 | 0.019 | −69.14 | 4.01 | 439.03 | 290.61 | −68. |
| 0.017 | 113188. | 7524. | −1032. | −0.772 | 0.023 | −68.61 | 4.28 | 526.92 | 249.41 | −55. |
| 0.018 | 111291. | 7564. | −1028. | −0.840 | 0.028 | −68.04 | 4.51 | 554.49 | 213.88 | −49. |
| 0.019 | 109468. | 7603. | −988. | −0.908 | 0.032 | −67.50 | 4.70 | 538.10 | 185.23 | −49. |
| 0.024 | 99644. | 7802. | −870. | −1.238 | 0.058 | −64.45 | 5.37 | 607.55 | 91.37 | −29. |
| 0.029 | 92730. | 8000. | −850. | −1.553 | 0.085 | −61.36 | 5.73 | 655.13 | 57.58 | −15. |
| 0.034 | 87743. | 8196. | −774. | −1.851 | 0.115 | −58.16 | 5.98 | 640.28 | 49.13 | −13. |
| 0.039 | 83326. | 8389. | −884. | −2.134 | 0.145 | −54.79 | 6.21 | 660.02 | 44.24 | −6. |
| 0.044 | 79753. | 8579. | −958. | −2.400 | 0.177 | −51.55 | 6.42 | 635.02 | 44.85 | −6. |
| 0.049 | 76738. | 8765. | −959. | −2.650 | 0.209 | −48.43 | 6.66 | 615.10 | 49.31 | −6. |
| 0.054 | 74176. | 8945. | −1017. | −2.884 | 0.243 | −45.28 | 6.92 | 641.00 | 55.04 | 0. |
| 0.059 | 71289. | 9120. | −1096. | −3.102 | 0.279 | −42.12 | 7.20 | 622.61 | 58.68 | 0. |
| 0.064 | 68383. | 9287. | −1164. | −3.305 | 0.315 | −39.06 | 7.50 | 604.62 | 62.54 | 0. |
| 0.069 | 65432. | 9447. | −1080. | −3.493 | 0.354 | −36.08 | 7.83 | 587.76 | 69.28 | 0. |
| 0.074 | 62809. | 9600. | −1250. | −3.666 | 0.394 | −33.18 | 8.18 | 573.57 | 73.51 | 0. |
| 0.079 | 60100. | 9743. | −1321. | −3.825 | 0.436 | −30.34 | 8.56 | 561.06 | 80.62 | 0. |
| 0.084 | 57131. | 9878. | −1426. | −3.970 | 0.479 | −27.57 | 8.98 | 548.37 | 87.31 | 0. |
| 0.089 | 53769. | 10003. | −1368. | −4.101 | 0.525 | −24.85 | 9.45 | 537.52 | 97.83 | 0. |
| 0.094 | 45765. | 10118. | −1749. | −4.218 | 0.574 | −22.27 | 9.91 | 473.20 | 71.29 | 0. |
| 0.099 | 35831. | 10224. | −2177. | −4.324 | 0.624 | −20.15 | 10.15 | 373.14 | 21.74 | 0. |
| 0.104 | 26836. | 10322. | −2351. | −4.421 | 0.675 | −18.54 | 10.14 | 270.59 | −29.09 | 0. |
| 0.109 | 18551. | 10415. | −1691. | −4.510 | 0.725 | −17.42 | 9.89 | 181.89 | −63.93 | 0. |
| 0.114 | 10694. | 10504. | −465. | −4.596 | 0.774 | −16.71 | 9.51 | 106.31 | −86.74 | 0. |
| 0.119 | 8550. | 10591. | −376. | −4.678 | 0.820 | −16.25 | 9.05 | 90.28 | −89.65 | 0. |
| 0.124 | 8252. | 10677. | −713. | −4.758 | 0.864 | −15.79 | 8.61 | 91.53 | −87.78 | 0. |
| 0.129 | 7954. | 10761. | −856. | −4.836 | 0.906 | −15.31 | 8.19 | 96.80 | −80.86 | 0. |
| 0.134 | 7681. | 10843. | −1167. | −4.911 | 0.946 | −14.83 | 7.79 | 97.00 | −80.01 | 0. |
| 0.139 | 7410. | 10923. | −1352. | −4.984 | 0.984 | −14.33 | 7.41 | 99.56 | −76.12 | 0. |
| 0.144 | 7147. | 11001. | −1576. | −5.054 | 1.020 | −13.83 | 7.04 | 100.39 | −74.28 | 0. |
| 0.149 | 6891. | 11077. | −1556. | −5.122 | 1.055 | −13.32 | 6.69 | 106.89 | −65.25 | 0. |
| 0.154 | 6643. | 11151. | −1893. | −5.188 | 1.087 | −12.80 | 6.35 | 103.39 | −68.60 | 0. |
| 0.159 | 6401. | 11222. | −1959. | −5.250 | 1.118 | −12.27 | 6.02 | 106.43 | −63.72 | 0. |
| 0.164 | 6166. | 11291. | −2010. | −5.310 | 1.147 | −11.74 | 5.70 | 109.39 | −58.86 | 0. |
| 0.169 | 5943. | 11358. | −2168. | −5.368 | 1.175 | −11.21 | 5.39 | 109.05 | −58.21 | 0. |

TABLE 6.2

| | | | | | | | | | | |
|---|---|---|---|---|---|---|---|---|---|---|
| 0.174 | 5719. | 11422. | −2445. | −5.422 | 1.201 | −10.66 | 5.09 | 107.17 | −62.38 | 0. |
| 0.179 | 5505. | 11483. | −2340. | −5.474 | 1.226 | −10.11 | 4.80 | 113.03 | −53.71 | 0. |
| 0.184 | 5299. | 11542. | −2562. | −5.523 | 1.249 | −9.56 | 4.52 | 109.27 | −57.22 | |
| 0.189 | 5095. | 11597. | −2710. | −5.570 | 1.271 | −9.00 | 4.24 | 107.07 | −58.72 | 0. |
| 0.194 | 4897. | 11650. | −2578. | −5.613 | 1.292 | −8.45 | 3.98 | 112.70 | −50.31 | 0. |
| 0.199 | 4697. | 11699. | −2647. | −5.654 | 1.311 | −7.89 | 3.71 | 111.86 | −49.96 | 0. |
| 0.204 | 4504. | 11745. | −2751. | −5.692 | 1.329 | −7.34 | 3.45 | 109.50 | −51.52 | 0. |
| 0.209 | 4314. | 11789. | −2654. | −5.728 | 1.346 | −6.79 | 3.20 | 113.17 | −45.57 | 0. |
| 0.214 | 4118. | 11829. | −2816. | −5.760 | 1.361 | −6.24 | 2.95 | 107.66 | −50.85 | 0. |
| 0.219 | 3917. | 11866. | −2743. | −5.790 | 1.375 | −5.70 | 2.70 | 109.41 | −47.06 | 0. |
| 0.224 | 3711. | 11899. | −2743. | −5.817 | 1.388 | −5.16 | 2.46 | 108.09 | −46.96 | 0. |
| 0.229 | 3496. | 11930. | −2756. | −5.842 | 1.400 | −4.63 | 2.23 | 105.36 | −48.36 | 0. |
| 0.234 | 3257. | 11957. | −2741. | −5.864 | 1.410 | −4.11 | 1.99 | 102.51 | −49.63 | 0. |
| 0.239 | 2996. | 11981. | −2643. | −5.883 | 1.420 | −3.59 | 1.75 | 101.97 | −47.92 | 0. |
| 0.244 | 2698. | 12002. | −2522. | −5.899 | 1.428 | −3.08 | 1.52 | 100.90 | −46.45 | 0. |
| 0.249 | 2363. | 12020. | −2381. | −5.914 | 1.435 | −2.58 | 1.29 | 99.35 | −45.24 | 0. |
| 0.254 | 1981. | 12035. | −2244. | −5.925 | 1.441 | −2.09 | 1.06 | 95.47 | −46.15 | 0. |
| 0.259 | 1577. | 12046. | −2095. | −5.934 | 1.445 | −1.62 | 0.83 | 91.64 | −46.97 | 0. |
| 0.264 | 1167. | 12055. | −1920. | −5.941 | 1.449 | −1.17 | 0.60 | 89.66 | −45.96 | 0. |
| 0.269 | 795. | 12061. | −1756. | −5.946 | 1.451 | −0.72 | 0.37 | 87.86 | −45.04 | 0. |
| 0.274 | 551. | 12064. | −1647. | −5.949 | 1.453 | −0.29 | 0.15 | 86.68 | −44.43 | 0. |

TABLE 7.1

ROD PULL AND TRACK FORCES COMPONENTS**********
Q.E. = 0.00 (DEGREES) SC (FEET) = 0.000 DATE 9-NOV-89 TIME 08:17:58

| TIME | U | Z | RBU | RBZ | RCU | RCZ | T1U | T1Z | T2U | T2Z |
|---|---|---|---|---|---|---|---|---|---|---|
| 0.000 | 0.000 | 0.000 | 500. | 0. | 7104. | 0. | 0. | −111. | 0. | 111. |
| 0.001 | 0.000 | 0.000 | 500. | 0. | 7104. | 0. | 0. | 1326. | 0. | 2874. |
| 0.002 | 0.000 | 0.000 | 500. | 0. | 7104. | 0. | 0. | 1326. | 0. | 2874. |
| 0.003 | −0.004 | 0.000 | 1727. | 0. | 7106. | 0. | −4. | −1666. | 0. | 6908. |
| 0.004 | −0.015 | 0.000 | 6347. | 0. | 7112. | 0. | −6. | −1755. | 0. | 7677. |
| 0.005 | −0.036 | 0.000 | 17182. | 0. | 7123. | 0. | −16. | −4707. | 0. | 10757. |
| 0.006 | −0.068 | 0.000 | 34828. | −1. | 7139. | 0. | −23. | −6548. | 0. | 12978. |
| 0.007 | −0.111 | 0.000 | 56761. | −3. | 7162. | 0. | −7. | −1755. | 1. | 11176. |
| 0.008 | −0.163 | 0.001 | 77749. | −6. | 7189. | −1. | 151. | 21467. | 0. | −1066. |

TABLE 7.1-continued

ROD PULL AND TRACK FORCES COMPONENTS**********

Q.E. = 0.00 (DEGREES) SC (FEET) = 0.000 DATE 9-NOV-89 TIME 08:17:58

| TIME | U | Z | RBU | RBZ | RCU | RCZ | T1U | T1Z | T2U | T2Z |
|---|---|---|---|---|---|---|---|---|---|---|
| 0.009 | −0.223 | 0.001 | 93349. | −15. | 7221. | −1. | 517. | 39787. | −2. | −10414. |
| 0.010 | −0.287 | 0.002 | 105776. | −31. | 7255. | −2. | 1019. | 50068. | −4. | −14486. |
| 0.011 | −0.354 | 0.004 | 112149. | −56. | 7291. | −4. | 1360. | 48789. | −6. | −12798. |
| 0.012 | −0.423 | 0.006 | 118531. | −92. | 7329. | −6. | 1749. | 49769. | −9. | −11483. |
| 0.013 | −0.494 | 0.009 | 119692. | −134. | 7367. | −8. | 1923. | 45399. | −9. | −8456. |
| 0.014 | −0.564 | 0.012 | 118187. | −180. | 7406. | −11. | 1841. | 37480. | −6. | −3728. |
| 0.015 | −0.634 | 0.015 | 116564. | −231. | 7446. | −15. | 1722. | 31229. | 0. | 187. |
| 0.016 | −0.703 | 0.019 | 115014. | −285. | 7485. | −19. | 1641. | 27143. | 7. | 2844. |
| 0.017 | −0.772 | 0.023 | 113187. | −341. | 7524. | −23. | 1528. | 23386. | 15. | 5110. |
| 0.018 | −0.840 | 0.028 | 111290. | −399. | 7564. | −27. | 1405. | 20123. | 25. | 7020. |
| 0.019 | −0.908 | 0.032 | 109467. | −457. | 7603. | −32. | 1294. | 17512. | 36. | 8528. |
| 0.024 | −1.238 | 0.058 | 99641. | −744. | 7801. | −58. | 855. | 9413. | 93. | 12478. |
| 0.029 | −1.553 | 0.085 | 92724. | −1026. | 7999. | −88. | 753. | 7204. | 143. | 12952. |
| 0.034 | −1.851 | 0.115 | 87733. | −1303. | 8195. | −122. | 886. | 7516. | 181. | 12164. |
| 0.039 | −2.134 | 0.145 | 83312. | −1566. | 8388. | −157. | 1066. | 8055. | 210. | 11188. |
| 0.044 | −2.400 | 0.177 | 79732. | −1825. | 8577. | −196. | 1349. | 9120. | 230. | 10062. |
| 0.049 | −2.650 | 0.209 | 76710. | −2080. | 8761. | −237. | 1759. | 10651. | 239. | 8804. |
| 0.054 | −2.884 | 0.243 | 74139. | −2337. | 8941. | −281. | 2285. | 12346. | 236. | 7501. |
| 0.059 | −3.102 | 0.279 | 71243. | −2571. | 9114. | −328. | 2850. | 13686. | 229. | 6349. |
| 0.064 | −3.305 | 0.315 | 68326. | −2792. | 9280. | −378. | 3528. | 15029. | 212. | 5206. |
| 0.069 | −3.493 | 0.354 | 65364. | −2996. | 9438. | −431. | 4464. | 16822. | 178. | 3889. |
| 0.074 | −3.666 | 0.394 | 62727. | −3201. | 9587. | −487. | 5461. | 18129. | 142. | 2787. |
| 0.079 | −3.825 | 0.436 | 60004. | −3388. | 9728. | −547. | 6848. | 19906. | 84. | 1488. |
| 0.084 | −3.970 | 0.479 | 57021. | −3545. | 9859. | −610. | 8548. | 21592. | 12. | 193. |
| 0.089 | −4.101 | 0.525 | 53644. | −3657. | 9980. | −677. | 11025. | 23965. | −98. | −1437. |
| 0.094 | −4.218 | 0.574 | 45639. | −3399. | 10091. | −748. | 10662. | 19846. | −54. | −728. |
| 0.099 | −4.324 | 0.624 | 35714. | −2895. | 10191. | −822. | 6903. | 11326. | 140. | 1737. |
| 0.104 | −4.421 | 0.675 | 26733. | −2344. | 10283. | −897. | 1463. | 2196. | 407. | 4657. |
| 0.109 | −4.510 | 0.725 | 18469. | −1741. | 10370. | −971. | −2893. | −4141. | 617. | 6565. |
| 0.114 | −4.596 | 0.774 | 10640. | −1071. | 10452. | −1045. | −5879. | −8282. | 767. | 7650. |
| 0.119 | −4.678 | 0.820 | 8502. | −907. | 10532. | −1116. | −6431. | −9121. | 818. | 7690. |
| 0.124 | −4.758 | 0.864 | 8200. | −923. | 10611. | −1186. | −6435. | −9188. | 843. | 7521. |
| 0.129 | −4.836 | 0.906 | 7899. | −933. | 10687. | −1253. | −5715. | −8206. | 811. | 6894. |
| 0.134 | −4.911 | 0.946 | 7623. | −941. | 10762. | −1317. | −5842. | −8427. | 838. | 6821. |
| 0.139 | −4.984 | 0.984 | 7349. | −944. | 10835. | −1380. | −5523. | −7998. | 827. | 6464. |
| 0.144 | −5.054 | 1.020 | 7085. | −944. | 10906. | −1441. | −5486. | −7969. | 836. | 6302. |
| 0.149 | −5.122 | 1.055 | 6827. | −941. | 10975. | −1499. | −4391. | −6393. | 745. | 5433. |
| 0.154 | −5.188 | 1.087 | 6577. | −935. | 11042. | −1555. | −5088. | −7419. | 818. | 5779. |
| 0.159 | −5.250 | 1.118 | 6334. | −926. | 11106. | −1609. | −4567. | −6666. | 772. | 5305. |
| 0.164 | −5.310 | 1.147 | 6097. | −916. | 11169. | −1661. | −4031. | −5885. | 721. | 4824. |
| 0.169 | −5.368 | 1.175 | 5874. | −904. | 11228. | −1711. | −4109. | −5999. | 731. | 4772. |

TABLE 7.2

| | | | | | | | | | | |
|---|---|---|---|---|---|---|---|---|---|---|
| 0.174 | −5.422 | 1.201 | 5650. | −889. | 11286. | −1759. | −4918. | −7171. | 819. | 5229. |
| 0.179 | −5.474 | 1.226 | 5436. | −874. | 11341. | −1804. | −3759. | −5469. | 692. | 4327. |
| 0.184 | −5.523 | 1.249 | 5229. | −857. | 11393. | −1848. | −4463. | −6474. | 770. | 4725. |
| 0.189 | −5.570 | 1.271 | 5026. | −838. | 11442. | −1889. | −4855. | −7020. | 815. | 4913. |
| 0.194 | −5.613 | 1.292 | 4829. | −819. | 11489. | −1928. | −3674. | −5291. | 676. | 4005. |
| 0.199 | −5.654 | 1.311 | 4629. | −797. | 11533. | −1965. | −3755. | −5383. | 682. | 3983. |
| 0.204 | −5.692 | 1.329 | 4437. | −774. | 11574. | −1999. | −4136. | −5898. | 725. | 4175. |
| 0.209 | −5.728 | 1.346 | 4248. | −751. | 11612. | −2031. | −3287. | −4660. | 618. | 3512. |
| 0.214 | −5.760 | 1.361 | 4053. | −725. | 11648. | −2061. | −4274. | −6020. | 735. | 4132. |
| 0.219 | −5.790 | 1.375 | 3854. | −697. | 11680. | −2089. | −3753. | −5248. | 666. | 3705. |
| 0.224 | −5.817 | 1.388 | 3650. | −666. | 11710. | −2114. | −3839. | −5326. | 672. | 3702. |
| 0.229 | −5.842 | 1.400 | 3438. | −633. | 11737. | −2138. | −4179. | −5745. | 709. | 3874. |
| 0.234 | −5.864 | 1.410 | 3202. | −594. | 11761. | −2158. | −4494. | −6120. | 743. | 4028. |
| 0.239 | −5.883 | 1.420 | 2945. | −550. | 11782. | −2177. | −4284. | −5775. | 710. | 3824. |
| 0.244 | −5.899 | 1.428 | 2651. | −498. | 11800. | −2193. | −4105. | −5468. | 680. | 3640. |
| 0.249 | −5.914 | 1.435 | 2322. | −439. | 11816. | −2207. | −3959. | −5207. | 654. | 3479. |
| 0.254 | −5.925 | 1.441 | 1947. | −369. | 11828. | −2219. | −4193. | −5438. | 673. | 3570. |
| 0.259 | −5.934 | 1.445 | 1550. | −295. | 11839. | −2228. | −4379. | −5633. | 689. | 3641. |
| 0.264 | −5.941 | 1.449 | 1146. | −219. | 11846. | −2235. | −4187. | −5381. | 661. | 3481. |
| 0.269 | −5.946 | 1.451 | 781. | −149. | 11851. | −2240. | −4005. | −5145. | 634. | 3333. |
| 0.274 | −5.949 | 1.453 | 541. | −104. | 11854. | −2243. | −3883. | −4986. | 615. | 3235. |

TABLE 8

TUBE DYNAMIC AND VERTICAL GROUND REACTION**********

Q.E. = 70.00 (DEGREES) SC (FEET) = 0.800 DATE 9-NOV-89 TIME 08:07:25

| TIME | RBE | RCE | R2Y | U | Z | VU | VZ | AU | AZ | IMPE E-3 |
|---|---|---|---|---|---|---|---|---|---|---|
| 0.000 | 500. | 7104. | 6896. | 0.000 | 0.000 | 0.00 | 0.00 | 0.00 | 0.00 | 0. |
| 0.001 | 500. | 7104. | 6896. | 0.000 | 0.000 | 0.00 | 0.00 | 0.00 | 0.00 | 0. |
| 0.002 | 500. | 7104. | 6896. | 0.000 | 0.000 | 0.00 | 0.00 | 0.00 | 0.00 | 0. |
| 0.003 | 1737. | 7106. | 12861. | −0.004 | 0.000 | −7.17 | 0.02 | −7159.24 | 24.81 | −939. |
| 0.004 | 6392. | 7112. | 16549. | −0.015 | 0.000 | −15.64 | 0.05 | −8451.56 | 29.35 | −1112. |

TABLE 8-continued

TUBE DYNAMIC AND VERTICAL GROUND REACTION**********

Q.E. = 70.00 (DEGREES) SC (FEET) = 0.800 DATE 9-NOV-89 TIME 08:07:25

| TIME | RBE | RCE | R2Y | U | Z | VU | VZ | AU | AZ | IMPE E-3 |
|---|---|---|---|---|---|---|---|---|---|---|
| 0.005 | 17296. | 7123. | 24916. | −0.036 | 0.000 | −26.40 | 0.09 | −10719.08 | 38.41 | −1419. |
| 0.006 | 35046. | 7139. | 37435. | −0.068 | 0.000 | −37.86 | 0.13 | −11389.98 | 40.90 | −1524. |
| 0.007 | 57106. | 7162. | 52599. | −0.111 | 0.000 | −48.47 | 0.18 | −10515.74 | 101.83 | −1433. |
| 0.008 | 78225. | 7189. | 67653. | −0.164 | 0.001 | −56.81 | 0.40 | −8245.54 | 328.99 | −1159. |
| 0.009 | 93949. | 7221. | 79389. | −0.224 | 0.001 | −62.31 | 0.80 | −5432.58 | 489.50 | −810. |
| 0.010 | 106494. | 7255. | 89749. | −0.288 | 0.002 | −66.38 | 1.34 | −4022.09 | 578.49 | −639. |
| 0.011 | 112967. | 7292. | 95092. | −0.355 | 0.004 | −68.40 | 1.88 | −1996.86 | 547.43 | −382. |
| 0.012 | 119451. | 7329. | 101426. | −0.425 | 0.006 | −70.37 | 2.43 | −1944.28 | 552.90 | −382. |
| 0.013 | 120726. | 7368. | 102836. | −0.495 | 0.009 | −70.77 | 2.93 | −387.33 | 491.45 | −180. |
| 0.014 | 120016. | 7408. | 102444. | −0.566 | 0.012 | −70.37 | 3.36 | 397.98 | 402.94 | −76. |
| 0.015 | 119299. | 7447. | 102188. | −0.636 | 0.015 | −69.92 | 3.73 | 444.46 | 337.33 | −68. |
| 0.016 | 118613. | 7486. | 101976. | −0.706 | 0.019 | −69.48 | 4.04 | 435.85 | 292.65 | −68. |
| 0.017 | 117935. | 7526. | 101544. | −0.775 | 0.023 | −68.94 | 4.31 | 532.31 | 250.45 | −55. |
| 0.018 | 117262. | 7566. | 101037. | −0.844 | 0.028 | −68.37 | 4.54 | 569.02 | 214.03 | −49. |
| 0.019 | 116602. | 7606. | 100519. | −0.912 | 0.033 | −67.80 | 4.74 | 561.32 | 184.68 | −49. |
| 0.024 | 113552. | 7805. | 97347. | −1.243 | 0.058 | −64.51 | 5.39 | 681.17 | 84.75 | −29. |
| 0.029 | 110762. | 8002. | 94301. | −1.557 | 0.086 | −60.98 | 5.70 | 759.00 | 45.94 | −15. |
| 0.034 | 108183. | 8196. | 91612. | −1.852 | 0.115 | −57.21 | 5.88 | 761.33 | 33.30 | −13. |
| 0.039 | 105744. | 8385. | 88757. | −2.128 | 0.145 | −53.20 | 6.01 | 794.22 | 20.42 | −6. |
| 0.044 | 103492. | 8568. | 86193. | −2.384 | 0.175 | −49.27 | 6.10 | 777.43 | 15.15 | −6. |
| 0.049 | 101417. | 8743. | 83741. | −2.621 | 0.206 | −45.42 | 6.17 | 762.00 | 10.93 | −6. |
| 0.054 | 99615. | 8910. | 81310. | −2.838 | 0.237 | −41.54 | 6.21 | 789.90 | 4.89 | 0. |
| 0.059 | 97941. | 9066. | 78737. | −3.036 | 0.268 | −37.62 | 6.21 | 775.84 | −4.38 | 0. |
| 0.064 | 96478. | 9212. | 75989. | −3.215 | 0.299 | −33.78 | 6.15 | 761.87 | −17.75 | 0. |
| 0.069 | 95240. | 9345. | 73058. | −3.374 | 0.329 | −30.00 | 6.02 | 747.81 | −34.72 | 0. |
| 0.074 | 94252. | 9466. | 69944. | −3.515 | 0.359 | −26.30 | 5.79 | 733.53 | −54.97 | 0. |
| 0.079 | 93544. | 9574. | 66676. | −3.637 | 0.387 | −22.67 | 5.46 | 719.05 | −78.04 | 0. |
| 0.084 | 93123. | 9668. | 63281. | −3.742 | 0.413 | −19.11 | 5.01 | 704.19 | −103.62 | 0. |
| 0.089 | 93027. | 9747. | 59832. | −3.829 | 0.437 | −15.63 | 4.42 | 689.25 | −131.36 | 0. |
| 0.094 | 93254. | 9811. | 56522. | −3.898 | 0.457 | −12.22 | 3.70 | 675.09 | −159.39 | 0. |
| 0.099 | 93805. | 9860. | 53650. | −3.951 | 0.473 | −8.87 | 2.83 | 663.38 | −185.22 | 0. |
| 0.104 | 95502. | 9894. | 51896. | −3.987 | 0.485 | −5.57 | 1.85 | 661.47 | −208.25 | 0. |
| 0.109 | 69724. | 9913. | 39449. | −4.006 | 0.492 | −2.31 | 0.78 | 489.22 | −163.93 | 0. |
| 0.114 | 14526. | 9920. | 15783. | −4.014 | 0.494 | −1.04 | 0.36 | 136.40 | −46.26 | 0. |
| 0.119 | 4453. | 9924. | 11486. | −4.018 | 0.496 | −0.55 | 0.19 | 72.21 | −24.70 | 0. |
| 0.124 | 1312. | 9926. | 10151. | −4.020 | 0.496 | −0.25 | 0.09 | 52.23 | −17.97 | 0. |
| 0.129 | 501. | 9926. | 9806. | −4.021 | 0.496 | −0.01 | 0.00 | 47.07 | −16.23 | 0. |

TABLE 9

ROD PULL AND TRACK FORCES COMPONENTS**********

Q.E. = 70.00 (DEGREES) SC (FEET) = 0.800 DATE 9-NOV-89 TIME 08:07:25

| TIME | U | Z | RBU | RBZ | RCU | RCZ | T1U | T1Z | T2U | T2Z |
|---|---|---|---|---|---|---|---|---|---|---|
| 0.000 | 0.000 | 0.000 | 500. | 0. | 7104. | 0. | 0. | −111. | 0. | 111. |
| 0.001 | 0.000 | 0.000 | 500. | 0. | 7104. | 0. | 0. | 843. | 0. | 594. |
| 0.002 | 0.000 | 0.000 | 500. | 0. | 7104. | 0. | 0. | 843. | 0. | 594. |
| 0.003 | −0.004 | 0.000 | 1737. | 0. | 7106. | 0. | −6. | −2449. | 0. | 4998. |
| 0.004 | −0.015 | 0.000 | 6392. | 0. | 7112. | 0. | −11. | −3585. | 0. | 6365. |
| 0.005 | −0.036 | 0.000 | 17296. | 0. | 7123. | 0. | −19. | −5759. | 0. | 9011. |
| 0.006 | −0.068 | 0.000 | 35046. | −1. | 7139. | 0. | −27. | −7984. | 0. | 11453. |
| 0.007 | −0.111 | 0.000 | 57106. | −3. | 7162. | 0. | −12. | −3178. | 0. | 9649. |
| 0.008 | −0.164 | 0.001 | 78225. | −6. | 7189. | −1. | 147. | 20726. | 0. | −2940. |
| 0.009 | −0.224 | 0.001 | 93949. | −15. | 7221. | −1. | 511. | 39102. | −2. | −12288. |
| 0.010 | −0.288 | 0.002 | 106494. | −31. | 7255. | −2. | 1010. | 49380. | −5. | −16325. |
| 0.011 | −0.355 | 0.004 | 112967. | −57. | 7292. | −4. | 1347. | 48088. | −7. | −14598. |
| 0.012 | −0.425 | 0.006 | 119451. | −93. | 7329. | −6. | 1733. | 49117. | −10. | −13274. |
| 0.013 | −0.495 | 0.009 | 120726. | −136. | 7368. | −8. | 1898. | 44630. | −11. | −10149. |
| 0.014 | −0.566 | 0.012 | 120016. | −184. | 7407. | −11. | 1801. | 36522. | −8. | −5258. |
| 0.015 | −0.636 | 0.015 | 119299. | −238. | 7447. | −15. | 1666. | 30128. | −2. | −1201. |
| 0.016 | −0.706 | 0.019 | 118613. | −296. | 7486. | −19. | 1570. | 25878. | 4. | 1603. |
| 0.017 | −0.775 | 0.023 | 117935. | −358. | 7526. | −23. | 1434. | 21872. | 12. | 4072. |
| 0.018 | −0.844 | 0.028 | 117261. | −423. | 7566. | −27. | 1286. | 18359. | 22. | 6183. |
| 0.019 | −0.912 | 0.033 | 116601. | −491. | 7606. | −32. | 1150. | 15525. | 33. | 7872. |
| 0.024 | −1.243 | 0.058 | 113548. | −853. | 7804. | −59. | 532. | 5845. | 97. | 12935. |
| 0.029 | −1.557 | 0.086 | 110755. | −1230. | 8002. | −89. | 245. | 2337. | 157. | 14151. |
| 0.034 | −1.852 | 0.115 | 108171. | −1608. | 8195. | −122. | 181. | 1533. | 206. | 13872. |
| 0.039 | −2.128 | 0.145 | 105726. | −1979. | 8384. | −157. | 51. | 384. | 254. | 13586. |
| 0.044 | −2.384 | 0.175 | 103465. | −2342. | 8566. | −194. | −1. | −6. | 294. | 12981. |
| 0.049 | −2.621 | 0.206 | 101381. | −2698. | 8740. | −232. | −68. | −418. | 330. | 12400. |
| 0.054 | −2.838 | 0.237 | 99569. | −3049. | 8905. | −272. | −228. | −1259. | 366. | 11980. |
| 0.059 | −3.036 | 0.268 | 97882. | −3392. | 9061. | −313. | −568. | −2828. | 411. | 11880. |
| 0.064 | −3.215 | 0.299 | 96406. | −3727. | 9205. | −355. | −1170. | −5265. | 469. | 12145. |
| 0.069 | −3.374 | 0.329 | 95154. | −4055. | 9337. | −397. | −2088. | −8517. | 543. | 12759. |
| 0.074 | −3.515 | 0.359 | 94151. | −4373. | 9456. | −438. | −3378. | −12539. | 636. | 13716. |
| 0.079 | −3.637 | 0.387 | 93427. | −4682. | 9562. | −477. | −5079. | −17243. | 750. | 14996. |
| 0.084 | −3.742 | 0.413 | 92990. | −4977. | 9654. | −515. | −7216. | −22540. | 886. | 16580. |
| 0.089 | −3.829 | 0.437 | 92879. | −5256. | 9731. | −549. | −9774. | −28321. | 1042. | 18441. |

TABLE 9-continued

ROD PULL AND TRACK FORCES COMPONENTS**********
Q.E. = 70.00 (DEGREES) SC (FEET) = 0.800 DATE 9-NOV-89 TIME 08:07:25

| TIME | U | Z | RBU | RBZ | RCU | RCZ | T1U | T1Z | T2U | T2Z |
|---|---|---|---|---|---|---|---|---|---|---|
| 0.094 | −3.898 | 0.457 | 93091. | −5515. | 9794. | −578. | −12594. | −34192. | 1208. | 20436. |
| 0.099 | −3.951 | 0.473 | 93628. | −5746. | 9842. | −601. | −15383. | −39626. | 1370. | 22365. |
| 0.104 | −3.987 | 0.485 | 95314. | −5996. | 9875. | −619. | −17949. | −44521. | 1522. | 24241. |
| 0.109 | −4.006 | 0.492 | 69583. | −4437. | 9893. | −628. | −14081. | −34195. | 1166. | 18335. |
| 0.114 | −4.014 | 0.494 | 14496. | −929. | 9900. | −632. | −3034. | −7305. | 254. | 3975. |
| 0.119 | −4.018 | 0.496 | 4443. | −286. | 9904. | −634. | −992. | −2378. | 86. | 1345. |
| 0.124 | −4.020 | 0.496 | 1309. | −84. | 9905. | −635. | −351. | −839. | 34. | 524. |
| 0.129 | −4.021 | 0.496 | 500. | −32. | 9906. | −635. | −185. | −442. | 20. | 311. |

We claim:

1. A gun system having a firing cycle and a moment of static weight, firing of said gun system producing recoil forces having an instantaneous stabilizing moment and an instantaneous destabilizing moment, said gun system comprising:

a recoiling cannon assembly having a tube axis, a center of mass, an initial prefiring position, and an initial prefiring orientation;

a cradle portion relatively fixed during the firing cycle for elevating said cannon assembly;

a carriage portion supporting said cradle portion, said carriage portion being fixed in ground contact when said gun system is fired and said carriage portion and said cradle portion remaining substantially relatively fixed with respect to each other during the firing cycle of said gun system;

mounting means for movably mounting said cannon assembly with respect to said cradle portion for travel along to two-stage curvilinear path, at least a portion of said first stage having a curved configuration for producing an upward force and vertical acceleration component to said center of mass of said recoiling cannon assembly during said first stage, said upward force causing a reaction resulting in forces having an instantaneous stabilizing moment, and said second stage having a configuration different from that of said first stage for causing controlled vertical deceleration of said cannon assembly during recoil;

recoil braking means for applying a relatively high retarding force to said cannon assembly while said cannon assembly is travelling along said curved configuration portion of said first stage of said curvilinear path and for applying a relatively low retarding force to said cannon assembly while said cannon assembly is travelling along said second stage of said curvilinear path, said relatively high and low retarding forces having magnitudes which are matched to said configurations of said first and second stages, respectively, of said curvilinear path, whereby the instantaneous destabilizing moment of the recoil forces is overcome by the instantaneous stabilizing moment of the forces resulting from the reaction to the upward force of said recoiling cannon assembly in said curved configuration portion of said first stage and the moment of static weight of said gun system; and return means for returning said cannon assembly to its initial prefiring position at the end of recoil.

2. The gun system of claim 1, wherein said first stage of said curvilinear path also has a linear portion shaped to maintain the prefiring orientation of said cannon assembly at the beginning of recoil.

3. The gun system of claim 1, wherein said second stage of said two-stage curvilinear recoil path is straight.

4. The gun system of claim 1, wherein said second stage of said curvilinear path has a curved configuration and said second stage is curved in the same direction as said curved configuration portion of said first stage of said curvilinear path, the curve of said second stage being shallower than the curve of said curved configuration portion of said first stage.

5. The gun system of claim 1, wherein said mounting means comprises means for producing rotation of said tube axis only in a vertical plane.

6. A gun system having a firing cycle and a moment of static weight, firing of said gun system producing recoil forces having an instantaneous stabilizing moment and an instantaneous destabilizing moment, said gun system comprising:

a recoiling cannon assembly having a tube axis, a center of mass, an initial prefiring position, and an initial prefiring orientation;

a cradle portion relatively fixed during the firing cycle for elevating said cannon assembly;

a carriage portion supporting said cradle portion, said carriage portion being fixed in ground contact when said gun system is fired and said carriage portion and said cradle portion remaining substantially relatively fixed with respect to each other during the firing cycle of said gun system;

mounting means for movably mounting said cannon assembly with respect to said cradle portion for travel along a two-stage curvilinear path, at least a portion of said first stage having a curved configuration for producing an upward force and vertical acceleration component to said center of mass of said recoiling cannon assembly during said first stage, said upward force causing a reaction resulting in forces having an instantaneous stabilizing moment, and said second stage having a configuration different from that of said first stage for causing controlled vertical deceleration of said cannon assembly during recoil;

pivoting, sliding interface means positioned on said cradle portion for slidably receiving said cannon assembly, said cannon assembly rotating about said interface means when said cannon assembly is travelling along said second stage;

recoil braking means for applying a relatively high retarding force to said cannon assembly while said cannon assembly is travelling along said curved configuration portion of said first stage of said curvilinear path and for applying a relatively low retarding force to said cannon assembly while said cannon assembly is travelling along said second stage of said curvilinear path, said relatively high and low retarding forces having magnitudes which are matched to said configurations of said first and second stages, respectivley, of said curvilinear path, whereby the instantaneous destabilizing moment of the recoil forces is overcome by the instantaneous stabilizing moment of the forces resulting from the reaction to the upward force of said recoiling cannon assembly in said curved configuration portion of said first stage and the moment of static weight of said gun system; and return means for returning said cannon assembly to its initial prefiring position at the end of recoil.

7. A gun system having a firing cycle and a moment of static weight, firing of said gun system producing recoil forces having an instantaneous stabilizing moment and an instantaneous destabilizing moment, said gun system comprising:

a recoiling cannon assembly having a tube axis, a center of mass, an initial prefiring position, and an initial prefiring orientation;

a cradle portion relatively fixed during the firing cycle for elevating said cannon assembly;

a carriage portion supporting said cradle portion, said carriage portion being fixed in ground contact when said gun system is fired and said carriage portion and said cradle portion remaining substantially relatively fixed with respect to each other during the firing cycle of said gun system;

mounting means for movably mounting said cannon assembly with respect to said cradle portion for travel along a two-stage curvilinear path, at least a portion of said first stage having a curved configuration for producing an upward force and vertical acceleration component to said center of mass of said recoiling cannon assembly during said first stage, said upward force causing a reaction resulting in forces having an instantaneous stabilizing moment, said second stage having a configuration different from that of said first stage for causing controlled vertical deceleration of said cannon assembly during recoil, and said second stage of said curvilinear path is curved in the opposite direction to that of said curved configuration portion of said first stage of said curvilinear path;

recoil braking means for applying a relatively high retarding force to said cannon assembly while said cannon assembly is travelling along said curved configuration portion of said first stage of said curvilinear path and for applying a relatively low retarding force to said cannon assembly while said cannon assembly is travelling along said second stage of said curvilinear path, said relatively high and low retarding forces having magnitudes which are matched to said configurations of said first and second stages, respectivley, of said curvilinear path, whereby the instantaneous destabilizing moment of the recoil forces is overcome by the instantaneous stabilizing moment of the forces resulting from the reaction to the upward force of said recoiling cannon assembly in said curved configuration portion of said first stage and the moment of static weight of said gun system; and return means for returning said cannon assembly to its initial prefiring position at the end of recoil.

8. A gun system comprising:

a recoiling cannon assembly having a center of mass, an initial prefiring position, and an initial prefiring orientation;

a cradle portion relatively fixed during firing for elevating said cannon assembly;

a carriage portion supporting said cradle portion, said carriage portion remaining fixed in ground contact when said gun system is fired and said carriage portion and said cradle potion being substantially relatively fixed with respect to each other during the firing cycle of said gun system;

campath means and cam follower means associated with said campath means for movably mounting said cannon assembly on said cradle portion for travel along said campath means, said campath means defining a two-stage curvilinear recoil path, said first stage having a curved configuration portion to produce an upward force and vertical acceleration component to said center of mass of said recoiling cannon assembly during said first stage, said upward force causing a reaction resulting in forces having an instantaneous stabilizing moment and an instantaneous destabilizing moment, and said second stage having a configuration different from that of said first stage for causing controlled vertical deceleration of said cannon assembly during recoil;

recoil braking means for applying a relatively high retarding force to said cannon assembly while said cannon assembly is travelling along said first stage of said curvilinear path and for applying a relatively low retarding force to said cannon assembly while said cannon assembly is travelling along said second stage of said curvilinear path, said relatively high and low retarding forces having magnitudes which are matched to said configurations of said first and second stages, respectivley, of said curvilinear path, whereby the instantaneous destabilizing moment of the recoil forces is overcome by the instantaneous stabilizing moment of the forces resulting from the reaction to the upward force of said recoiling cannon assembly in said curved configuration portion of said first stage and the moment of static weight of said gun system; and storage means for storing a portion of the recoil energy of said cannon portion and returning said cannon portion to its initial prefiring position, using the stored recoil energy.

9. The gun system of claim 8, wherein said campath means comprises left and right tracks positioned aft of the center of mass of said cannon assembly.

10. The gun system of claim 8, wherein said campath means is fixedly mounted on said cradle portion and said cam follower means is fixedly mounted on said cannon assembly.

11. The gun system of claim 8, wherein said campath means is fixedly mounted on said cannon assembly and said cam follower means is fixedly mounted on said cradle portion.

12. A gun system comprising:

a recoiling cannon assembly having a center of mass, an initial prefiring position, and an initial prefiring orientation;

a cradle portion relatively fixed during firing for elevating said cannon assembly;

a carriage portion supporting said cradle portion, said carriage portion remaining fixed in ground contact when said gun system is fired and said carriage portion and said cradle potion being substantially relatively fixed with respect to each other during the firing cycle of said gun system;

campath means and cam follower means associated with said campath means for movably mounting said cannon assembly on said cradle portion for travel along said campath means, said campath means defining a two-stage curvilinear recoil path, said first stage having a curved configuration portion to produce an upward force and vertical acceleration component to said center of mass of said recoiling cannon assembly during said first stage, said upward force causing a reaction resulting in forces having an instantaneous stabilizing moment and an instantaneous destabilizing moment, and said second stage having a configuration different from that of said first stage for causing controlled vertical deceleration of said cannon assembly during recoil;

pivoting, sliding interface means positioned on said cradle portion for slidably receiving said cannon assembly, said cannon assembly rotating about said interface means when said cannon assembly is travelling along said second stage;

recoil braking means for applying a relatively high retarding force to said cannon assembly while said cannon assembly is travelling along said first stage of said curvilinear path and for applying a relatively low retarding force to said cannon assembly while said cannon assembly is travelling along said second stage of said curvilinear path, said relatively high and low retarding forces having magnitudes which are matched to said configurations of said first and second stages, respectivley, of said curvilinear path, whereby the instantaneous destabilizing moment of the recoil forces is overcome by the instantaneous stabilizing moment of the forces resulting from the reaction to the upward force of said recoiling cannon assembly in said curved configuration portion of said first stage and the moment of static weight of said gun system; and storage means for storing a portion of the recoil energy of said cannon portion and returning said cannon portion to its initial prefiring position, using the stored recoil energy.

13. A method for stabilizing a gun system upon firing, the gun system comprising a recoiling cannon assembly having a center of mass, an initial prefiring position, and an initial prefiring orientation, a cradle portion relatively fixed during the firing cycle for elevating the cannon assembly, a carriage portion supporting the cradle portion, the carriage portion being fixed in ground contact when the gun system is fired and said carriage portion and said cradle portion remaining substantially relatively fixed with respect to each other during the firing cycle of said gun system, said method comprising the steps of:

providing a path having first and second stages for displacing the cannon assembly during recoil;

producing an upward force and vertical acceleration component to the center of mass of the recoiling cannon assembly as it recoils by displacing the cannon assembly along the first stage of the path;

following said producing step, vertically decelerating the cannon assembly in a controlled fashion by displacing the cannon assembly along the second stage of the path; and applying a relatively high retarding force to the cannon assembly while the cannon assembly is travelling along the first stage of the path and a relatively low retarding force to the cannon assembly while the cannon assembly is travelling along the second stage of the path, to predictably and controllably decelerate the cannon assembly during said producing and decelerating steps, the relatively high and low retarding forces having magnitudes which are matched to the configurations of the first and second stages, respectively, of the path.

* * * * *